US011910938B2

(12) United States Patent
Twohy et al.

(10) Patent No.: US 11,910,938 B2
(45) Date of Patent: Feb. 27, 2024

(54) CASE FRAME AND DOOR ASSEMBLY FOR A MERCHANDISER

(71) Applicant: Hussmann Corporation, Bridgeton, MO (US)

(72) Inventors: Raymond P. Twohy, Saint Peters, MO (US); Delanie M. Parmenter, O'Fallon, MO (US); Daniel E. Schnur, Saint Peters, MO (US)

(73) Assignee: Hussmann Corporation, Bridgeton, MO (US)

( * ) Notice: Subject to any disclaimer, the term of this patent is extended or adjusted under 35 U.S.C. 154(b) by 0 days.

(21) Appl. No.: 17/532,911

(22) Filed: Nov. 22, 2021

(65) Prior Publication Data

US 2022/0079352 A1 Mar. 17, 2022

Related U.S. Application Data

(63) Continuation of application No. 16/345,197, filed as application No. PCT/US2016/058886 on Oct. 26, 2016, now Pat. No. 11,178,981.

(51) Int. Cl.
*A47F 3/04* (2006.01)
*A47F 3/00* (2006.01)

(52) U.S. Cl.
CPC ..... *A47F 3/001* (2013.01); *A47F 3/04* (2013.01); *A47F 3/0426* (2013.01); *A47F 3/0434* (2013.01)

(58) Field of Classification Search
CPC ..... A47F 3/001; A47F 3/04; A47F 3/0426; A47F 3/0434
See application file for complete search history.

(56) References Cited

U.S. PATENT DOCUMENTS 4,248,489 A 2/1981 Barroero
4,671,582 A 6/1987 Stromquist
5,255,531 A 10/1993 Williams et al.
(Continued)

FOREIGN PATENT DOCUMENTS

EP 3033975 A1 6/2016
WO 9945331 A2 9/1999
(Continued)

OTHER PUBLICATIONS

International Search Report and Written Opinion for Application No. PCT/US2016/058886 dated Jul. 19, 2017, (44 pages).
(Continued)

*Primary Examiner* — James O Hansen
(74) *Attorney, Agent, or Firm* — Michael Best & Friedrich LLP

(57) ABSTRACT

A mullion assembly for a merchandiser including an elongated mullion body that has a first end and a second end. The mullion body defines an elongated channel extending from the first end toward the second end along a longitudinal axis oriented along a length of the mullion body. The channel is defined by a support surface, opposite sidewalls, and opposite hooks that are coupled to the sidewalls and that extend in a direction across the longitudinal axis. A light assembly is coupled to the mullion body within the elongated channel, and the light assembly is captured by the hooks to retain the light assembly in the channel.

14 Claims, 50 Drawing Sheets

(56) References Cited

U.S. PATENT DOCUMENTS

| | | | | |
|---|---|---|---|---|
| 8,539,783 | B1 * | 9/2013 | Bunch | F25D 21/04 62/154 |
| 2001/0003408 | A1 | 6/2001 | Otto et al. | |
| 2004/0172892 | A1 | 9/2004 | Cremaschi | |
| 2004/0182009 | A1 | 9/2004 | Flory et al. | |
| 2006/0038412 | A1 | 2/2006 | Muramatsu et al. | |
| 2008/0007945 | A1 * | 1/2008 | Kelly | F25D 21/04 362/218 |
| 2008/0158858 | A1 * | 7/2008 | Madireddi | F21V 19/0045 62/251 |
| 2008/0205043 | A1 * | 8/2008 | Shibusawa | A47F 3/001 362/125 |
| 2011/0050065 | A1 | 3/2011 | Lee et al. | |
| 2011/0058357 | A1 | 3/2011 | Anderson | |
| 2011/0083460 | A1 * | 4/2011 | Thomas | F21S 4/28 62/264 |
| 2011/0304253 | A1 * | 12/2011 | Howington | F25D 27/00 312/405 |
| 2011/0304254 | A1 | 12/2011 | Stubblefield | |
| 2013/0249371 | A1 | 9/2013 | Lively et al. | |
| 2013/0285517 | A1 | 10/2013 | Wach et al. | |
| 2013/0334938 | A1 | 12/2013 | Dickey et al. | |
| 2015/0223619 | A1 | 8/2015 | Artwohl et al. | |
| 2016/0047592 | A1 * | 2/2016 | Rolek | F25D 23/065 312/406.1 |

FOREIGN PATENT DOCUMENTS

| | | | |
|---|---|---|---|
| WO | 0075561 | A1 | 12/2000 |
| WO | 2005119124 | A2 | 12/2005 |
| WO | 2006113961 | A2 | 11/2006 |

OTHER PUBLICATIONS

New Zealand Patent Office Examination Report No. 1 for Application No. 781578 dated Jul. 28, 2023 (4 pages).

* cited by examiner

CASE FRAME AND DOOR ASSEMBLY FOR A MERCHANDISER

CROSS-REFERENCE TO RELATED APPLICATIONS

This application is continuation of U.S. patent application Ser. No. 16/345197, filed Apr. 25, 2019, now U.S. Pat. No. 11,178,981, which is a national phase application filing of International Patent Application No. PCT/US2016/058886, filed Oct. 26, 2016, the entire contents of each of which are incorporated herein by reference.

BACKGROUND

The present invention relates to merchandisers and, more particularly, to door assemblies for refrigerated merchandisers.

Existing walk-in coolers and refrigerated merchandisers (collectively referred to as 'merchandisers') generally include structure that defines a product support or display area for supporting and displaying products (e.g., for stocking or selection of products, or to be visible and accessible through an opening in the front of the merchandiser). Merchandisers are generally used in retail food store applications such as grocery or convenient stores or other locations where food product is displayed in a refrigerated condition. Some merchandisers include doors to enclose the product display area of the case and reduce the amount of cold air released into the surrounding environment. The doors typically include one or more glass panels that allow a consumer to view the food products stored inside the case.

Refrigerated merchandisers may be susceptible to condensation forming on the glass panel of the door, which obstructs viewing of the food product positioned inside the case. Condensation typically forms on the outer surface of the glass panel due to a cool outer surface being in communication with the ambient environment. In addition, fog can form on the inside surface of the panel due to the inner surface generally being in communication with the relatively cold product display area and then being exposed to the relatively humid air of the ambient environment when the door is opened.

Some existing doors use a high-wattage heated coating applied to an inner surface of the glass panel that is in communication with the surrounding environment to inhibit or remove condensation on the outermost surface of the door. Similar high-wattage heated coatings are typically used on the glass panel that is adjacent the product display area (on the surface opposite the surface facing the product display area) to inhibit or remove fog on the innermost surface of the door. These conventional doors are often connected to high voltage AC power (e.g., 110V or greater) and use a relatively high amount of heat energy (e.g., 200 Watts, 300 Watts, etc.) to remove condensation and fog on the innermost and outermost surfaces of the door. The high amounts of heat energy used with these doors are generally needed to overcome heat losses associated with heating portions of the door in addition to heating the glass panel.

SUMMARY

The present invention provides, in one aspect, a case frame and mullion assembly that includes a case frame including a frame member that defines a mullion pocket, a first electrical connector that is coupled to the frame member within the mullion pocket, a mullion that is defined by an elongated body, a second electrical connector that is coupled to the frame member within the mullion pocket, and an attachment mechanism that is coupled to one or both of the case frame and the mullion. The attachment mechanism positioned between the frame member and the mullion to attach the mullion to the frame member. The attachment mechanism aligns and couples the first electrical connector relative to the second electrical connector upon attachment of the mullion to the frame member.

The present invention provides, in another aspect, a mullion assembly for a merchandiser that includes an elongated mullion body including a first end and a second end. The mullion body defines an elongated channel extending from the first end toward the second end along a longitudinal axis oriented along a length of the mullion body. The channel defines a support surface, opposite sidewalls, and opposite hooks coupled to the sidewalls and extending in a direction across the longitudinal axis. A light assembly is coupled to the mullion body within the elongated channel, the light assembly being captured by the hooks to retain the light assembly in the channel.

The present invention provides, in another aspect, a refrigerated merchandiser that includes a case defining a product display area and includes a case frame having frame members and a mullion. A door is coupled to the case frame and encloses at least a portion of the product display area, the door including a door frame and a glass panel coupled to the door frame>A first gasket is coupled to the mullion and includes a first gasket element defining a first cavity, the first gasket further including a first magnet disposed in the first cavity>A second gasket is coupled to the door frame and includes a second gasket element defining a second cavity and having a seal portion, the second gasket further including a second magnet disposed in the second cavity of the second gasket element. The door is movable relative to the mullion between a closed position and an open position, and, in the closed position, the first and second magnets are spaced apart from each other by an air gap and the seal portion is engaged with the mullion to limit infiltration of ambient air into the product display area.

The present invention provides, in another aspect, a refrigerated merchandiser that includes a case defining a product display area and includes a case frame having frame members. A door is pivotably coupled to the case frame via a hinge assembly and encloses at least a portion of the product display area, the door including a door frame and a glass panel coupled to the door frame. A door close mechanism is positioned between the case frame and the door to permit movement of the door between a closed position and an open position. The door close mechanism includes a base plate attached to the case frame and a spiral spring supported by the base plate, the spiral spring responds to a closing force of the door to maintain a substantially constant door close rate.

The present invention provides, in another aspect, a refrigerated merchandiser that includes a case defining a product display area and includes a case frame having frame members. A door is pivotably coupled to the case frame via a hinge assembly and encloses at least a portion of the product display area. The door includes a door frame and a glass panel coupled to the door frame, and a door hold-open mechanism positioned between the case frame and the door. The door hold-open mechanism includes a housing movable with the door as the door pivots between a closed position and an open position, and a cam apparatus including a lever engageable with the housing, and a cam coupled to the lever to apply a force to the lever such that the lever is engageable with the housing to hold the door in an open position. The cam is adjustable to increase or decrease the force applied to the lever.

The present invention provides, in another aspect, a refrigerated merchandiser that includes a case defining a product display area and includes a case frame having elongated upper and lower frame members, and a door including a door frame and a glass panel coupled to the door frame. The door includes a first door pivot disposed on a first end of the door frame, and a second door pivot disposed on a second end of the door frame that is axially aligned with the first door pivot. A first frame pivot is attached to the upper frame member and pivotably coupled to the first door pivot, the first frame pivot further electrically coupled to the first door pivot. A second frame pivot is attached to the lower frame member and pivotably coupled to the second door pivot, the second frame pivot further electrically coupled to the second door pivot. The first frame pivot has a positive or negative electrical polarity and the first door pivot is non-polar to define a first electrical connection between the case frame and the door, and the second frame pivot has the other of the positive or negative electrical polarity and the second door pivot is nonpolar to define a second electrical connection between the case frame and the door.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

For ease of discussion and understanding, the following detailed description illustrates a case and door frame assembly in association with a refrigerated merchandiser 10. It should be appreciated that the refrigerated merchandiser 10 is provided for purposes of illustration of one or more embodiments of the case and door frame assembly. The case and door frame assembly can be used in association with any structure that includes a frame and a door. Examples of such a structure include, but are not limited to, a walk-in cooler, a walk-in freezer, a low temperature merchandiser (e.g., operating at a temperature below 32° Fahrenheit), a medium temperature merchandiser (e.g., operating at a temperature range of 34° to 41° Fahrenheit), or any other similar structure. Accordingly, the term "refrigerated merchandiser 10" includes the listed examples, in addition to any structure that includes a frame and a door.

Figure 1:
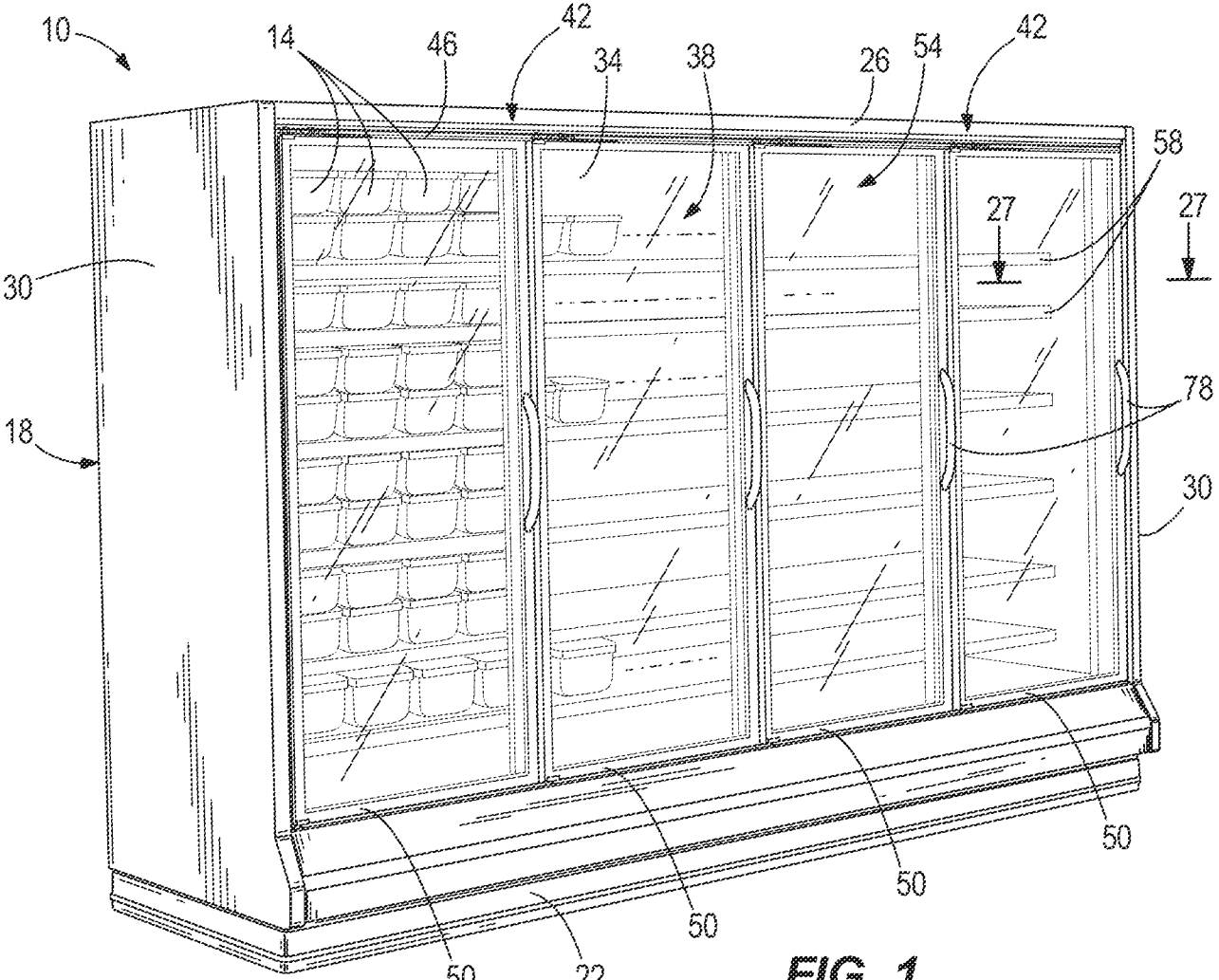
FIG. 1 is a perspective view of an exemplary refrigerated merchandiser including a case and door frame assembly embodying the invention, with the doors positioned in a first configuration illustrated as left-hand open configuration.

FIG. 1 illustrates the refrigerated merchandiser 10 that may be located in a supermarket, a convenience store, or other suitable retail location (not shown) for presenting fresh food, frozen food, beverages, or other product 14 to consumers. The merchandiser 10 includes a case 18 that is defined by a base 22, a canopy 26, opposite side walls 30, and a rear wall 34. The case 18 also includes an access opening 38 positioned opposite the rear wall 34. The access opening 38 is defined by a case frame assembly 42 that includes a case frame 46. A plurality of doors 50 are coupled to the case frame 46 to provide access to the product 14 through the access opening 38. The area partially enclosed by the base 22, the canopy 26, and the rear wall 34 defines a product support area 54 (e.g., a product display area or volume 54) for supporting the product 14 in the case 18. For example, the food product can be displayed on racks or shelves 58 extending from the rear wall 34 toward the case frame 46, and is accessible by consumers through the doors 50 adjacent a front of the case 18. As shown in FIG. 1, the product 14 and the shelves 58 are visible behind the substantially transparent doors 50. The illustrated merchandiser 10 has one section and one product support area 54 that is defined by the section. As will be appreciated, the merchandiser 10 can include one or more sections, with each section defining a product support area that cooperates to define the overall product support area 54 of the merchandiser 10.

The refrigerated merchandiser 10 also includes a refrigeration system (not shown) that is in communication with the case 18 to provide refrigerated airflow to the product display area 54. The refrigeration system generally includes an evaporator located within an air passageway internal to the case 18. As is known in the art, the evaporator receives a saturated refrigerant that has passed through an expansion valve. The saturated refrigerant is evaporated as it passes through the evaporator as a result of absorbing heat from the airflow passing over the evaporator. The absorption of heat by the refrigerant allows the temperature of the airflow to decrease as it passes over the evaporator. The heated or gaseous refrigerant then exits the evaporator and is pumped back to one or more compressors (not shown) for reprocessing into the refrigeration system. The cooled airflow exiting the evaporator via heat exchange with the liquid refrigerant is directed through the remainder of the air passageway and is introduced into the product display area 54 where the airflow will remove heat from and maintain the product 14 at desired conditions.

Figure 2:
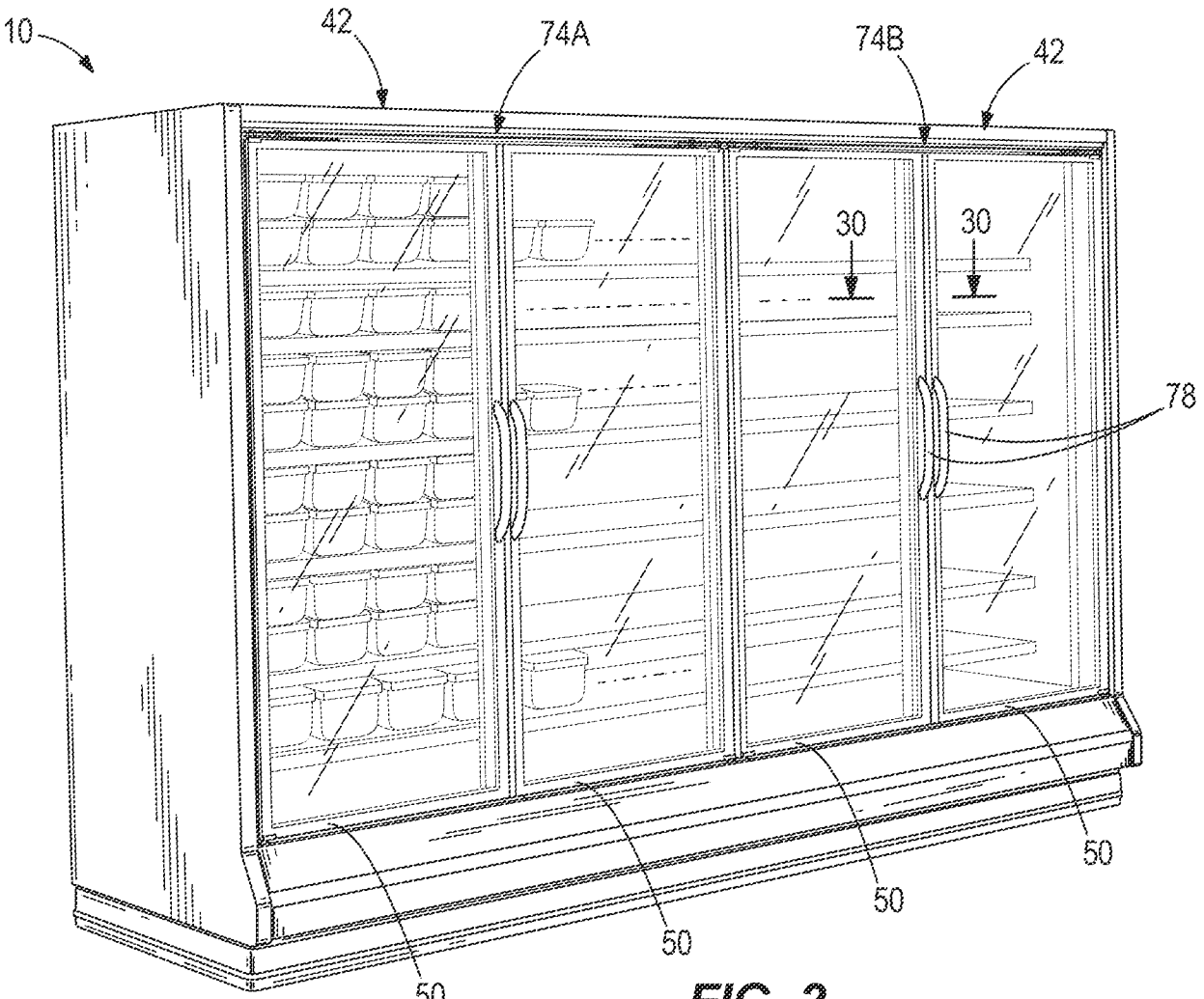
FIG. 2 is a perspective view of another embodiment of the refrigerated merchandiser of FIG. 1, with the doors attached to the case frame assembly being positioned in a second configuration illustrated as a double door (wishbone) configuration.

Referring to FIGS. 1-2, the illustrated case frame 46 has two frame sections 42, with two doors 50 attached to each frame section 42. As shown in FIG. 1, each door 50 is attached to the case frame 46 in a first configuration, which is a left-hand open configuration (i.e. each door opens along a hinge (defining a pivot axis 62, shown in FIG. 3) along a left end or a left side of the door 50, as viewed when facing the door 50). The doors 50 are configured to be oriented (or reoriented) in either a left-hand open configuration or a right-hand open configuration, and the doors 50 do not need to have the same configuration (e.g., the merchandiser 10 can include a combination of left-hand and right-hand open configuration). For example, with the door 50 oriented such that the hinge 62 is on the left side, the illustrated door 50 can be removed or disengaged from the case frame 46, rotated clockwise or counter-clockwise one hundred-eighty degrees (180°) (e.g., rotated about a horizontal axis 66 (shown in FIG. 3) in a plane defined by the door 50 (e.g., a plane that is defined by the door 50, or a plane that is defined by at least one glass panel 70 positioned in the door 50) so that the hinge 62 is then oriented on the right side of the door 50 when viewed from the front, and installed or re-engaged in the case frame 46 in the right-hand open configuration. It will be appreciated that the doors 50 can be switched between left-hand and right-hand configurations. In some embodiments of the refrigerated merchandiser 10, the doors 50 can be oriented as a combination of right-hand opening and left-hand opening doors 50. For example, FIG. 2 illustrates another embodiment of the refrigerated merchandiser 10 showing the doors 50 in a second configuration. In the second configuration the doors 50 are separated into two sets of double doors 74*a*, 74*b*, with a set of double doors 74*a*, 74*b* positioned in each frame section 42. Each set of double doors 74*a*, 74*b* includes a left-hand opening door 50 and a right-hand opening door 50 (see FIG. 4). A handle 78 (shown in FIGS. 1-2) can be installed on each door 50 via handle mounting points 82 (shown in FIGS. 3-4) by a suitable fastener (e.g., a screw, a bolt, etc.).

Figure 6:
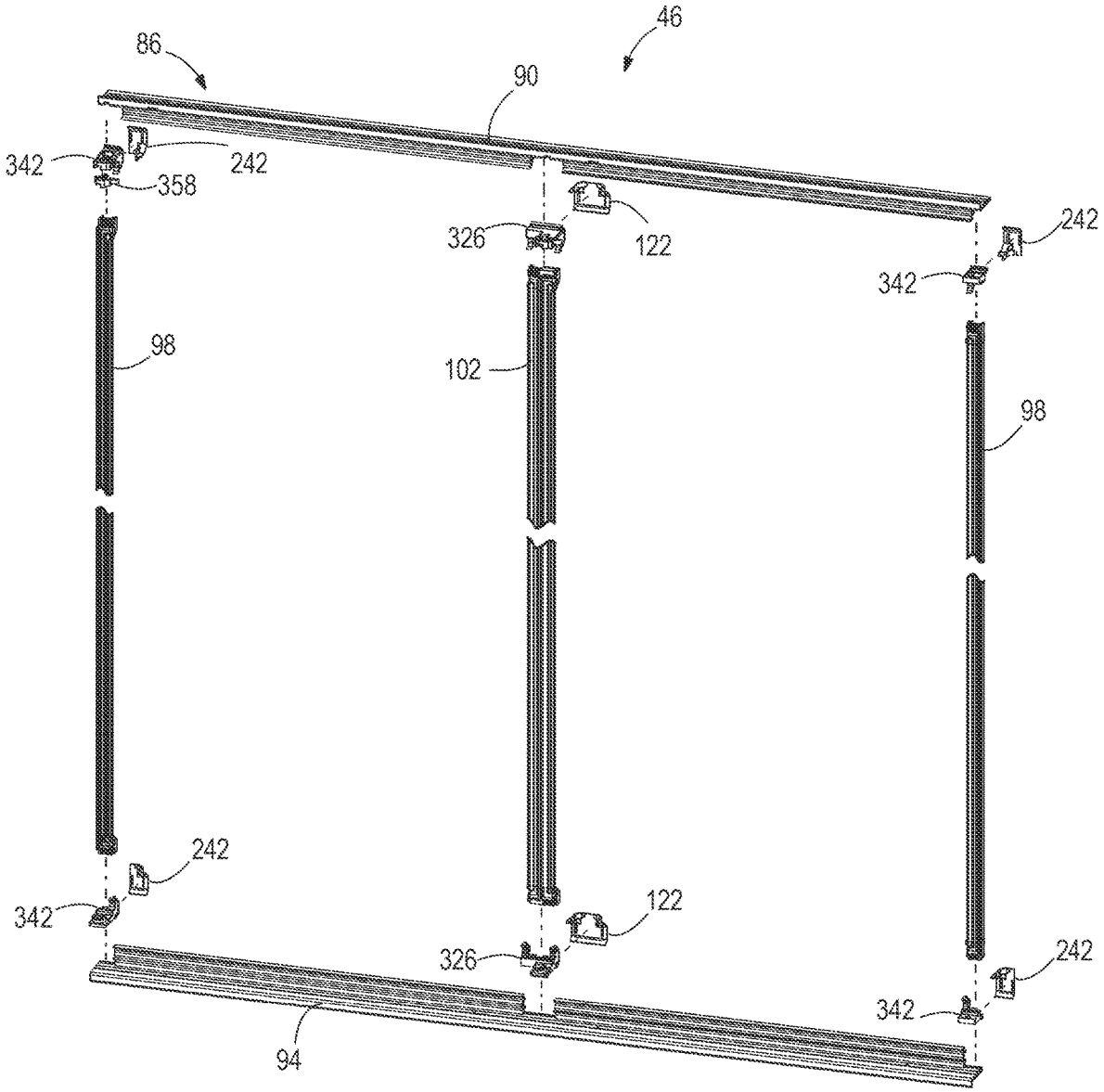
FIG. 6 is a partially exploded view of the portion of the case frame assembly of FIG. 5 illustrating a removable center mullion and removable end mullions.

FIGS. 3-7 further illustrate different embodiments of the case frame 46. The case frame 46 is a modular frame that is formed of a plurality of interconnected frame members 86. More specifically, the modular case frame 46 includes a top frame member or top frame portion 90 and a bottom frame member or bottom frame portion 94 that is opposite the top frame portion 90. Mullions or vertical supports 98, 102 separately connect to both the top frame member 90 and the bottom frame member 94. The mullions can include a center mullion 102 (or also referred to as a second mullion or a center mullion assembly) that is positioned between adjacent or consecutive doors 50. The mullions also include end mullions 98 (also referred to as a first mullion, a side mullion, or an end mullion assembly 98). As shown in FIG. 6, two end mullions 98 are positioned at opposite ends of the section of the case frame 46. While FIGS. 3-7 illustrate a case frame 46 with one center mullion 102, the case frame 46 can include a plurality of center mullions 102 (e.g., when the case frame 46 includes more than two doors 50) or no center mullions 102 (e.g., when the case frame 46 includes a single door 50). For purposes of the description, the end mullion 98 and the center mullion 102 will be referred to as a "mullion." It should also be appreciated that each end mullion 98 is generally one-half of a symmetrical center of the center mullion 102 (e.g., a left side end mullion 98 and a right side end mullion 98 being approximately the same as the respective left side or right side of the center mullion 102—compare FIG. 12 with FIG. 19).

Figure 7:
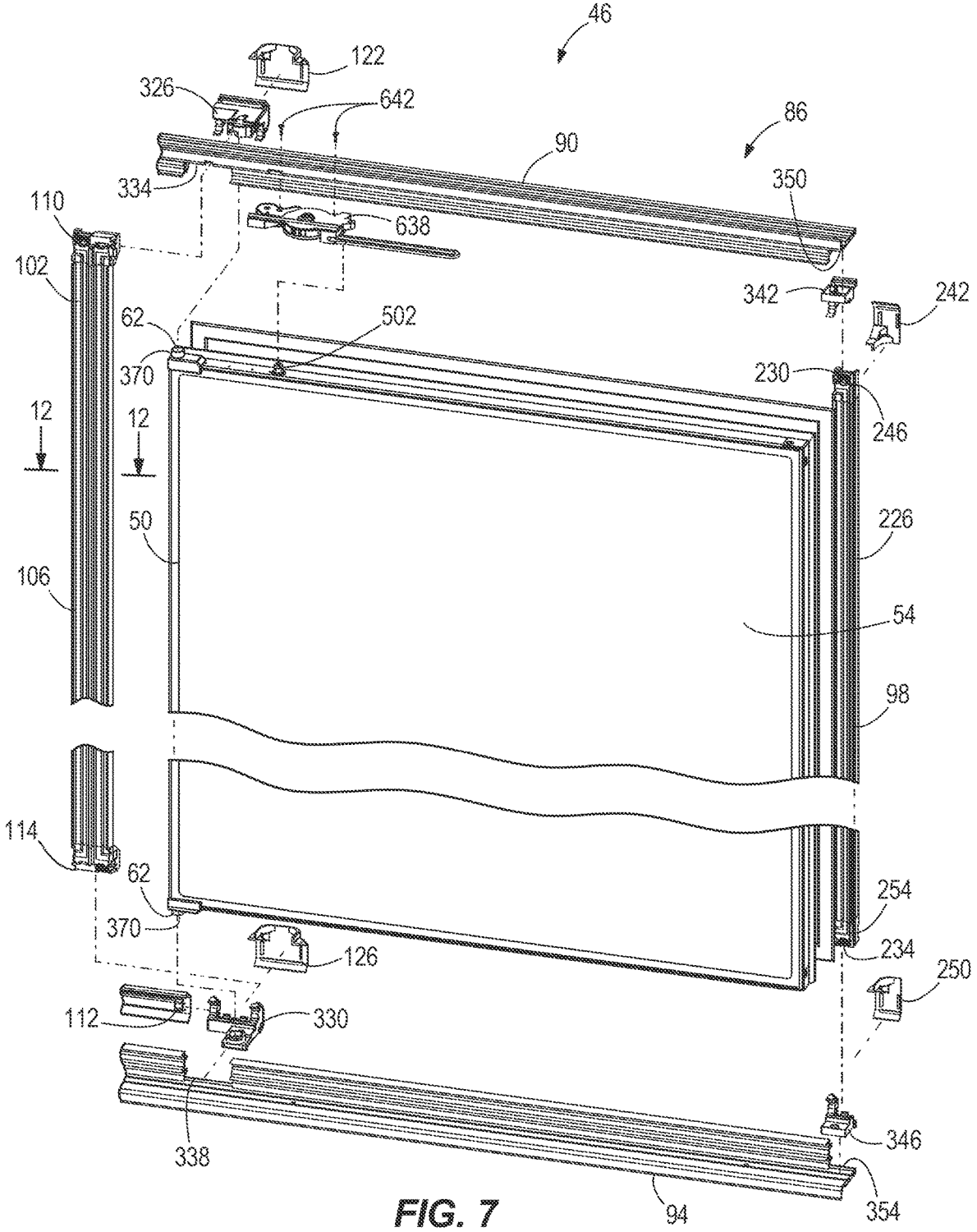
FIG. 7 is a partially exploded view of a portion of the case frame assembly of FIG. 3, illustrating the right side of the case frame assembly and the associated door (as viewed in FIG. 3).
Figure 14:
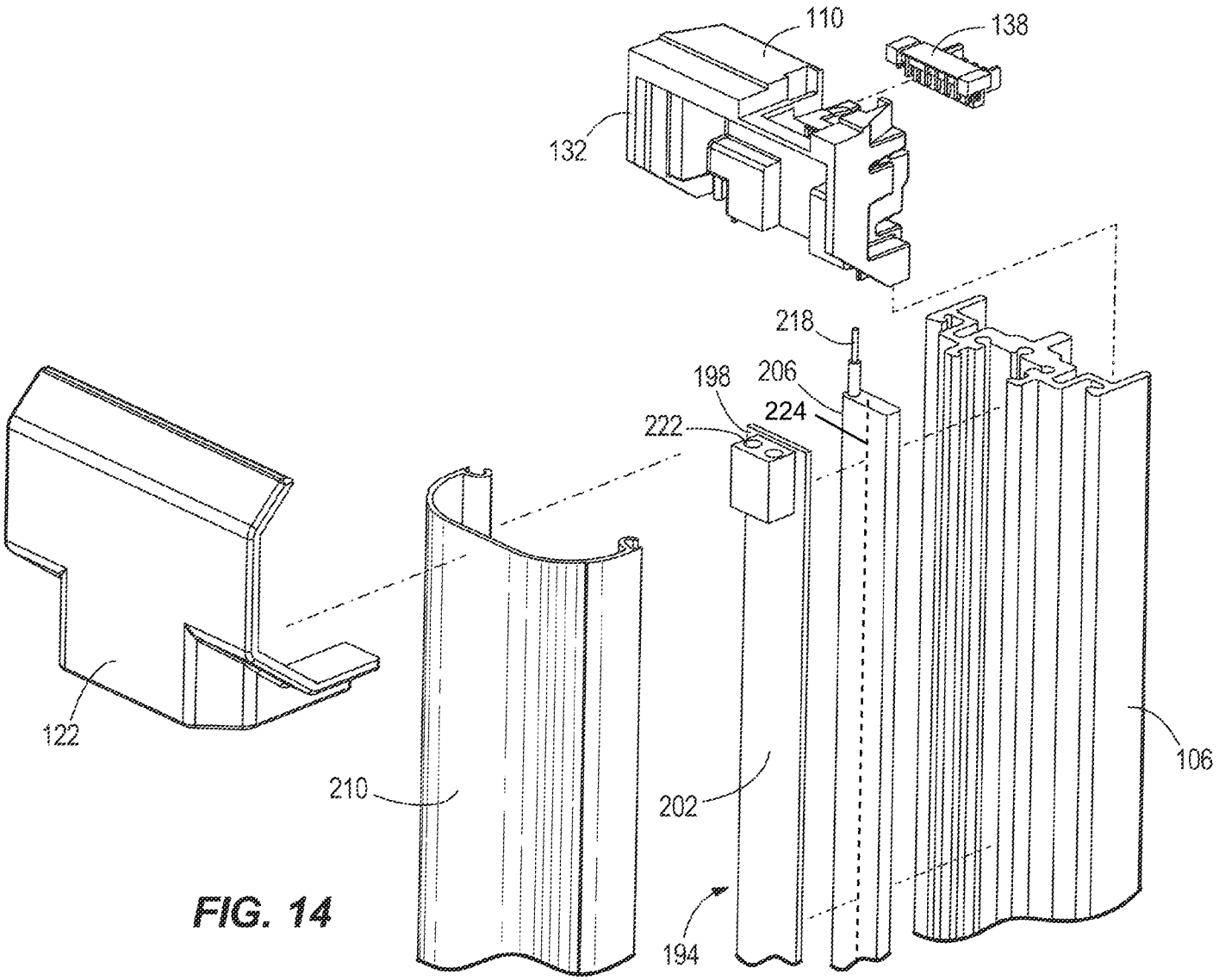
FIG. 14 is an exploded perspective view of the top end of the center mullion shown in FIG. 7.

Referring to FIG. 7, the center mullion 102 includes a mullion body 106 that has a first or top end 110 and a second or bottom end 114 opposite the top end 110. The mullion body 106 also has a longitudinal axis 118 (shown in FIGS. 8 and 10) that extends along a length of the body 106. As shown in FIGS. 6, 7, and 14, a first mullion end cover 122 is positioned in engagement with the mullion body 106 at the top end 110, while a second mullion end cover 126 is positioned into engagement with the mullion body 106 at the bottom end 114.

Figure 8:
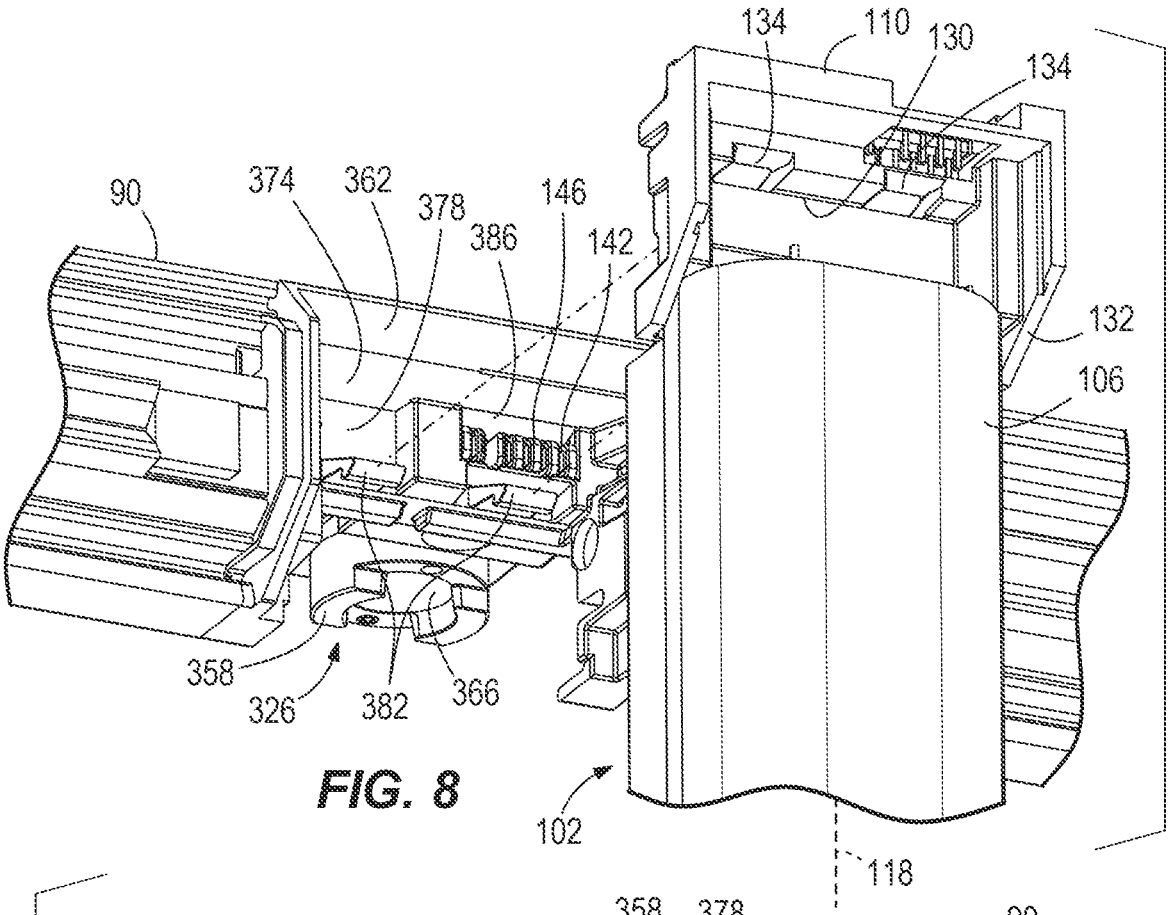
FIG. 8 is a perspective view of a top end of the center mullion of FIG. 7, viewed from a first side and detached from a top frame member of the case frame assembly of FIG. 3.
Figure 9:
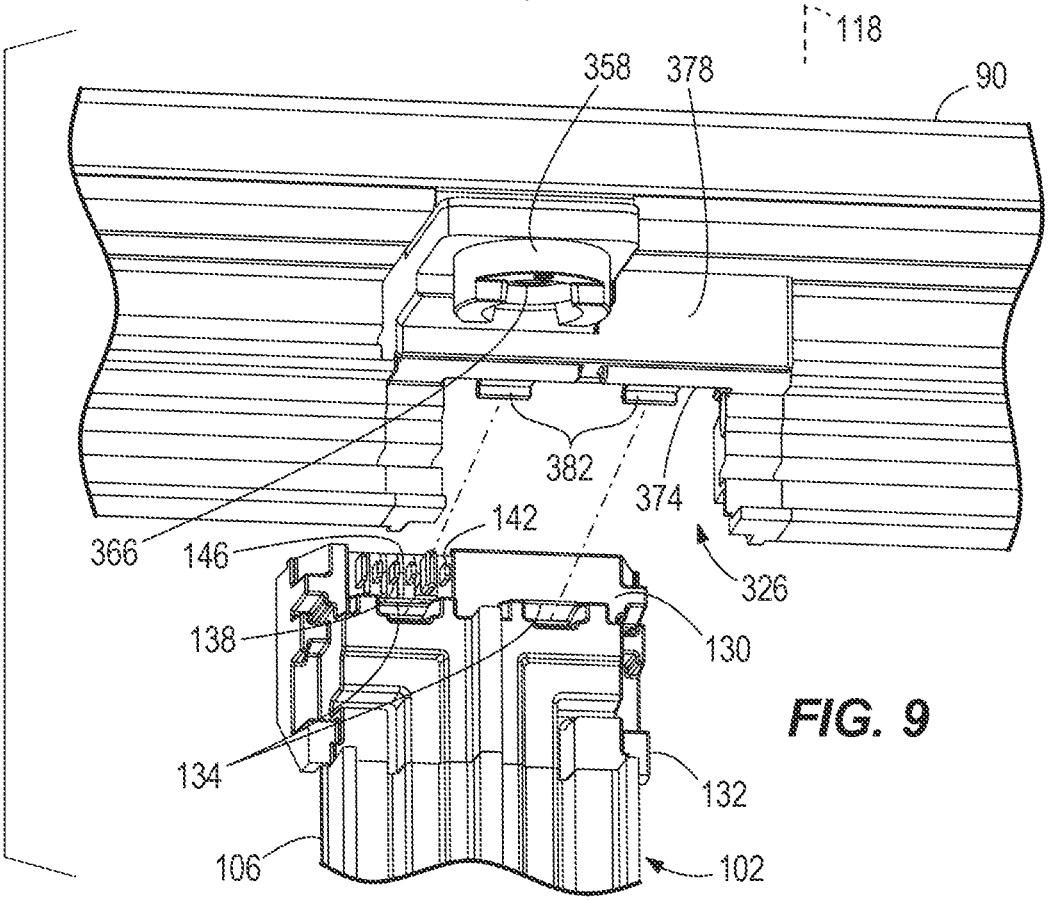
FIG. 9 is a perspective view of the top end of the center mullion of FIG. 7, viewed from a second side opposite the first side and detached from the top frame member of the case frame assembly of FIG. 3.

With reference to FIGS. 8-9, the top end 110 of the center mullion 102 includes a first mullion pocket 130. The first mullion pocket 130 is defined by the mullion body 106, and more specifically a first end housing 132. The first mullion pocket 130 includes a plurality of openings 134 (or attachment points 134) positioned on the end housing 132. A first electrical connector 138 (shown in FIG. 9) is coupled to (or received by) the end housing 132 within the mullion pocket 130. The first electrical connector 138 is positioned adjacent the openings 134 and includes a plurality of tabs 142 and a plurality of sockets 146 (shown in FIG. 9). In other embodiments, the first electrical connector 138 can include one or more tabs 142, one or more sockets 146, or a combination of thereof.

Figure 10:
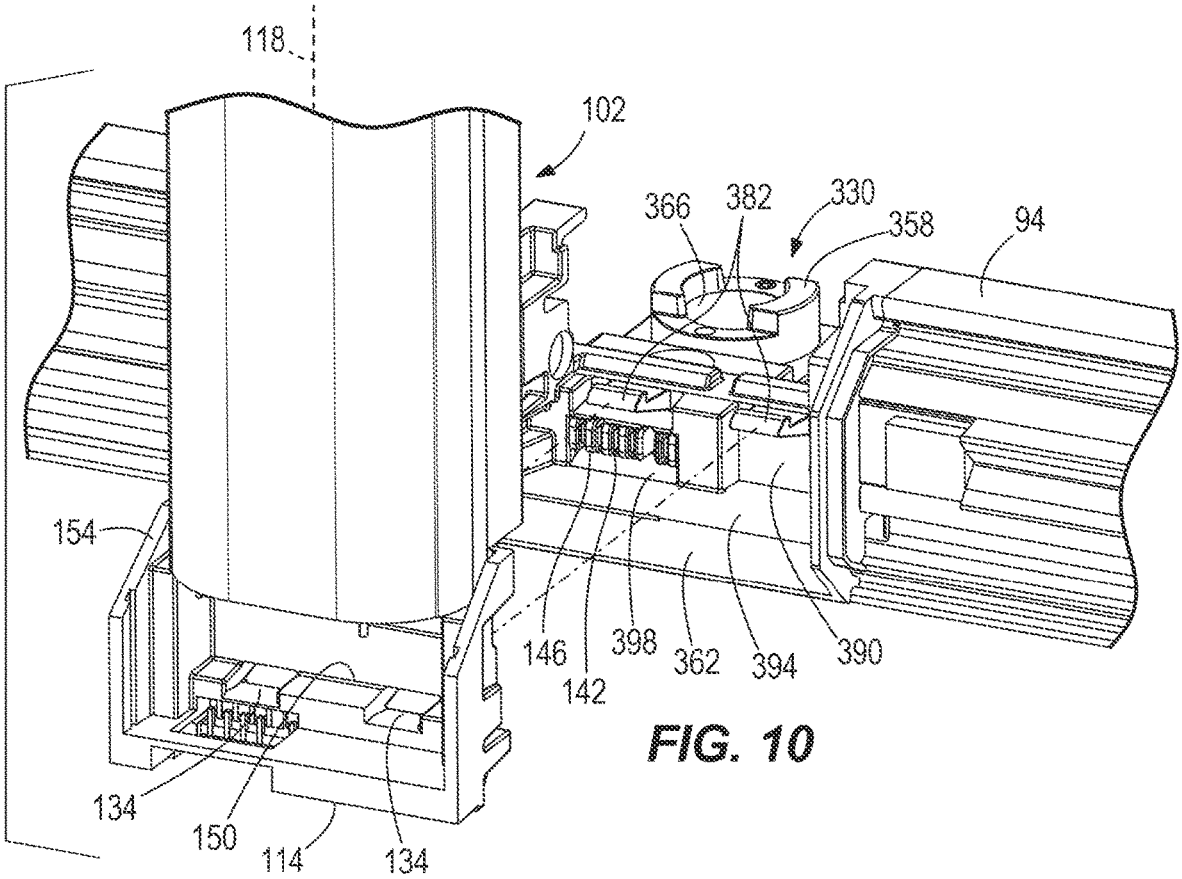
FIG. 10 is a perspective view of a bottom end of the center mullion of FIG. 7, viewed from the first side and detached from a bottom frame member of the case frame assembly of FIG. 3.
Figure 11:
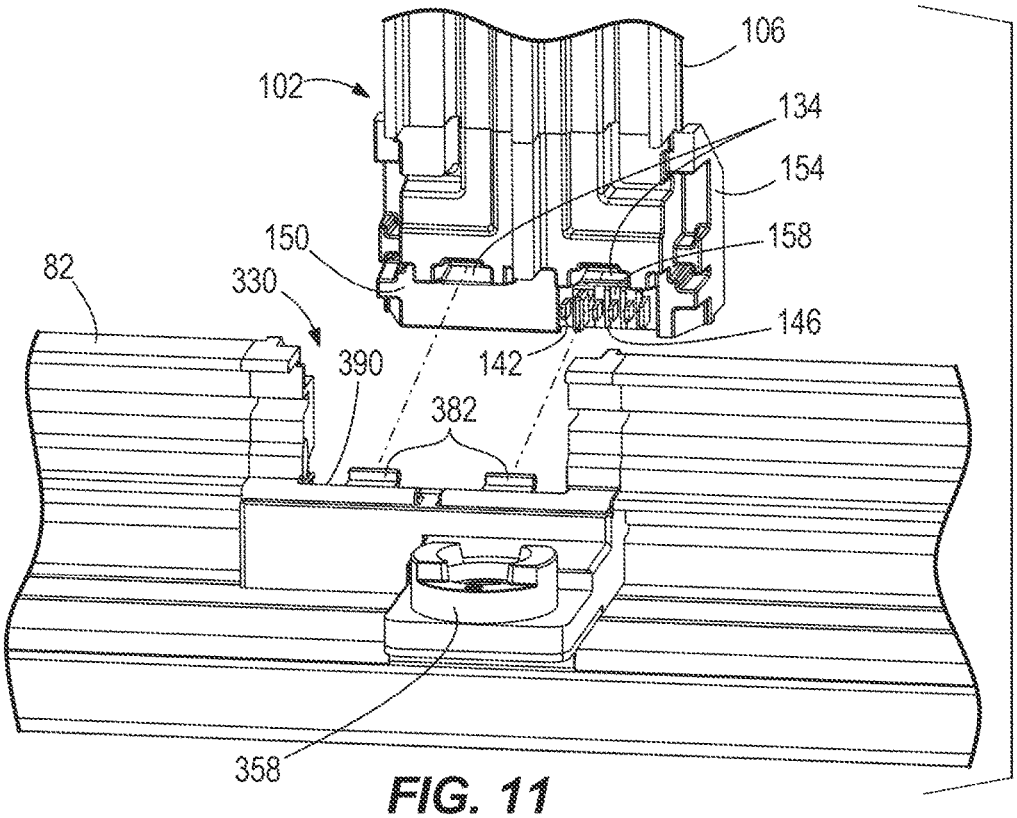
FIG. 11 is a perspective view of the bottom end of the center mullion of FIG. 7, viewed from the second side and detached from the bottom frame member of the case frame assembly of FIG. 3.

FIGS. 10-11 illustrate the bottom end 114 of the center mullion 102. The bottom end 114 includes a second mullion pocket 150 that is defined by the mullion body 106, and more specifically a second end housing 154. The second mullion pocket 150 is substantially the same as the first mullion pocket 130, with like numbers defining like components. The second mullion pocket 150 includes a plurality of openings 134 (or attachment points 134) positioned on the end housing 154. A second electrical connector 158 (shown in FIG. 11) is coupled to (or received by) the end housing 154 within the mullion pocket 150. A second electrical connector 158 is positioned adjacent the openings 134 and includes a plurality of tabs 142 and a plurality of sockets 146 (shown in FIG. 11). The second electrical connector 158 is the same or substantially the same as the first electrical connector 138 (shown in FIG. 9).

Figure 12:
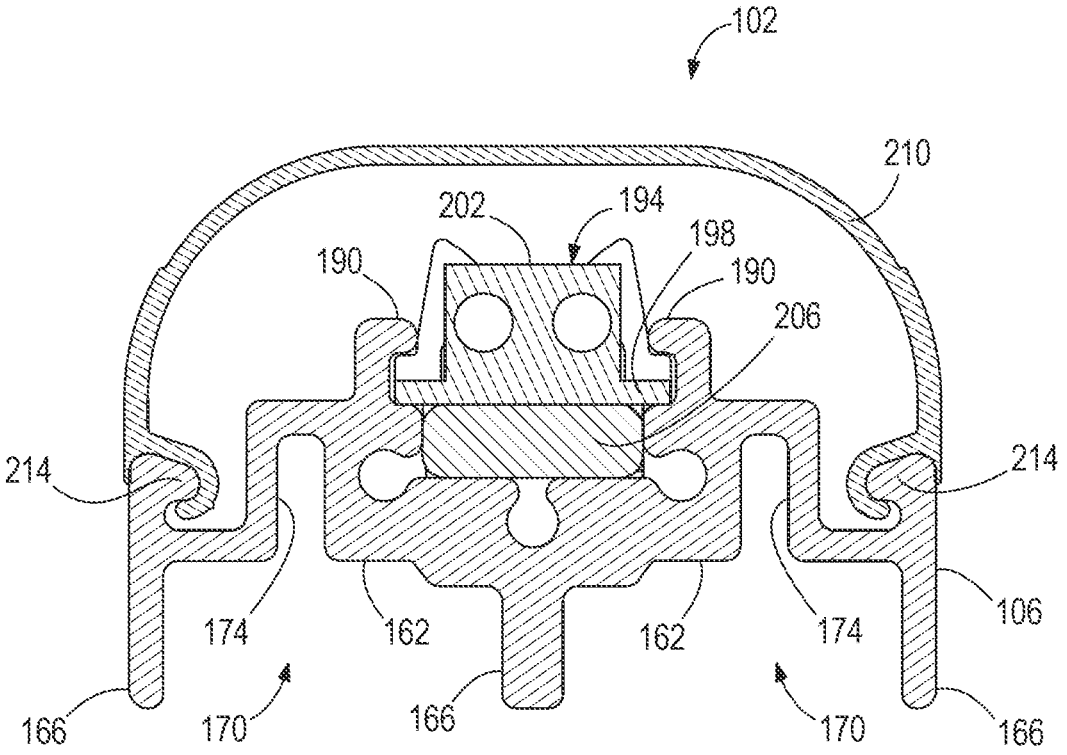
FIG. 12 is a cross-sectional view of the center mullion of FIG. 7, taken along line 12-12 and illustrating a lens, a light assembly, and a heater.
Figure 13:
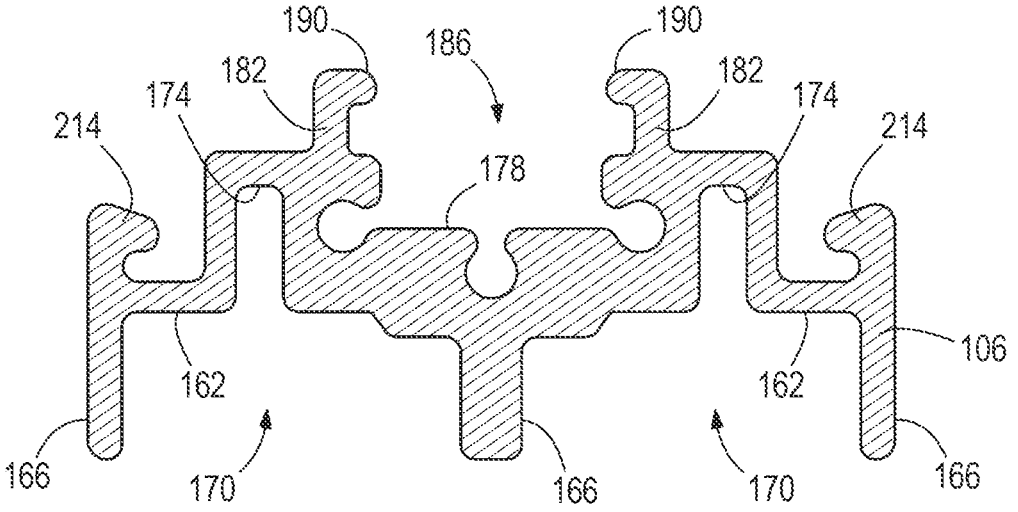
FIG. 13 is a cross-sectional view of the mullion body of the center mullion shown in FIG. 12, with the lens, light assembly, and heater removed.

Referring to FIGS. 12-13, the mullion body 106 includes a support surface 162 and a plurality of sidewalls or outer walls 166 disposed on the support surface 162. The support surface 162 and at least two sidewalls 166 define a pair of channels 170. Each channel 170 is elongated and extends longitudinally along the center mullion 102. The mullion body 106 also defines a cavity 174 (e.g., a gasket securement cavity) that is positioned in each channel 170. As shown in FIG. 13, the mullion body 106 also includes a support surface 178 and opposite sidewalls 182 that define a channel 186. The channel 186 is disposed or oriented substantially parallel to each channel 170. A pair of hooks 190 (e.g., first hooks 190) extend inward (toward the center of the mullion body 106 across the longitudinal axis 118 (shown in FIGS. 8 and 10)) from the sidewalls 182 and are positioned on opposite sides of the channel 186. The hooks 190 are configured to engage a portion of a light assembly 194 (shown in FIG. 12) to capture and retain the light assembly 194 within the channel 186. The light assembly 194 includes a circuit board 198 that carries a light source 202 (shown in FIG. 12), illustrated as a plurality of light emitting diodes (or LED's) 202. The light emitting diodes 202 are coupled to the circuit board 198, for example in a strip of LED's 202, to illuminate the product display area 54 (shown in FIG. 1).

As illustrated in FIG. 12, a heater 206 is disposed within the channel 186 between the mullion body 106 and the light assembly 194. The heater 206 is positioned in contact with the light assembly 194 to cooperatively heat the mullion body 106, and an air space around the center mullion 102. Generally, heat generated by the light assembly 194 is used to heat the mullion body 106, and the air space around the center mullion 102, to minimize or limit condensation. The heater 206 can provide heat (or additional heat) to supplement the heat generated by the light assembly 194.

A lens 210 encloses the light assembly 194. The lens 210 engages a pair of hooks 214 (or second hooks 214) formed by the mullion body 106. The hooks 214 are coupled to the sidewalls 166 and extend in a direction across the longitudinal axis 118 (shown in FIGS. 8 and 10). The lens 210 is captured by the hooks 214 to couple the lens 210 to the mullion body 106 and enclose the light assembly 194. In other embodiments, a heat sink can be disposed in the channel 186.

Referring to FIG. 14, the first end housing 132 receives an end of the mullion body 106. The heater 206 includes an electrical connection 218, and the circuit board 198 includes another electrical connection 222. The electrical connections 218, 222 are in communication with the first electrical connector 138 such that electricity (or power) can be distributed from the electrical connector 138 to power the heater 206 and the light source 202 (carried by the circuit board 198). Accordingly, the electrical connector 138 is electrically coupled to the light assembly 194 to provide power (or electricity) to the light assembly 194, and to the heater 206 to provide power (or electricity) to the heater 206. The cover 122 can engage both a portion of the mullion lens 210 and the first housing 138 to cover the first mullion pocket 130 (shown in FIG. 9). While FIG. 14 illustrates the first housing 132 engaging the mullion body 106 at the first end 110, the second housing 154 engages the mullion body 106 at the second end 114 (shown in FIGS. 10-11) in substantially the same way.

In one embodiment, the light assembly 194 is integrated into, or formed as part of, the center mullion 102. Accordingly the center mullion 102 acts as a luminaire. To change the light emitting diodes 202, the center mullion 102 is removed from the frame members 90, 94 and replaced with another mullion (not shown) having its own light source. In other embodiments, the light assembly 194 can be insertable within (or removable from) the channel 186. Generally, the light assembly 194 can be insertable (or removable) relative to one of the longitudinal ends of the center mullion 102 (e.g., from the first end 110 or the second end 114), and along the longitudinal axis 118 defined by the center mullion 102. In other embodiments, the center mullion 102 can be removed from the frame members 90, 94 to change one or more of the light emitting diodes 202 (without changing the entire light assembly 194).

In still other embodiments, a resistance wire 224 (e.g., PTC chips, etc.) can be used as the heater 206 to provide continuous or periodic heat to the mullion body 106 when the light assembly 194 is off (i.e. not emitting light) or not present. In embodiments with both the resistance wire 224 and the light assembly 194, the resistance wire 224 can be configured to supply power to the light emitting diodes 202 when the light emitting diodes 202 are powered on, and to heat the mullion body 106 when the light emitting diodes 202 are powered off (e.g., to minimize or remove condensation that may form on the mullion). In other words, the resistance wire 224 can power the heater 206 and the light assembly 194.

Referring back to FIG. 7, the end mullion 98 includes a mullion body 226 that has a first or top end 230 and a second or bottom end 234 opposite the top end 230. The mullion body 226 also has a longitudinal axis 238 that extends along a length of the body 226. A third mullion end cover 242 is positioned into engagement with the mullion body 226 at the top end 230, and is configured to cover a third end housing 246. Similarly, a fourth mullion end cover 250 is positioned into engagement with the mullion body 226 at the bottom end 234, and is configured to cover a fourth end housing 254. Since the end mullion 98 is generally one-half of a symmetrical center of the center mullion 102, the third and fourth end housings 246, 254 are generally one-half of a symmetrical center of the first and second end housings 132, 154. For ease of understanding, like components will be identified with like numbers and the housings of the end mullion will not be described separately in detail.

Figure 15:
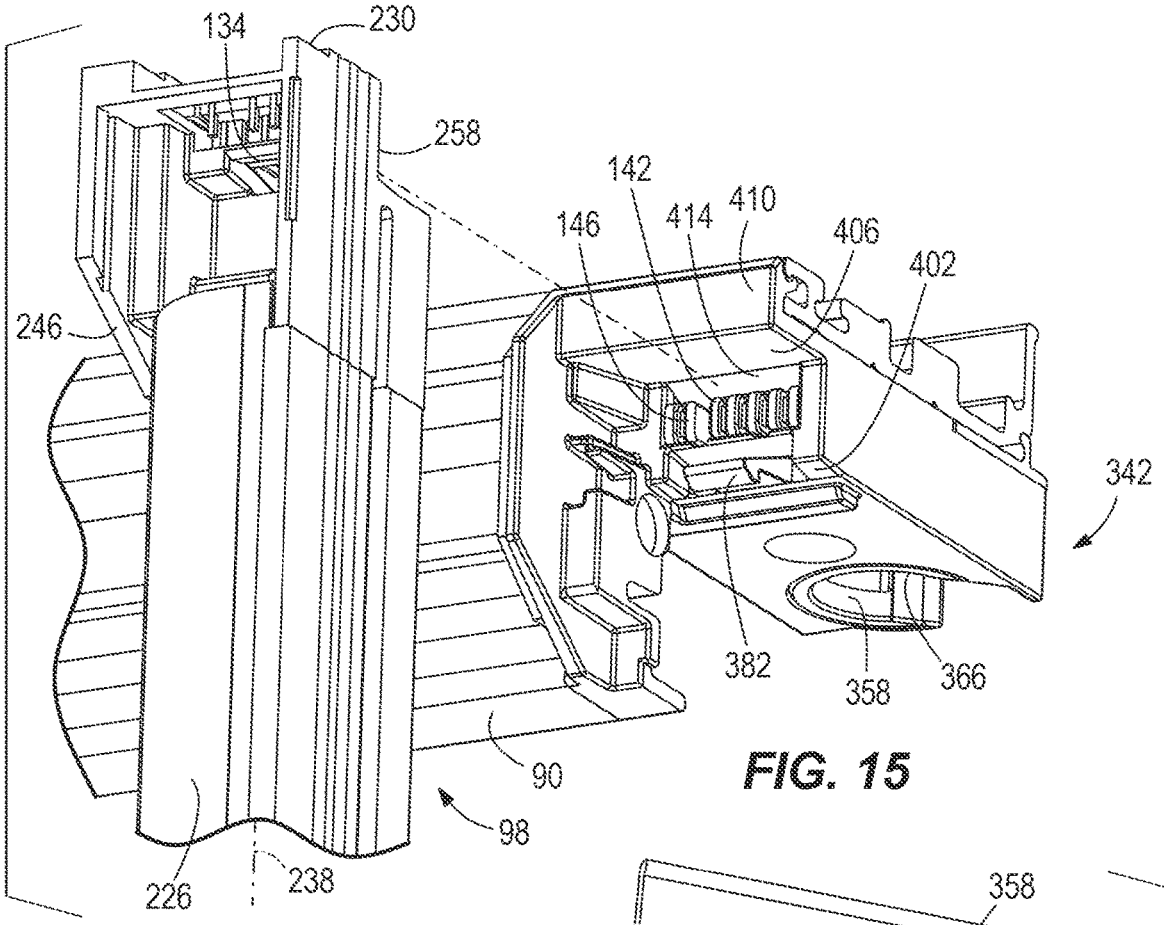
FIG. 15 is a is a perspective view of a top end of one end mullion viewed from a first side and detached from the top frame member of the case frame assembly of FIG. 6.
Figure 16:
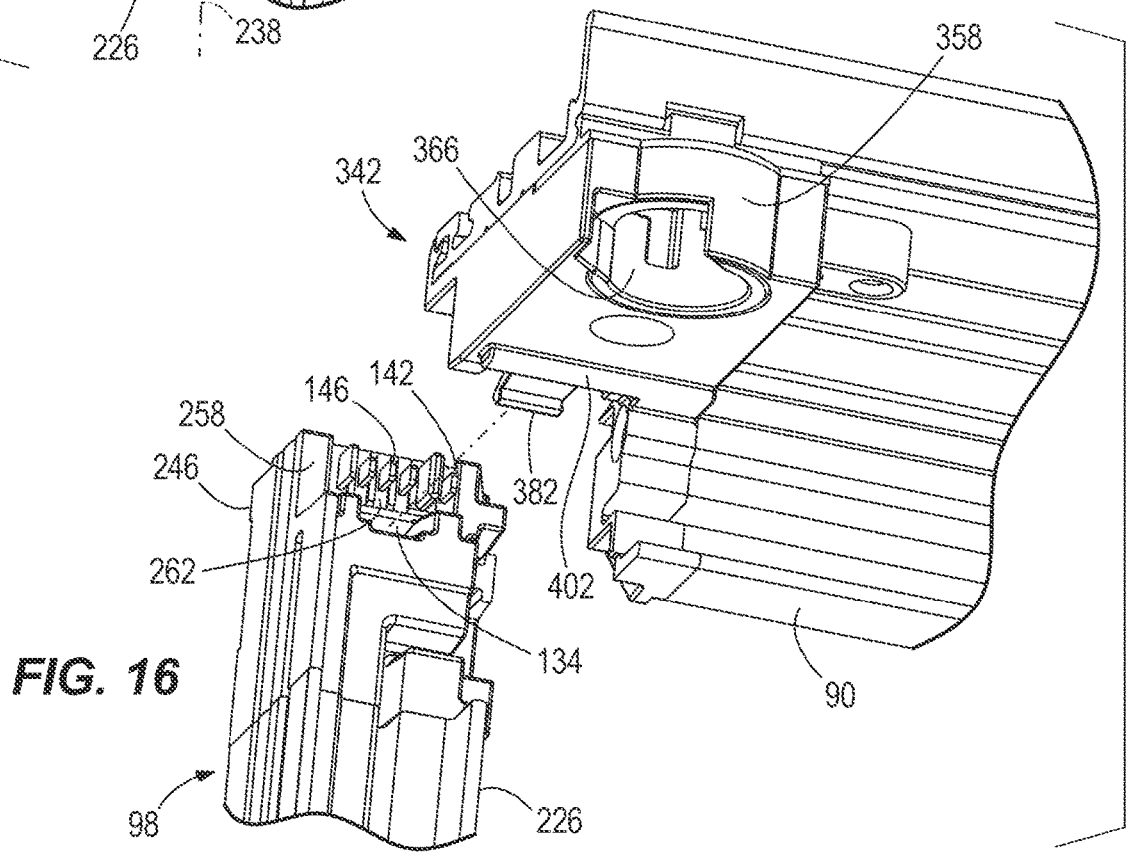
FIG. 16 is a perspective view of the top end of the end mullion of FIG. 7, viewed from a second side and detached from the top frame member of the case frame assembly of FIG. 6.

Referring now to FIGS. 15-16, the top end 230 of the end mullion 98 includes a third mullion pocket 258. The third mullion pocket 258 is defined by the mullion body 226, and more specifically the third end housing 246. The third mullion pocket 258 includes at least one opening 134 (or attachment point 134) positioned on the end housing 246. A third electrical connector 262 (shown in FIG. 16) is coupled to (or received by) the end housing 246 within the mullion pocket 258. The third electrical connector 262 is positioned on the end housing 246, and is adjacent the opening 134 and includes a plurality of tabs 142 and a plurality of sockets 146 (shown in FIG. 16). The third electrical connector 262 is substantially the same as the first and second electrical connectors 138, 158 (shown in FIGS. 9 and 11, respectively). In other embodiments, the third electrical connector 262 can include one or more tabs 142, one or more sockets 146, or a combination of thereof.

Figure 17:
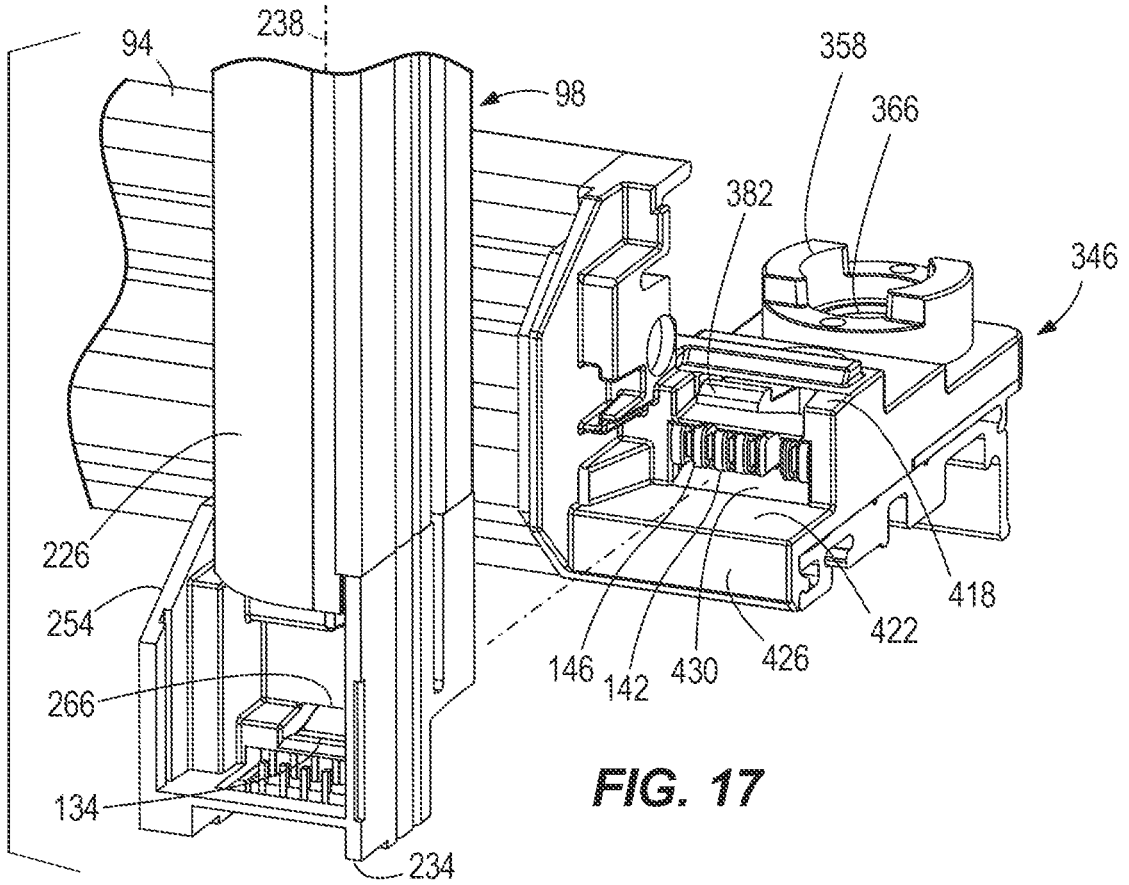
FIG. 17 is a perspective view of a bottom end of the end mullion of FIG. 7, viewed from the first side and detached from a bottom frame member of the case frame assembly of FIG. 6.
Figure 18:
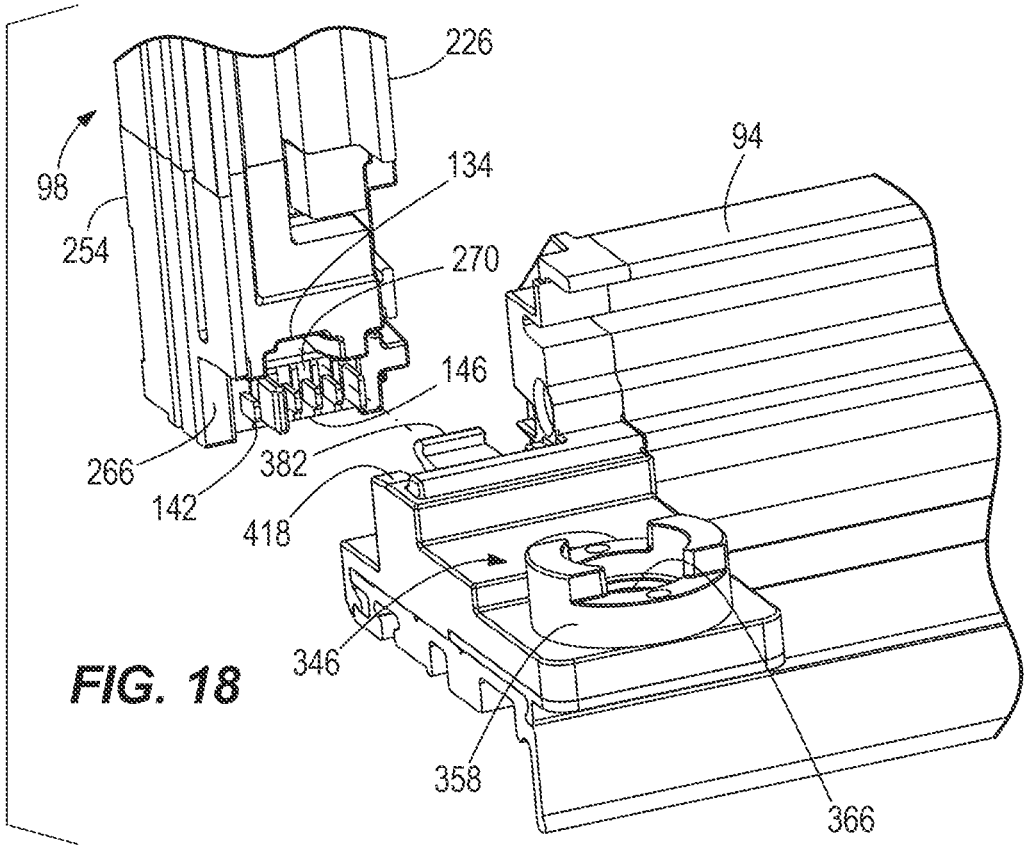
FIG. 18 is a perspective view of the bottom end of the center mullion of FIG. 7, viewed from the second side and detached from the bottom frame member of the case frame assembly of FIG. 3.

FIGS. 17 and 18 illustrate the bottom end 234 of the end mullion 98. The bottom end 234 includes a fourth mullion pocket 266 that is defined by the mullion body 226, and more specifically the fourth end housing 254. The fourth mullion pocket 266 is substantially the same as the third mullion pocket 258, with the same reference numerals defining like components. As illustrated, the fourth mullion pocket 266 includes at least one opening (or attachment point) 134 that is positioned on the end housing 254. With specific reference to FIG. 18, a fourth electrical connector 270 is positioned on the end housing 254 adjacent the opening 134. The fourth electrical connector 270 includes a plurality of tabs 142 and a plurality of sockets 146, and is substantially the same as the third electrical connector 262 (see FIG. 16).

Figure 19:
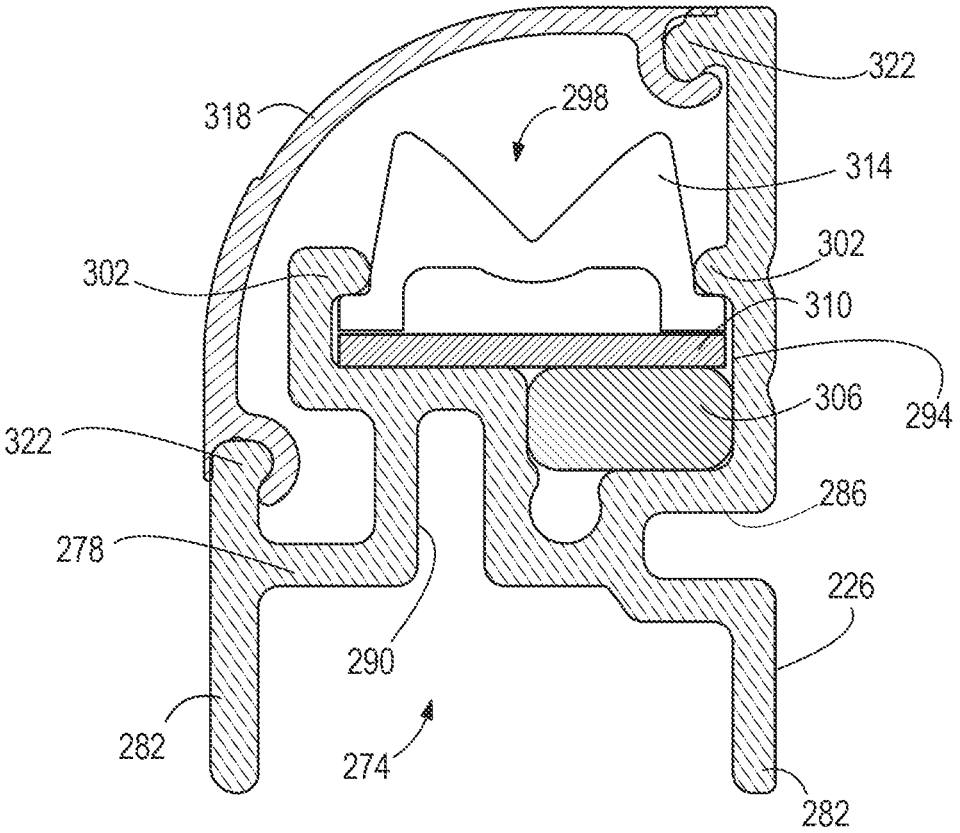
FIG. 19 is a cross-sectional view of the end mullion shown in FIG. 7.

Referring now to FIG. 19, the mullion body 226 defines a channel or a gasket channel 274. The channel 274 is elongated and extends longitudinally along the end mullion 98. The channel 274 is defined by a support surface 278 and a pair of opposite sidewalls 282 provided at opposite ends of the support surface 278. The mullion body 226 also defines a groove 286 that is elongated and extends longitudinally along the mullion body 226. The groove 286 can be positioned substantially parallel to the channel 274, and is provided to facilitate a connection between the end mullion 98 and one of the side walls 30 (shown in FIG. 1), which is discussed in greater detail below. The mullion body 226 also defines a cavity 290 (e.g., a gasket securement cavity) that is positioned in the channel 274. Further, the mullion body 226 defines a cavity 294 (e.g., a light assembly securement cavity) that is positioned on a side of the support surface 278 opposite the gasket securement cavity 290.

The mullion body 226 has a cavity 294 that receives and retains a light assembly 298. The cavity 294 is defined by a portion of the mullion body 226, is elongated, and extends longitudinally along the end mullion 98. A pair of hooks 302 is disposed on opposite sides of the cavity 294. Each hook 302 is configured to engage a portion of the light assembly 298 to capture the light assembly 298 within the cavity 294.

A heater 306, which is similar to or the same as the heater 206, is disposed within the cavity 294 between the mullion body 226 and the light assembly 298. The light assembly 298 includes a circuit board 310 that carries a light source 314, which is illustrated as a plurality of light emitting diodes (or LED's) 314. The light emitting diodes 314 are coupled to the circuit board to illuminate the product display area 54 (see FIG. 1). The heater 306 is positioned in contact with the light assembly 298 to cooperatively heat the mullion body 226, and an air space around the end mullion 98. A lens 318 encloses the light assembly 298. The lens 318 engages a pair of hooks 322 (or second hooks 322) positioned on the mullion body 226. In other embodiments, a heat sink can be disposed in the cavity 294 in place of the light assembly 298. The heater 306 can heat the mullion body 226 to limit condensation. In still other embodiments, a resistance wire (e.g., PTC chips, etc.) can be used to provide a continuous heat to the mullion body 226 when the light assembly 298 is off (i.e., not emitting light) or not present. In embodiments with both resistance wire and the light assembly 298, the resistance wire can be configured to supply power to the light emitting diodes 314 when the light emitting diodes 314 are powered on, and to heat the mullion body 226 when the light emitting diodes 314 are powered off. For example, the resistance wire partially powers the heater 306 and partially powers the light assembly 298. The heater 306 is positioned in contact with the light assembly 298 to cooperatively heat the mullion body 226 and any air space in and/or around the end mullion 98. Generally, heat generated by the light assembly 298 is used to heat the mullion body 226, and the air space around the end mullion 98, to minimize or limit condensation. Like the heater 206 described with regard to FIG. 12, the heater 306 can provide heat to supplement the heat generated by the light assembly 298.

The light assembly 298 can be integrated into or formed as part of the end mullion 98 such that the end mullion 98 acts as a luminaire. That is, to change one or more of the light emitting diodes 314, the mullion 98 is removed from the frame member 90, 94 and replaced with another mullion that may have a light assembly. Alternatively, the light assembly 298 can be insertable into (or removable) from the cavity 294 of the end mullion 98 (e.g., from one of the longitudinal ends of the end mullion 98 along the longitudinal axis 238 (shown in FIGS. 15 and 17) defined by the end mullion 98.

The frame members 90, 94 and/or mullions 98, 102 can be manufactured by pultrusion, or pulled through a die, to facilitate formation of a constant cross-section. In other embodiments, the frame members 90, 94 and/or mullions 98, 102 can be manufactured by any other suitable die based extrusion process (e.g., hot extrusion, cold extrusion, micro extrusion, warm extrusion, etc.), or can otherwise be molded, cast, or formed by any other suitable manufacturing process.

A quick connect-disconnect feature facilitates removal and/or installation of the mullions 98, 102 with the top and bottom frame members 90, 94 quickly and easily. The quick connect-disconnect feature also facilitates alignment and engagement of an electrical connection between the mullions 98, 102 and the top and bottom frame members 90, 94.

Referring back to FIG. 7, to facilitate the quick connect-disconnect between the center mullion 102 and the top and bottom frame members 90, 94, each of the frame members 90, 94 includes respective center mullion mounting assemblies 326, 330. The first mullion mounting assembly 326 is configured to slidably engage the top frame member 90. More specifically, the first mullion mounting assembly 326 can engage a gap or slot 334 that is disposed in the top frame member 90. Similarly, a second mullion mounting assembly 330 is configured to slidably engage the bottom frame member 94. More specifically, the second mullion mounting assembly 330 engages a gap or slot 338 disposed in the bottom frame member 94.

To facilitate the quick connect-disconnect between each end mullion 98 and the top and bottom frame members 90, 94, each of the frame members 90, 94 includes respective end mullion mounting assemblies 342, 346. The third mullion mounting assembly 342 slidably engages the top frame member 90. (e.g., a gap or slot 350 disposed in the top frame member 90). The fourth mullion mounting assembly 346 is configured to slidably engage the bottom frame member 94 (e.g., a gap or slot 354 disposed in the bottom frame member 94). It should be appreciated that the first and second center mullion mounting assemblies 326, 330 can be the same or substantially the same, with like numbers identifying like components. Similarly, the third and fourth end mullion mounting assemblies 342, 346 can be the same or substantially the same, with like numbers identifying like components. Furthermore, similar elements in the mullion mounting assemblies 326, 330, 342, 346 have the same reference numerals to identify like components.

Referring to FIGS. 8-9, the first mounting assembly 326 includes a hinge portion 358 and a mullion attachment portion 362 (shown in FIG. 8). The hinge portion 358 includes a recess or female portion 366 that is configured to receive a door pivot 370, which is shown in FIG. 7 and described in detail below. The mullion attachment portion 362 includes a mullion pocket 374 (or second mullion pocket 374) that is defined by a housing 378. A plurality of spring clips 382 (or biased tabs 382) is positioned in the mullion pocket 374. In addition, a fifth electrical connector 386 (shown in FIG. 8) is nested in (or coupled to) the mullion pocket 374. The fifth electrical connector 386 includes a plurality of tabs 142 and a plurality of sockets 146. As will be appreciated, the fifth electrical connector 386 can include one or more tabs 142, one or more sockets 146, or a combination of thereof.

Referring to FIGS. 10-11, the second mounting assembly 330 also includes a hinge portion 358 and a mullion attachment portion 362 (shown in FIG. 10). The mullion attachment portion 362 includes a mullion pocket 390 (or second mullion pocket 390) that is defined by a housing 394 (shown in FIG. 10). A plurality of spring clips 382 (or biased tabs 382) is positioned in the mullion pocket 390. In addition, a sixth electrical connector 398 (shown in FIG. 10) is nested in (or coupled to) the mullion pocket 390. The sixth electrical connector 398 is the same as or substantially similar to the fifth electrical connector 386, and similarly includes a plurality of tabs 142 and a plurality of sockets 146. It should be appreciated that the hinge portion 358 and associated female portion 366 in one or both the first and second mounting assemblies 326, 330 can be optional and/or removable based on the orientation of the door 54.

Referring to FIGS. 15-16, the third mounting assembly 342 includes a hinge portion 358 and an end mullion attachment portion 402. The hinge portion 358 can include a recess or female portion 366 that is configured to receive the door pivot 370, which is shown in FIG. 7 and discussed in additional detail below. As illustrated in FIG. 15, the end mullion attachment portion 402 includes a mullion pocket 406 that is defined by a housing 410. A spring clip 382 (or biased tab 382) is positioned in the mullion pocket 406. In addition, a seventh electrical connector 414 (shown in FIG. 15) is nested in (or coupled to) the mullion pocket 406. The seventh electrical connector 414 includes a plurality of tabs 142 and a plurality of sockets 146.

Referring to FIGS. 17-18, the fourth mounting assembly 346 also includes a hinge portion 358 and an end mullion attachment portion 418. The hinge portion 358 has a recess or female portion 366 that receives the door pivot 370, which is also shown in FIG. 7 and described in detail below. As illustrated in FIG. 17, the end mullion attachment portion 418 includes a mullion pocket 422 that is defined by a housing 426. A spring clip 382 (or biased tab 382) is positioned in the mullion pocket 422. In addition, an eighth electrical connector 430 is nested in (or coupled to) the mullion pocket 422. The eighth electrical connector 430 is the same as or substantially similar to the seventh electrical connector 414, and includes a plurality of tabs 142 and a plurality of sockets 146. It should be appreciated that the hinge portion 358 and associated female portion 366 in both the third and fourth mounting assemblies 342, 346 can be optional and/or removable based on the orientation of the door 54.

To connect the center mullion 102 to the top and bottom frame members 90, 94, the first and second mullion housings 132, 154 are positioned in alignment with the respective first and second mullion mounting assemblies 326, 330. As illustrated in FIGS. 8-11, the top mullion pockets 130, 374 and bottom mullion pockets 150, 390 are complementary to each other such that the mullion pocket 130, 150 on each end of the mullion 102 is aligned and engageable with the respective mullion pocket 374, 390 of each mounting assembly 326, 330 complementary. Furthermore, each spring clip 382 is positioned in alignment with an associated opening 134 on the mullion 102. By positioning the spring clips 382 in alignment with an associated opening 134 on the mullion 102, the electrical connectors 138, 158 on the center mullion 102 are automatically positioned into alignment with a corresponding electrical connector 386, 398 on the mounting assembly 326, 330. The top electrical connectors 138, 386 and the bottom electrical connectors 158, 398 are complementary. The center mullion 102 is then inserted into each mounting assembly 326, 330.

Figure 20:
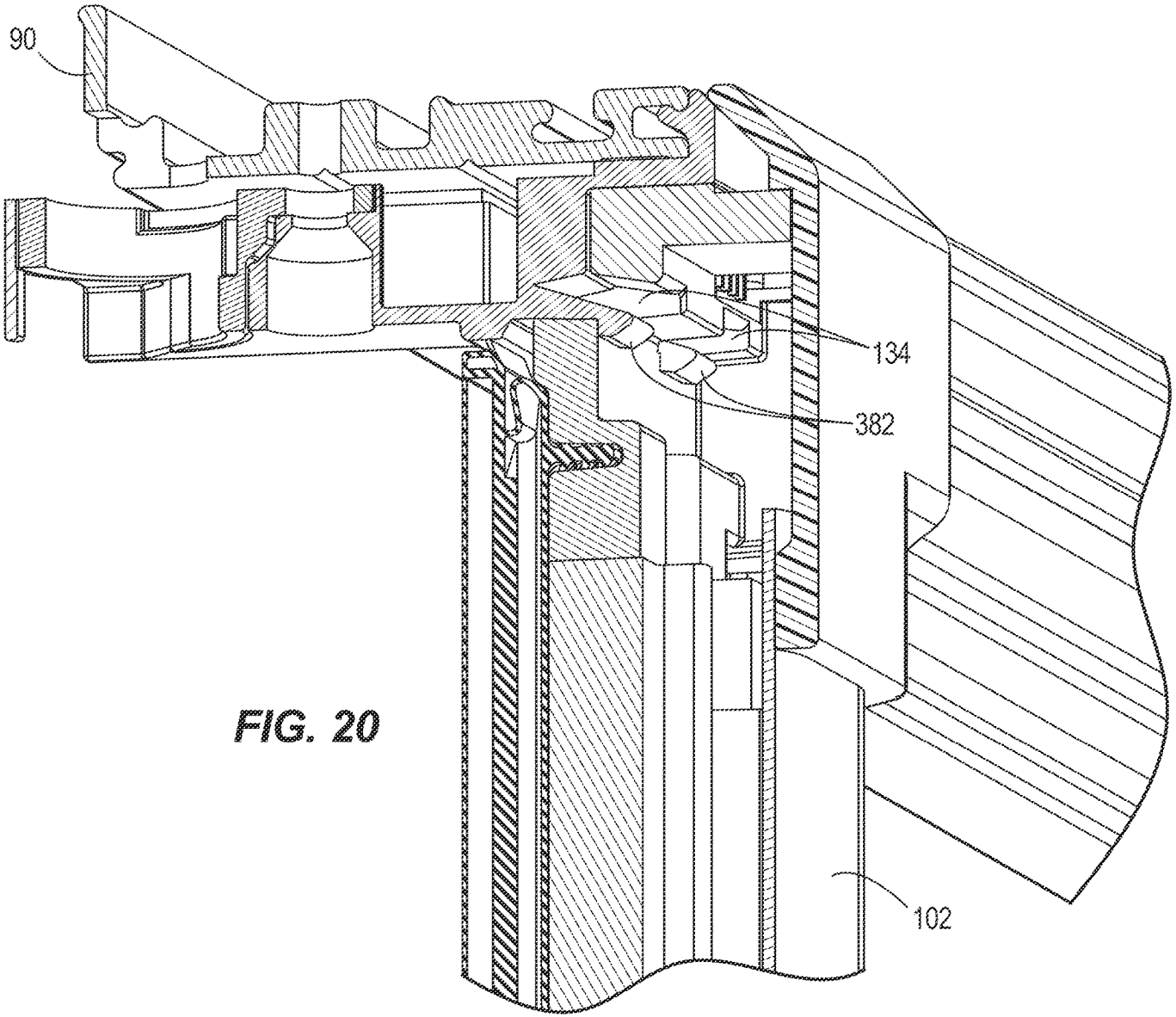
FIG. 20 is a cross-sectional view of the top end of the center mullion of FIG. 5, illustrating the removable connection with the top frame member of the case frame assembly.
Figure 21:
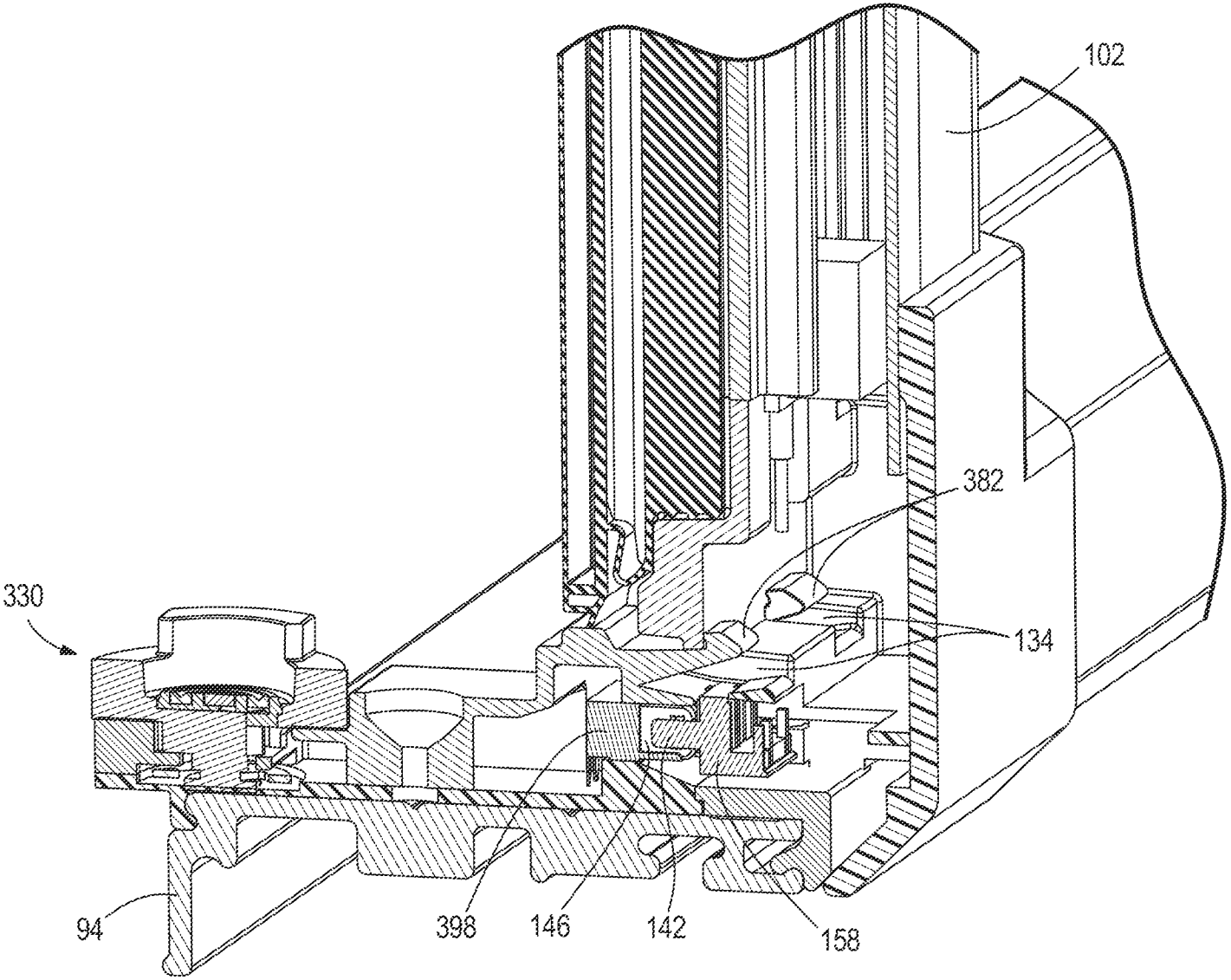
FIG. 21 is a cross-sectional view of the bottom end of the center mullion of FIG. 5, illustrating the removable connection with the bottom frame member of the case frame assembly.

During insertion, each opening 134 receives an associated spring clip 382, each mullion electrical connector 138, 158 engages with a corresponding electrical connector 386, 398 on the mounting assembly 326, 330, and each mullion pocket 374, 390 of each mounting assembly 326, 330 receives the corresponding mullion pocket 130, 150 on the center mullion 102. As shown in FIGS. 20-21, after the spring clips 382 are each received by the associated openings 134, the spring clips 382, which flex slightly upon insertion, bias into engagement with a respective portion of the center mullion 102 to connect the center mullion 102 to the top and bottom frame members 90, 94. Accordingly, the spring clips 382 and the openings 134 define an exemplary attachment mechanism between the mullions and the upper and lower portions of the case frame. In addition, as illustrated in FIG. 21, the electrical connector 158 on the center mullion 102 and the electrical connector 398 on the mounting assembly 330 couple to form an electrical connection between the frame member 94 and the center mullion 102 (e.g., each tab 142 of one electrical connector 158, 398 is received by a corresponding socket 146 of the other electrical connector 398, 158, etc.). The electrical connection provides power from the case frame 46 to the center mullion 102 to power components of the center mullion 102 (e.g., the light assembly 194, the heater 206, etc.). While the connection between the electrical connectors 158, 398 at the bottom end 114 of the center mullion 102 is illustrated and described in detail, it should be appreciated that the same electrical connection also occurs at the top end 110 of the center mullion 102 between the electrical connectors 138, 386 in the same fashion.

To release the center mullion 102 from the top and bottom frame members 90, 94, the bias on each spring clip 382 can be overcome (e.g., by applying a force on each clip 382 from inside the product display area) to disengage each clip 382 from the respective portion of the center mullion 102. The clip 382 can then be removed from the corresponding opening 134. During removal, the electrical connectors 138, 158 on the center mullion 102 disengage from the electrical connectors 386, 398 on the mounting assembly 326, 330, which terminates the flow of electricity from the case frame 46 to the center mullion 102. The center mullion 102 can then be completely withdrawn from the respective mullion pocket 374, 390 of each mounting assembly 326, 330.

To connect each end mullion 98 to the top and bottom frame members 90, 94, the third and fourth mullion housings 246, 254 are positioned in alignment with the respective third and fourth mullion mounting assemblies 342, 346. As illustrated in FIGS. 15-18, the mullion pocket 258, 266 on each end of the end mullion 98 is aligned with the respective mullion pocket 406, 422 of each mounting assembly 342, 346. The top mullion pockets 258, 406 and the bottom mullion pockets 266, 422 are complementary and engage each other upon alignment and movement of the mullion 98 toward toe frame members 90, 94. Furthermore, each spring clip 382 is positioned in alignment with an associated opening 134 on the end mullion 98. By positioning the spring clips 382 in alignment with an associated opening 134 on the end mullion 98, the electrical connectors 262, 270 on the end mullion 98 are positioned in alignment with the corresponding electrical connectors 414, 430 on the mounting assembly 342, 346. The top electrical connectors 262, 414 and the bottom electrical connectors 270, 430, respectively also are complementary and configured to engage each other. The end mullion 98 is then inserted into each mounting assembly 342, 346. During insertion, each opening 134 receives an associated spring clip 382, each mullion electrical connector 262, 270 engages with a corresponding electrical connector 414, 430 on the mounting assembly 342, 346, and each mullion pocket 406, 422 of each mounting assembly 342, 346 receives the corresponding mullion pocket 258, 266 on the end mullion 98.

Figure 22:
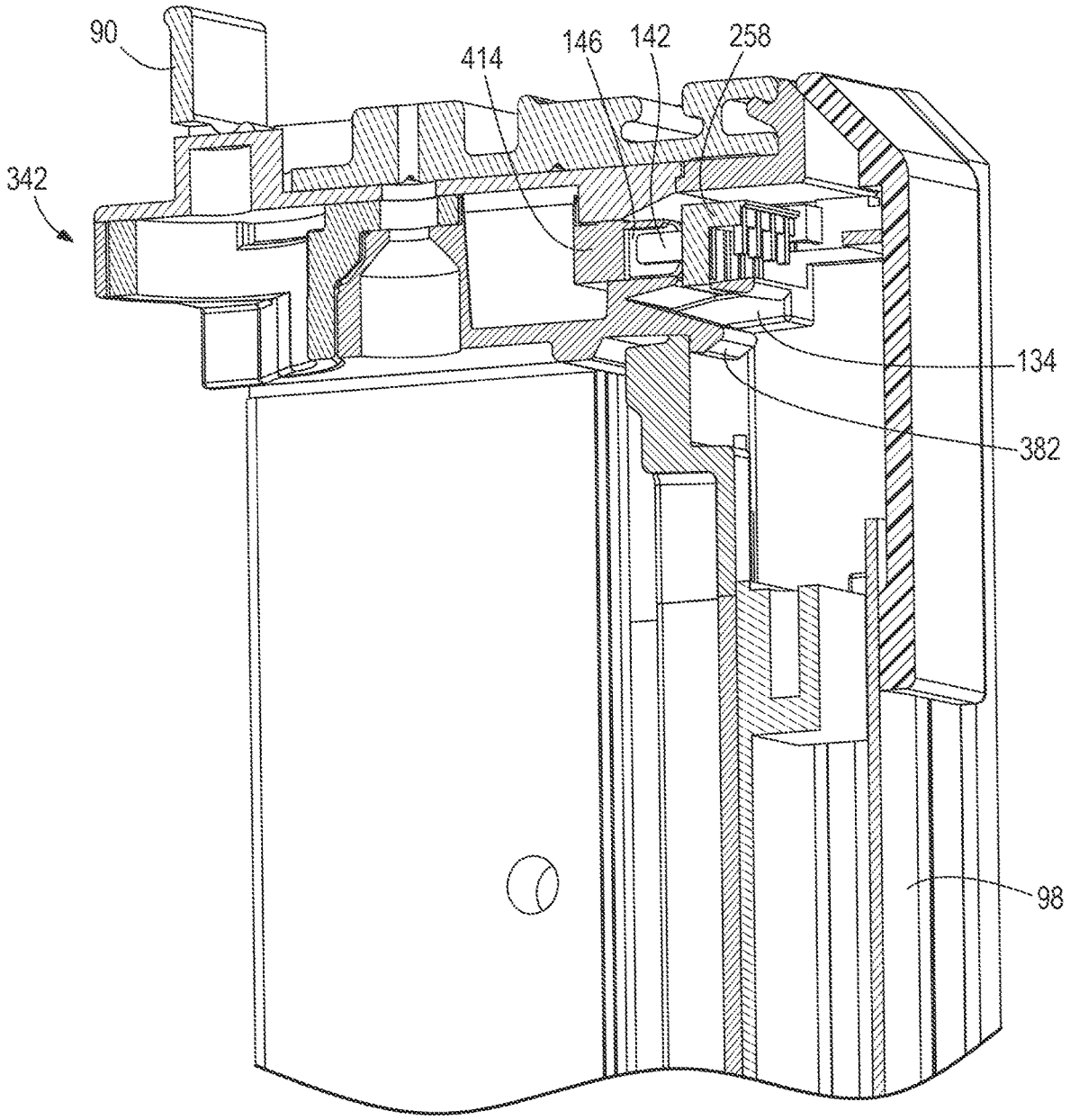
FIG. 22 is a cross-sectional view of the top end of the end mullion of FIG. 5, illustrating the removable connection with the top frame member of the case frame assembly.
Figure 23:
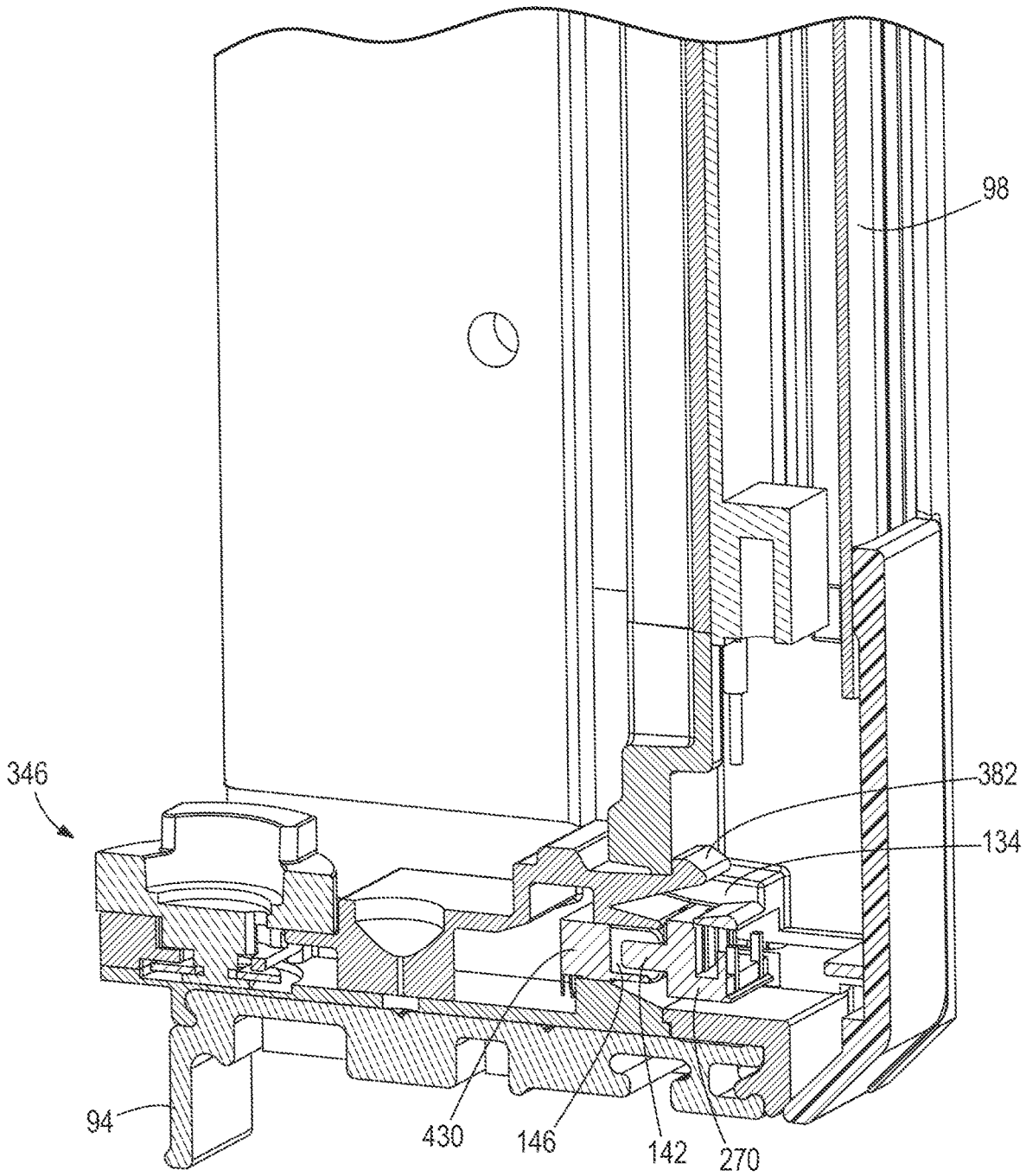
FIG. 23 is a cross-sectional view of the bottom end of the end mullion of FIG. 5, illustrating the removable connection with the bottom frame member of the case frame assembly.

As shown in FIGS. 22-23, after the spring clips 382 are each received by the associated opening 134, the spring clips 382 bias into engagement with a respective portion of the end mullion 98 to connect the center mullion 98 to the top and bottom frame members 90, 94. Accordingly, the spring clips 382 and the openings 134 define an exemplary attachment mechanism for the mullion 98 and the frame members 90, 94. In addition, as illustrated in FIG. 22, the electrical connector 258 on the end mullion 98 and the electrical connector 414 on the mounting assembly 342 couple to form an electrical connection between the top frame member 90 and the end mullion 98 (e.g., each tab 142 of one electrical connector 258, 414 is received by a corresponding socket 146 of the other electrical connector 414, 258, etc.). Similarly, as illustrated in FIG. 23, the electrical connector 270 on the end mullion 98 and the electrical connector 430 on the mounting assembly 346 couple to form an electrical connection between the bottom frame member 94 and the end mullion 98 (e.g., each tab 142 of one electrical connector 270, 430 is received by a corresponding socket 146 of the other electrical connector 430, 270, etc.). The electrical connection provides power from the case frame 46 to the end mullion 98 to power one or more components of the end mullion 98 (e.g., the light assembly 298, the heater 306, etc.).

To release the end mullion 98 from the top and bottom frame members 90, 94, the bias on each spring clip 382 can be overcome (e.g., by applying a force on each clip 382 from inside the product display area) to disengage each clip 382 from the respective portion of the end mullion 98. The clip 382 can then be removed from the corresponding opening 134. During removal, the electrical connectors 258, 270 on the end mullion 98 respectively disengage from the electrical connector 414, 430 on the mounting assembly 342, 346, terminating the flow of electricity from the case frame 46 to the end mullion 98. The end mullion 98 can then be withdrawn from the respective mullion pocket 406, 422 of each mounting assembly 342, 346.

Figure 24:
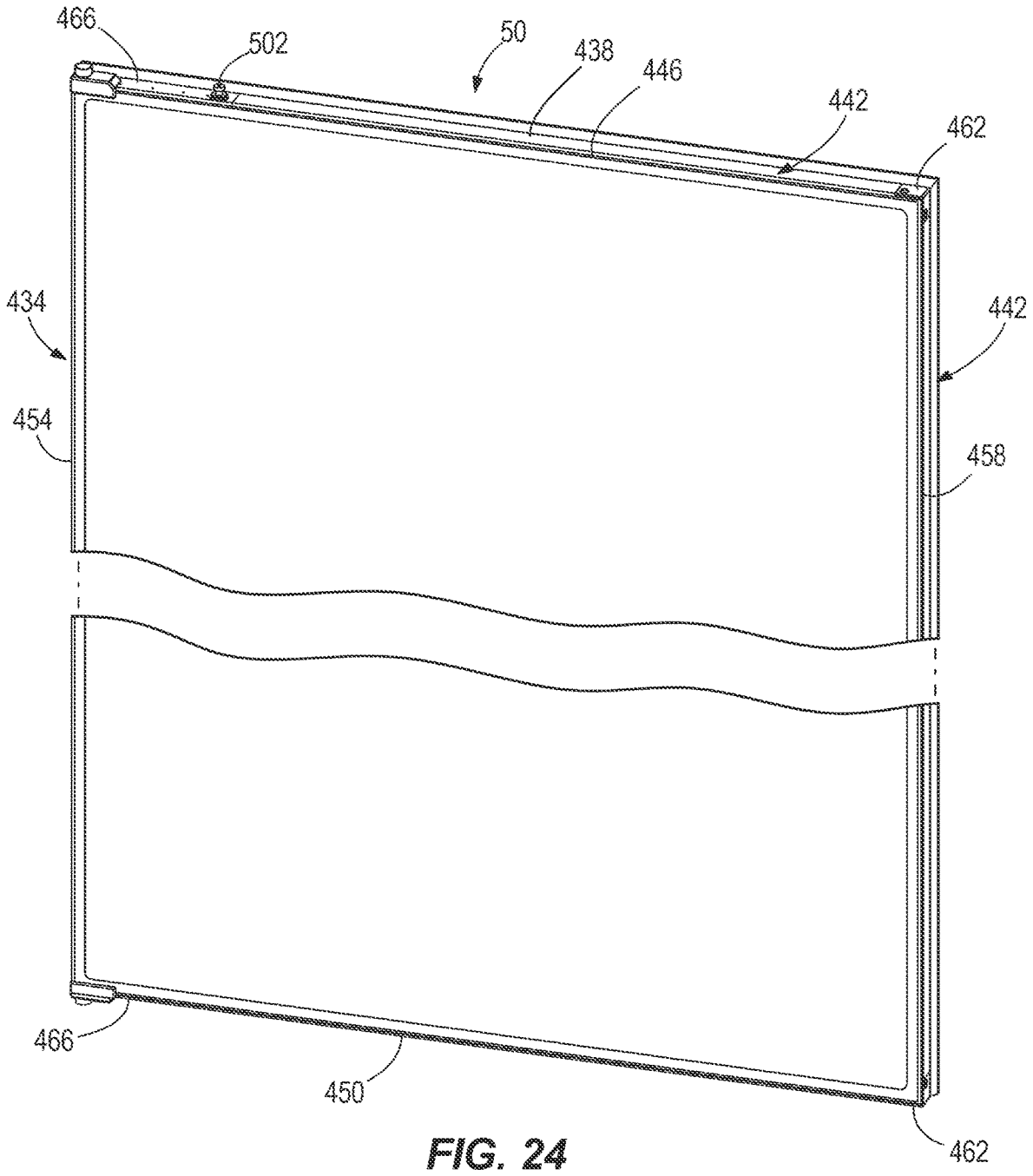
FIG. 24 is a perspective view of one door of the merchandiser of FIGS. 1 and 2.
Figure 25:
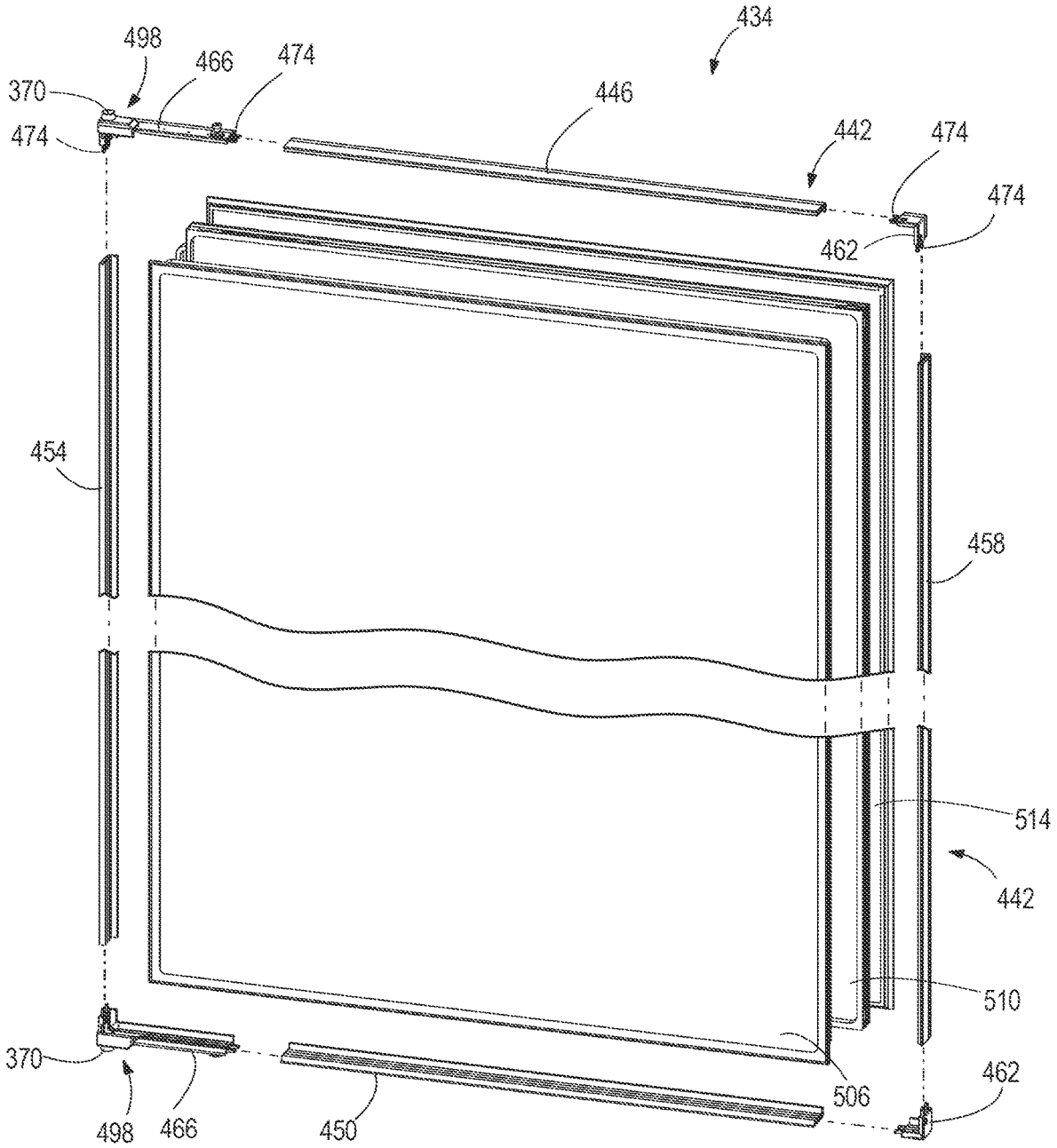
FIG. 25 is an exploded view of the door of FIG. 24, illustrating a modular door frame assembly including a frame and a glass panel assembly.
Figure 26:
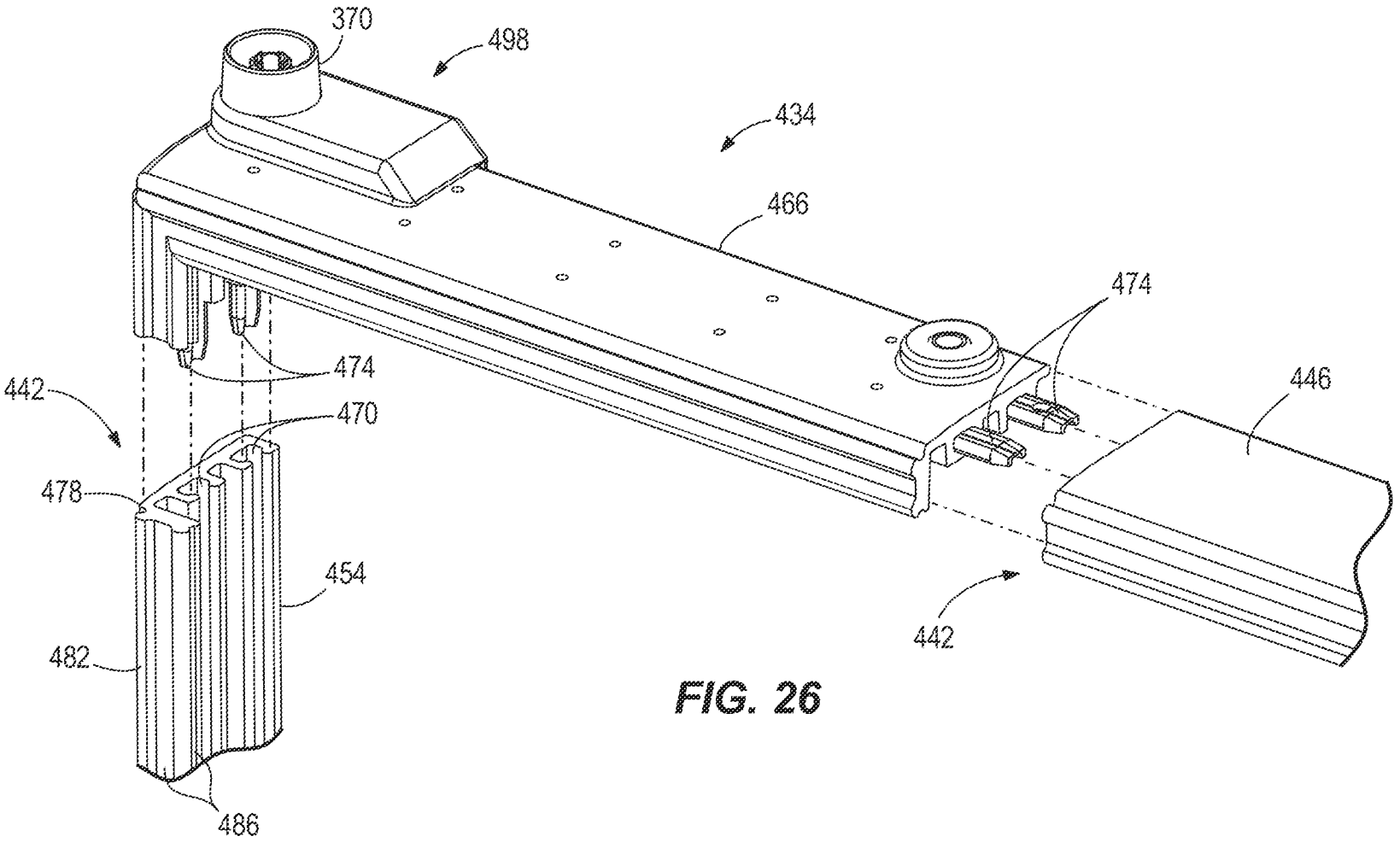
FIG. 26 is a exploded perspective view of a corner of the door frame of FIGS. 24 and 25.

With reference to FIGS. 24-26 the door 50 includes a door frame assembly 434 that includes a door frame 438. The door frame assembly 434 is a modular assembly that has a plurality of pultrusion-formed frame members 442 that interlock by a tab and slot combination (see FIGS. 25-26). More specifically, the frame members 442 include a top frame member 446, a bottom frame member 450, a first upright member 454, a second upright member 458, and a plurality of corner members 462, 466. With reference to FIG. 26, the top, the bottom, and the upright members 446, 450, 454, 458 each include a plurality of longitudinal slots 470 that extend along a length of the respective member 446, 450, 454, 458. The slots 470 are each configured to receive a projection 474 that is positioned on the corner members 462, 466. This facilitates an interlocking connection between each member 446, 450, 454, 458 and a corresponding corner member 462, 466 to define the door frame assembly 434, and more specifically the door frame 438. It should be appreciated that while FIG. 26 illustrates one example of a corner member 466 engaging with the members 446, 454, the other corner members 462, 466 engage with respective members 446, 450, 454, 458 (shown in FIG. 25) generally in the same manner (i.e. in tab and slot combinations). In addition, while the corner members 462, 466 are illustrated as having two projections 474, the corner members 462, 466 can have any suitable quantity of projections 474 (e.g., one or more than two projections, etc.). In other embodiments, the members 446, 450, 454, 458 can each include one or more projections 474 that are configured to engage respective slots 470 positioned in the corner members 462, 466.

Figure 27:
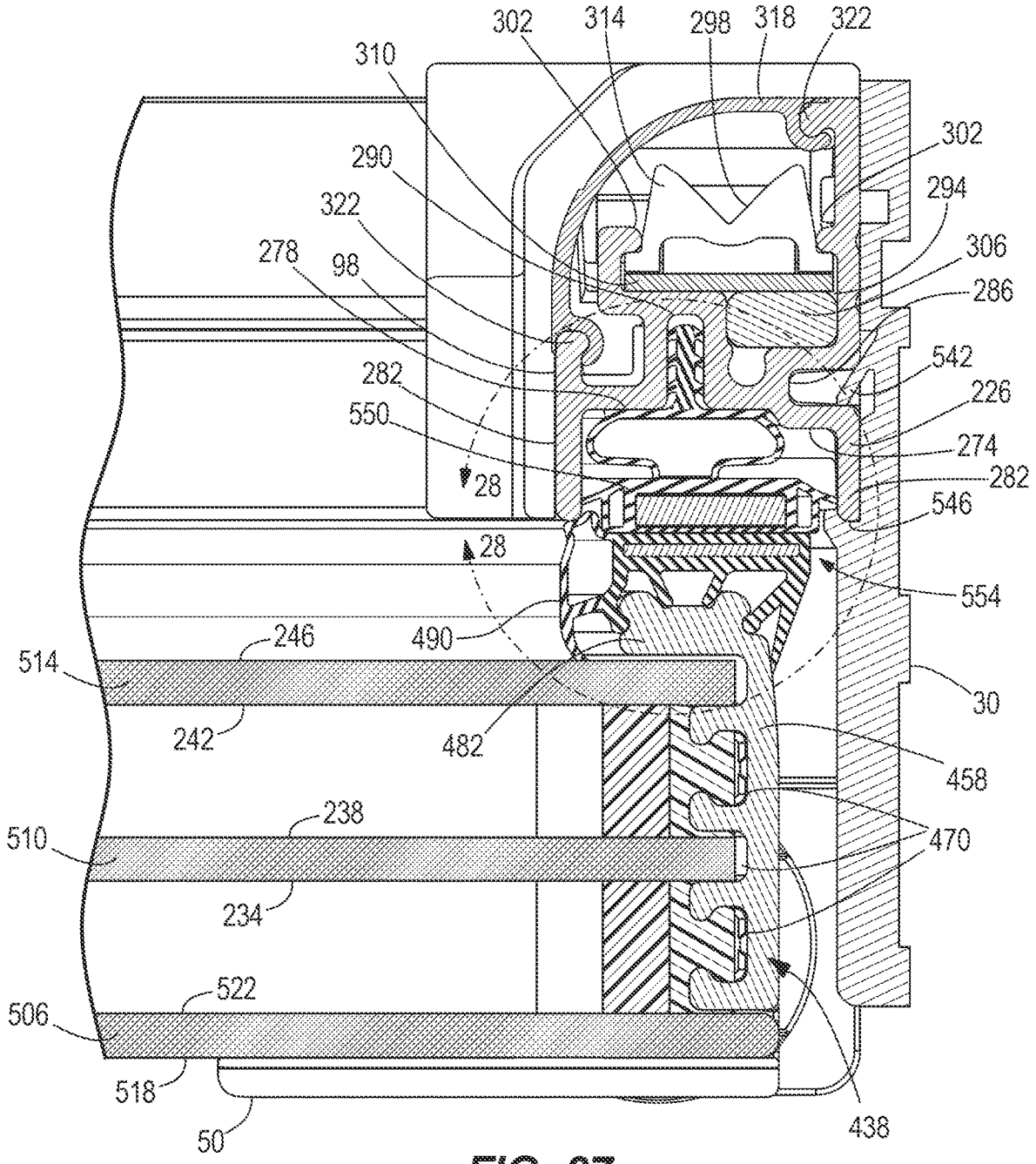
FIG. 27 is a cross-sectional view of a portion of the merchandiser of FIG. 1, taken along line 27-27 of FIG. 1.
Figure 28:
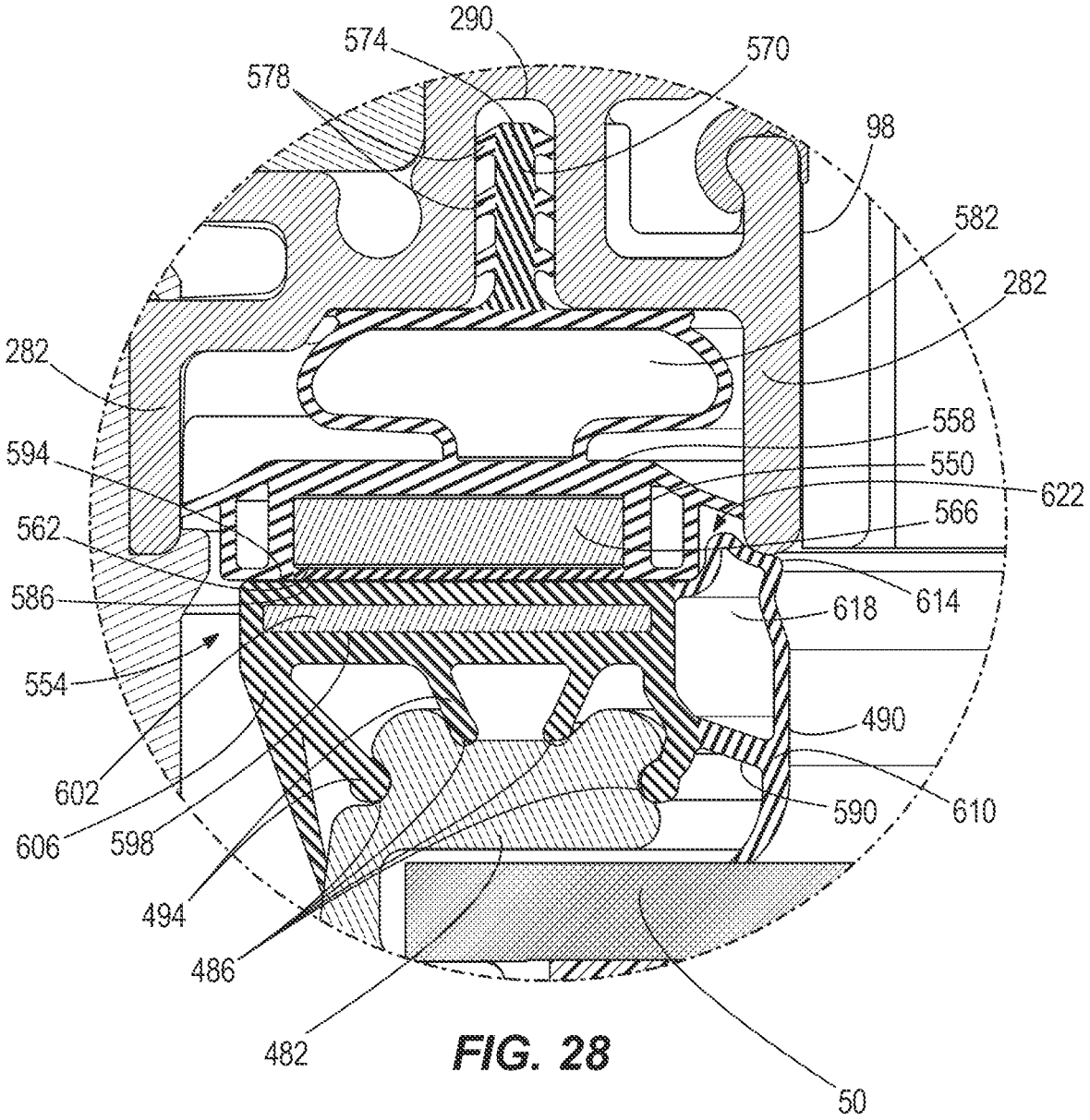
FIG. 28 is an enlarged view of a portion of FIG. 27 taken along line 28-28 of FIG. 27, illustrating a seal assembly between the door in a closed position relative to the case frame with first and second portions of the seal assembly in a contact relationship.

With specific reference to FIG. 25, the frame members 446, 450, 454, 458 are substantially alike. The top and bottom frame members 446, 450 are generally parallel to each other, while the upright (or side) members 454, 458 extend longitudinally between the top and bottom frame members 446, 450 and are generally parallel to each other. Referring now to FIG. 26, the first upright member 454 includes a member portion 478 that defines the slots 470. The member portion 478 also includes a post 482 that defines a plurality of channels 486 (also shown in FIG. 28). The channels 486 are elongated and extend longitudinally along the first upright member 454. As shown in FIGS. 27 and 28, the post 482 and associated channels 486 are configured to receive or couple a door gasket 490 to the door 50. With reference to FIG. 28, the door gasket 490 is coupled to the post 482, and thus the door frame 438, by a plurality of attachment arms 494. The arms 494 are configured to be received by the channels 486 (e.g., via a snap-fit arrangement). While FIG. 26 illustrates the slots 470, member portion 478, post 482, and channels 486 in association with the first upright member 454, it should be appreciated that all frame members 446, 450, 454, 458 can include these structural features.

As best seen in FIGS. 25 and 26, the corner members 462, 466 generally include the same components, such as the projections 474, except that corner members 466 also include a door pivot assembly 498. The door pivot assembly 498 includes the door pivot 370, which is illustrated as a male portion 370 that is configured to be received by the recess or female portion 366 (shown in FIGS. 8-11 and 15-18). As shown, the door pivot 370 projects outward from the door frame assembly 434 and defines the hinge or door pivot axis 62 (shown in FIGS. 3, 4, and 7). Each corner member 466 also includes a door closure guide mount 502

(shown in FIGS. 7 and 24). The door closure guide mount 502 is disposed on the corner member 466, and thus the door frame 438.

Referring now to FIG. 27, the illustrated door 50 includes a glass panel assembly that has a plurality of glass panels 506, 510, 514 coupled to the door frame 438 (shown in FIG. 24). While the illustrated door 50 includes three glass panels 506, 510, 514, fewer or more glass panels can be included in the door 50. The first glass panel 506 includes a first surface 518 and a second surface 522 that is opposite the first surface 518. The second glass panel 510 includes a third surface 526 and a fourth surface 530 that is opposite third surface 526, with the third surface 526 facing the second surface 522 of the first panel 506. The third glass panel 514 includes a fifth surface 534 that is opposite a sixth surface 538 that defines an innermost surface facing the product display area 54. The fifth surface 534 faces the fourth surface 530. The first surface 518 and the sixth surface 538 are both exposed surfaces. The first surface 518 of the first glass panel 506 is an outermost surface of the door that is exposed to an ambient environment surrounding the merchandiser 10. The sixth surface 538 of the third glass panel 514 is an innermost surface of the door that is adjacent (or exposed) to the temperature controlled product display area 54 (see FIG. 1). In doors 50 having two (or more) glass panels, the first glass panel 506 can be exposed to the ambient environment surrounding the merchandiser 10, while the second glass panel 510 can be positioned adjacent the product display area 54.

With reference to FIG. 27, the end mullion 98 is attached to one of the side walls 30 of the merchandiser 10. To facilitate the connection with the side wall 30, the side wall 30 includes an arm 542 and a cavity 546 that is defined by a portion of the side wall 30. One of the end mullion sidewalls 282 is received by the cavity 546. The arm 542 of the side wall 30 is also received by the groove 286 of the end mullion 98. The arm 542 can provide a compressive force against the mullion body 226 (or a portion thereof) to assist with retention of the sidewall 282 in the cavity 546. In some embodiments, an intermediate panel (not shown) can be provided as an interface between the side wall 30 and the end mullion 98. The intermediate panel can be attached to the side wall 30 and can include the arm 542 and the cavity 546 to engage with the end mullion 98, while also providing additional structural support for the end mullion 98.

With reference to FIGS. 27 and 28, a first gasket or mullion gasket 550 is coupled to the end mullion 98. The first gasket 550 and the door gasket or second gasket 490 cooperatively define a seal assembly 554 that is positioned between the door 50 and the end mullion 98 to facilitate a seal between the door 50 and the mullion 98.

Referring to FIG. 28, the first gasket 550 includes a first gasket element 558 that defines a first cavity 562, and a first attachment element 566 (e.g., a magnet, ferromagnetic material, a material having ferritic, ferromagnetic, or martensitic structures such as a metallic strip, etc.; described as a 'ferromagnetic element' for purposes of the description and the claims) that is disposed in or received by the first cavity 562.

The first gasket element 558 also includes a fastener 570 that is engaged with the gasket securement cavity 290 that is defined by the mullion body 226 (FIG. 19). The fastener 570 includes a post 574 that is formed of a first material, and a plurality of barbs 578 formed of a second material that is softer (less rigid, more flexible, more malleable) than the first material. While the first fastener 570 is illustrated as a plug fastener that has a plurality of barbs, in other embodiments any fastener suitable to fasten the gasket 558 to the mullion 98 can be used.

With continued reference to FIG. 28, the first gasket element 558 further defines an air gap (or cavity) 582 that is disposed between the fastener 574 and the first cavity 562 and that assists with insulating the area in which the gasket element 558 is positioned. The portion of the first gasket element 558 that defines the first cavity 562 and the air gap 582 is also formed of the second material that is softer (less rigid, more flexible, more malleable) than the first material.

When the fastener 574 is inserted into the cavity 290, the gasket 550 is received by (e.g., nested in) the mullion 98. When nested in or attached to the mullion 98, an exterior-facing surface 586 of the gasket 550 can flex or be generally bowed (or is generally convex), with the bowed portion extending away from the mullion 98 to contact a portion of the second gasket 490 when the door 50 is in a closed position or a closed configuration.

The second gasket 490 includes a second gasket element 590 that has a wall or interior-facing surface 594. When the door 50 is in the closed position or closed configuration, the interior-facing surface 594 faces the exterior-facing surface 586. The second gasket element 590 defines a second cavity 598, with the wall 594 partially defining the cavity 598. The second gasket element 590 supports a second attachment element 602 (e.g., a magnet, ferromagnetic material, a material having ferritic, ferromagnetic, or martensitic structures such as a metallic strip, etc.; described as a 'ferromagnetic element' for purposes of the description and the claims) that is disposed in or received by the second cavity 598. As shown in FIG. 28, the second gasket element 590 can include a first portion 606 that is formed of a first material, and a second portion 610 that is formed of a second material that is softer (or less rigid, or more flexible, or more malleable) than the first material. The first and second portions 606, 610 can be coextruded with the first and second materials to form the second gasket 490.

The second gasket element 590 also includes a seal portion or lip 614 that defines a hollow chamber or air gap 618. The seal portion 614 is configured to engage or contact a portion of the mullion 98 (illustrated as the sidewall 282 in FIG. 28) to form a seal between the second gasket 490 and the mullion 98 when the door 50 is in a closed position or a closed configuration. The hollow chamber 618 may permit a partial collapse or deformation of the seal portion 614 upon engagement of the seal portion 614 with the mullion 98 so that the connection between the door 50 and the mullion 98 is substantially or completely air tight.

As illustrated in FIGS. 27-28, the first and second gaskets 490, 550 are in a contact relationship with each other to form a seal between the door 50 and the mullion 98. However, while the gaskets 490, 550 are in contact with each other, the gaskets 490, 550 generally do not compress (or are non-compressible or in non-compressible contact). To assist with maintaining the contact relationship between the gaskets 490, 550, the attachment elements 566, 602 cooperate, via magnetic attraction, to form a magnetized coupling. The magnetized coupling between the gaskets 490, 550, and in turn between the door 50 and the mullion 98, maintains the seal between the door 50 and the mullion 98, and further assists to maintain the door 50 in a closed position in relation to the mullion 98. The seal between the gaskets 490, 550, and the seal portion 614 that are in engagement with the mullion 98 cooperate to limit infiltration of ambient air (or air from the environment surrounding the merchandiser 10) into the product display area 54. Limiting infiltration of air is desirable in certain applications, for example low temperature applications, to prevent water or condensate from accumulating in a gap 622 between the gaskets 490, 550. When the door 50 is transitioned into an open position (or an open configuration), the door 50 moves relative to the mullion 98 to disengage the contact relationship of the gaskets 490, 550, and to disengage the seal portion 614 from engagement with the mullion 98.

Figure 29:
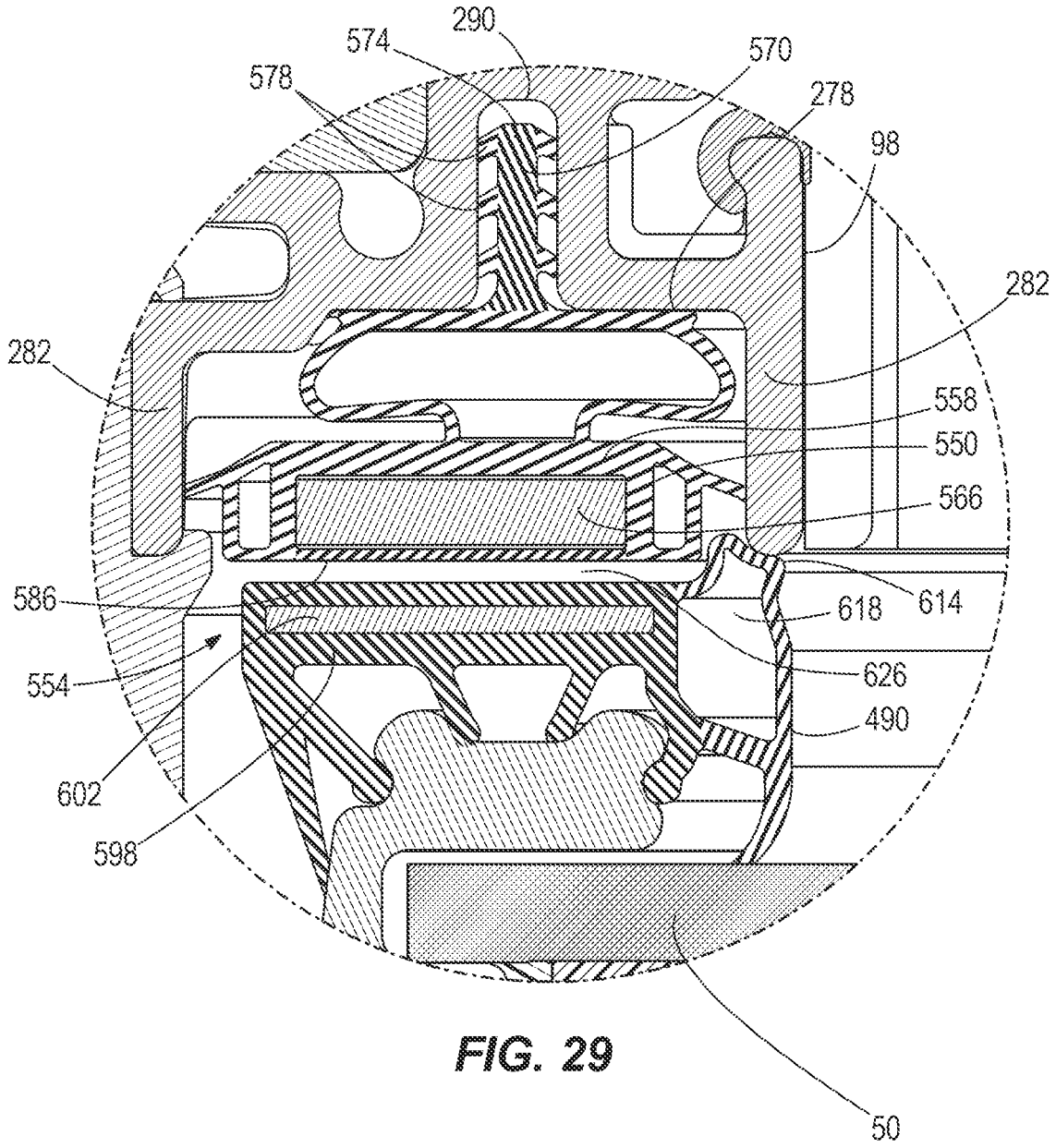
FIG. 29 is the enlarged view of a seal assembly similar to the seal assembly illustrated in FIG. 28, illustrating the door in the closed position relative to the case frame and the first and second portions of the seal assembly in a non-contact relationship.

FIG. 29 illustrates another embodiment of the seal assembly 554. For ease of understanding, like components will be identified with like reference numerals. When the fastener 570 is inserted into the cavity 290, the gasket 550 is received by (e.g., nested in) the mullion 98. When nested in the mullion 98, the exterior-facing surface 586 of the gasket 550 is generally aligned with an outermost extent of the mullion 98 instead of protruding outward from the mullion 98 like the assembly 554 described with regard to FIG. 28. For example, the outermost extent of the mullion 98 is defined by ends of the sidewalls 282 that are disposed opposite the support surface 278 (e.g., the same end of the sidewall 282 received by the channel 546 on the side wall 30 shown in FIG. 27). Due to the alignment of the gasket 550 with the extents of the mullion 98, and the recessed nature of the door gasket 490 relative to the seal 614, the first and second gaskets 490, 550 are oriented in a non-contact relationship relative to each other. The first attachment element 566 and the second attachment element 602 are spaced apart from each other by a gap 626 (i.e., are in non-contact relationship with each other), but cooperate, via magnetic attraction, to form a magnetized coupling that maintains the door 50 in a closed position in relation to the mullion 98. Stated another way, the chamber 618, the gap 626, and the seal 614 cooperate to limit infiltration of ambient air (or air from the environment surrounding the merchandiser 10) into the product display area 54. When the door 50 is transitioned into an open position (or an open configuration), the door 50 moves relative to the mullion 98 to disengage the non-contact, facing relationship of the gaskets 490, 550 (and the attachment elements 566, 602), and to disengage the seal portion 614 from engagement with the mullion 98. In the illustrated embodiment, the gaskets 490, 550 are non-compressible gaskets.

Figure 30:
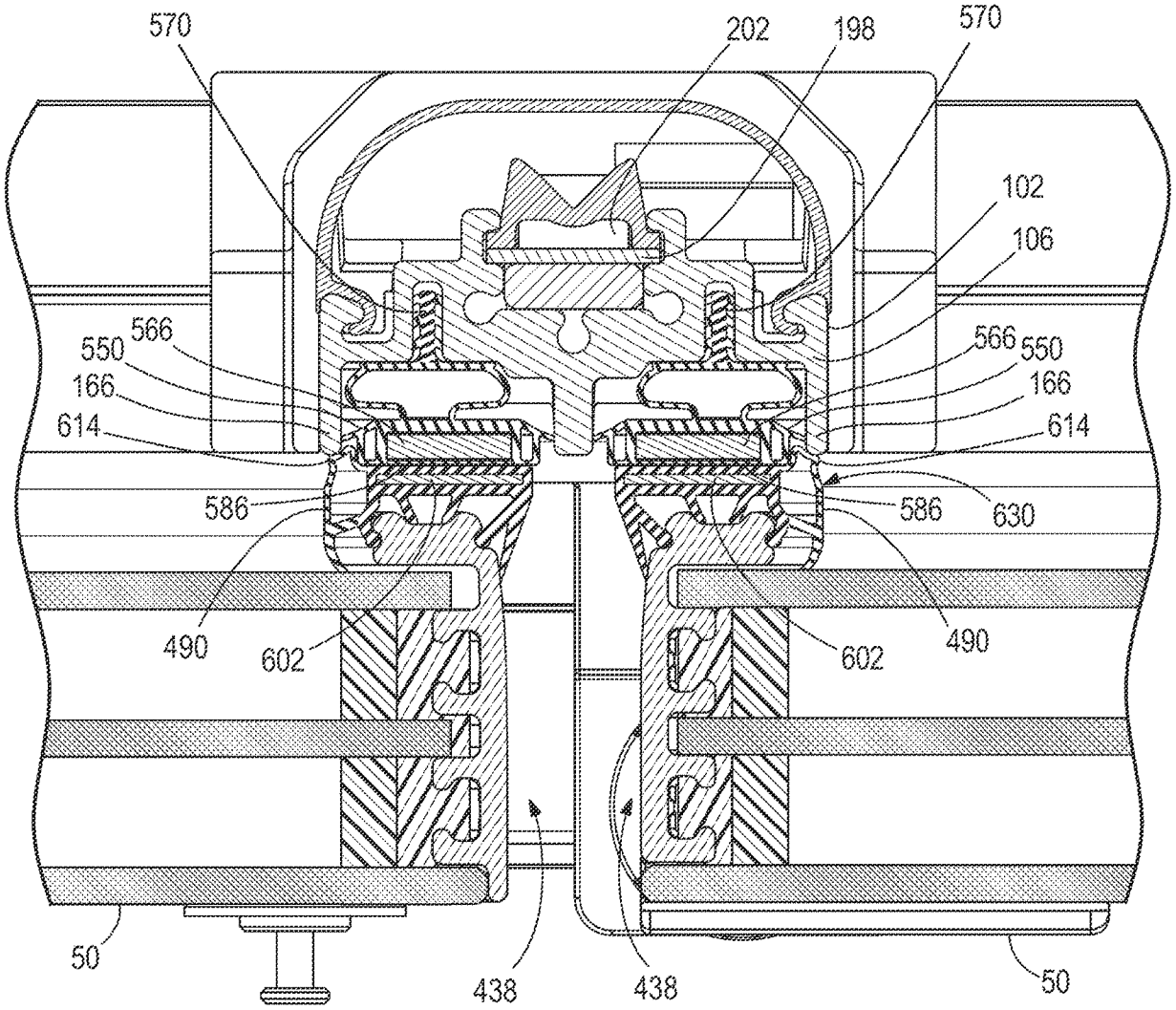
FIG. 30 is a cross-sectional view of a portion of the merchandiser of FIG. 2, taken along line 30-30 of FIG. 2, illustrating a seal assembly between the doors and the center mullion with the first and second portions in a contact relationship.

FIG. 30 illustrates a cross-section of a portion of the doors 50, the center mullion 102, and a seal assembly 630 that is positioned between each door 50 and the center mullion 102. The seal assembly 630 facilitates a seal between the doors 50 and the center mullion 102. The seal assembly 630 is substantially similar to the seal assembly 554, with like terms being used to describe like components. A plurality of first gaskets or mullion gaskets 550 are coupled to the center mullion 102. Generally, each gasket 550 is associated with a door 50. The fasteners 570 of each gasket 550 engage one of the cavities 174 (see FIGS. 12-13) to retain the gaskets 550 in the center mullion 102. When the fasteners 570 are received by (or are engaged with) the cavities 174, the gaskets 550 are nested in (or received by) the center mullion 102. When nested in the mullion 102, an exterior-facing surface 586 of the gasket 550 flexes or can be bowed (or is generally convex), with the bowed portion extending away from the center mullion 102 to contact a portion of the second gasket 490 when the door 50 is in a closed position or a closed configuration.

The second gasket 490 (e.g., the door gasket 490) on the door frame 438 of each door 50 is configured to engage a corresponding first gasket 550 on the center mullion 102 in a contact relationship when the doors 50 are in the closed position. The first and second gaskets 490, 550 are in a contact relationship with each other to form a seal between the door 50 and the center mullion 102. In other embodiments, the gaskets 490, 550 may not compress (or are non-compressible or in non-compressible contact). The first and second attachment elements 566, 602 cooperate, via magnetic attraction, to form a magnetized coupling. The magnetized coupling between the gaskets 490, 550, and in turn between each door 50 and the center mullion 102, maintains the seal between the door 50 and the center mullion 102, and further assists to maintain the door 50 in a closed position in relation to the center mullion 102. In addition, the seal 614 engages (or contacts) a portion of the center mullion 102, and more specifically one of the sidewalls 166. When the door 50 is transitioned to an open position (or an open configuration), the door 50 moves relative to the center mullion 102 to disengage the non-compressible contact relationship of the gaskets 490, 550, disengage the magnetized coupling of the first and second attachment elements 566, 602, and disengage the seal portion 614 from engagement with the center mullion 102.

Figure 31:
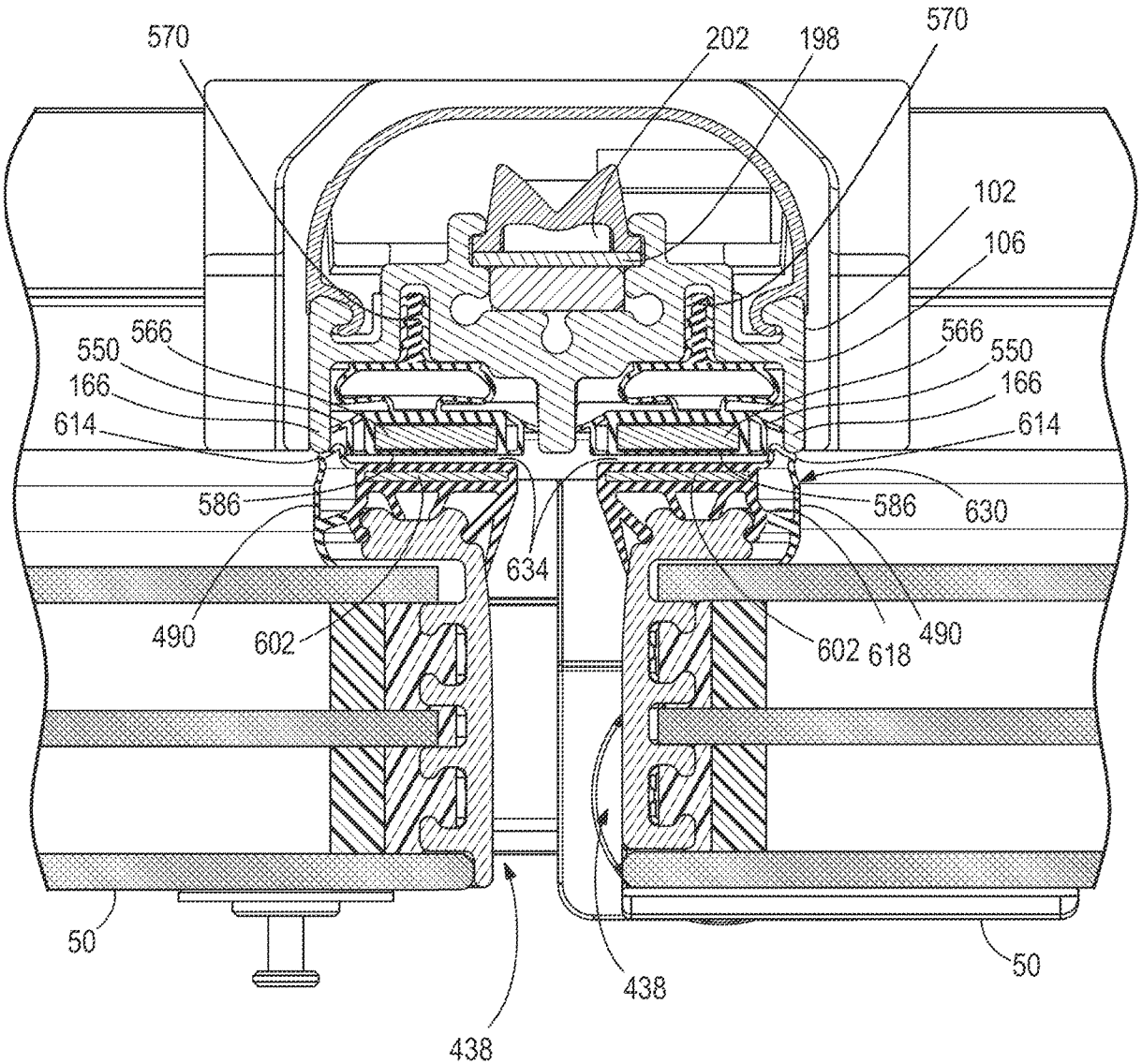
FIG. 31 is a cross-sectional view similar to FIG. 30 and illustrating another seal assembly between the doors and the center mullion with the first and second portions of the seal assembly in a non-contact relationship.

FIG. 31 illustrates another embodiment of the seal assembly 630. For ease of understanding, like components will be identified with like reference numerals. When the fastener 570 is inserted into the cavity 174 (see FIGS. 12-13), the gasket 550 is received by (e.g., nested in) the center mullion 102. When nested in the center mullion 102, an exterior-facing surface 586 of the gasket 550 is generally aligned with an outermost extent of the center mullion 102. For example, in the illustrated embodiment, the outermost extent of the center mullion 102 is defined by ends of the sidewalls 166 that are disposed opposite the support surface 162 (shown in FIGS. 12-13). In this arrangement, the first and second gaskets 490, 550 are oriented or positioned in a non-contact relationship with each other. The first attachment element 566 and the second attachment element 602 are spaced apart from each other by a gap 634 (i.e., are in non-contact relationship with each other), but cooperate, via magnetic attraction, to form a magnetized coupling that maintains the door 50 in a closed position in relation to the center mullion 102. Stated another way, the chamber 618, the gap 634, and the seal 614 cooperate to limit infiltration of ambient air (or air from the environment surrounding the merchandiser 10) into the product display area 54. When the door 50 is transitioned into an open position (or an open configuration), the door 50 moves relative to the center mullion 102 to disengage the non-contact, facing relationship of the gaskets 490, 550 (and the attachment elements 566, 602), and to disengage the seal portion 614 from engagement with the center mullion 102.

With reference back to FIG. 7, a door close mechanism or a door close assembly 638 is mounted between the case frame 46 and the door 50 to facilitate movement of the door 50 between a closed position and an open position. The door close assembly 638 is mounted to the top frame member 90 by one or more fasteners or other securement members 642 (e.g., a bolt, a screw, or any other member suitable to secure the assembly 638 to the frame member 86). The door close assembly 638 is configured to respond to a closing force of the door 50 to maintain a substantially constant door close force, which may also be referred to as a "soft closure" of the door 50.

Figure 32:
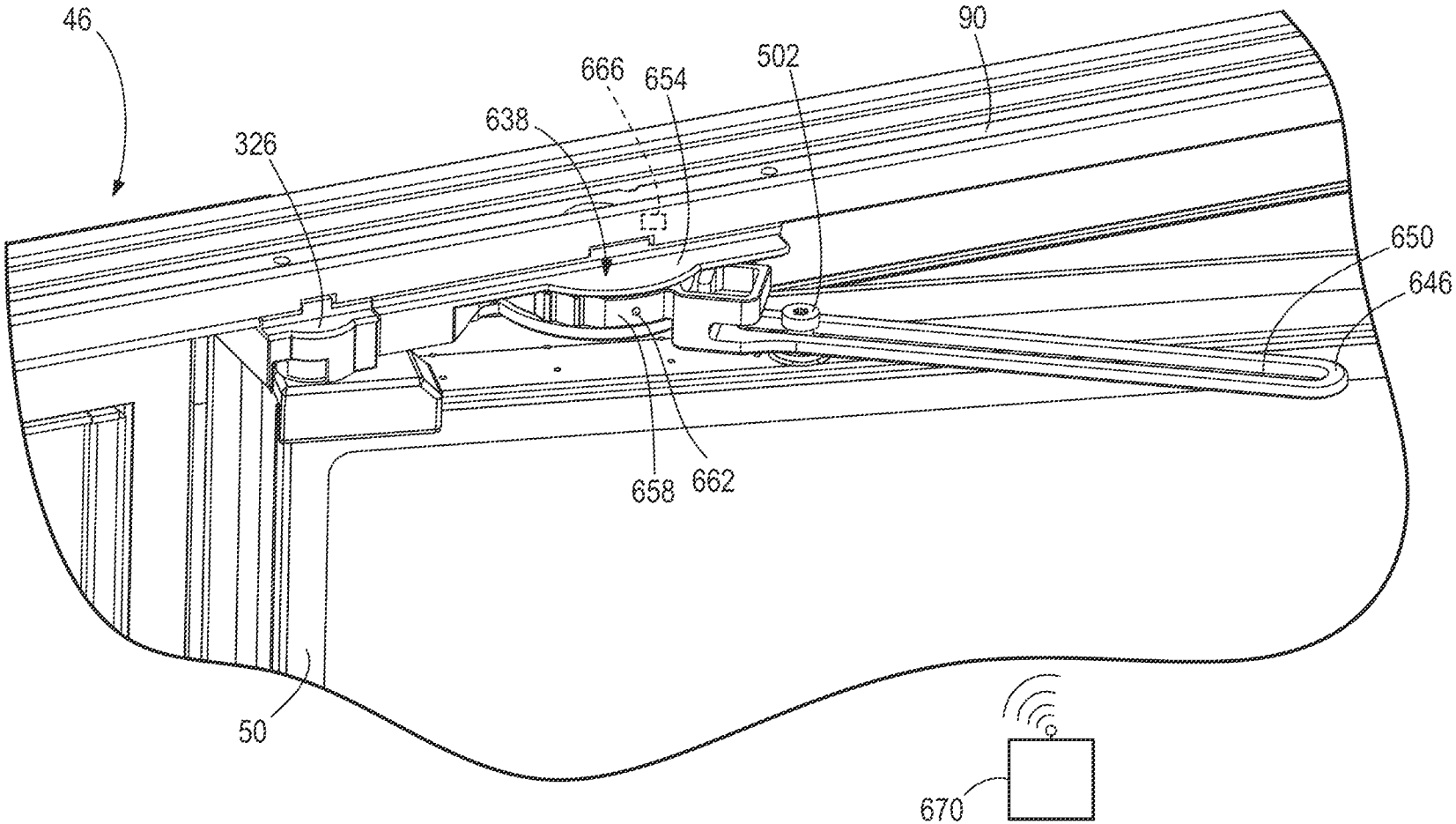
FIG. 32 is a perspective view of a door close assembly that is mounted to the case frame and engaged with one door that is shown in a partially open configuration.

Referring now to FIG. 32, the door close assembly 638 is mounted to the case frame 46 and is engaged with the door 50. The door close assembly 638 includes an elongated arm 646 that defines a channel 650. The channel 650 is configured to receive the door closure guide mount 502, which couples the elongated arm 646 to the door 50. As the door 50 opens or closes, the guide mount 502 slides within or moves within the channel 650. The door close assembly 638 also includes a base plate 654 that is attached to the top frame member 90, and a housing 658 (e.g., see FIG. 17) that is coupled to the base plate 654.

Figure 42:
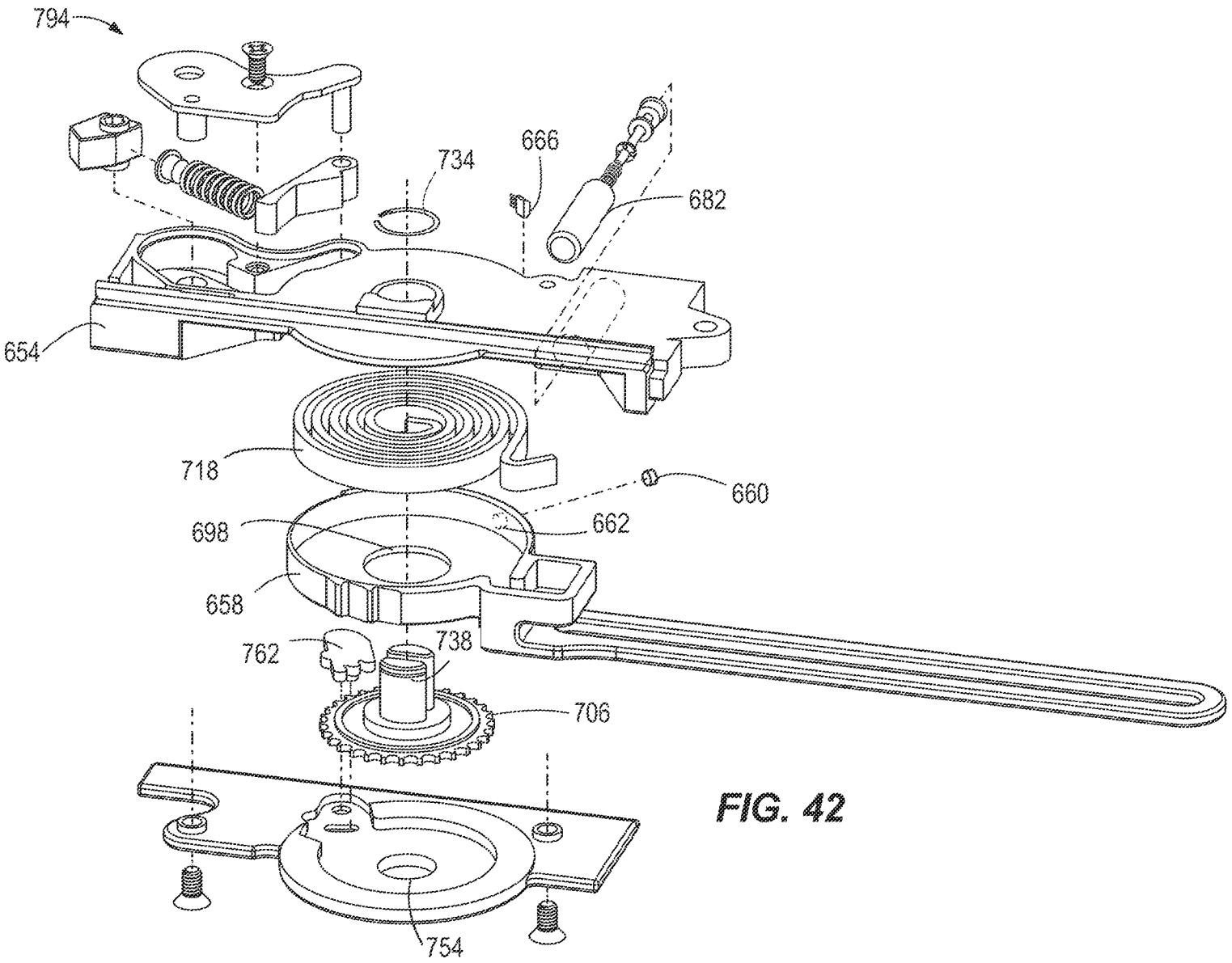
FIG. 42 is an exploded view of the door close assembly of FIG. 34, viewed from the top and illustrating the tension adjustment assembly of FIG. 40.
Figure 43:
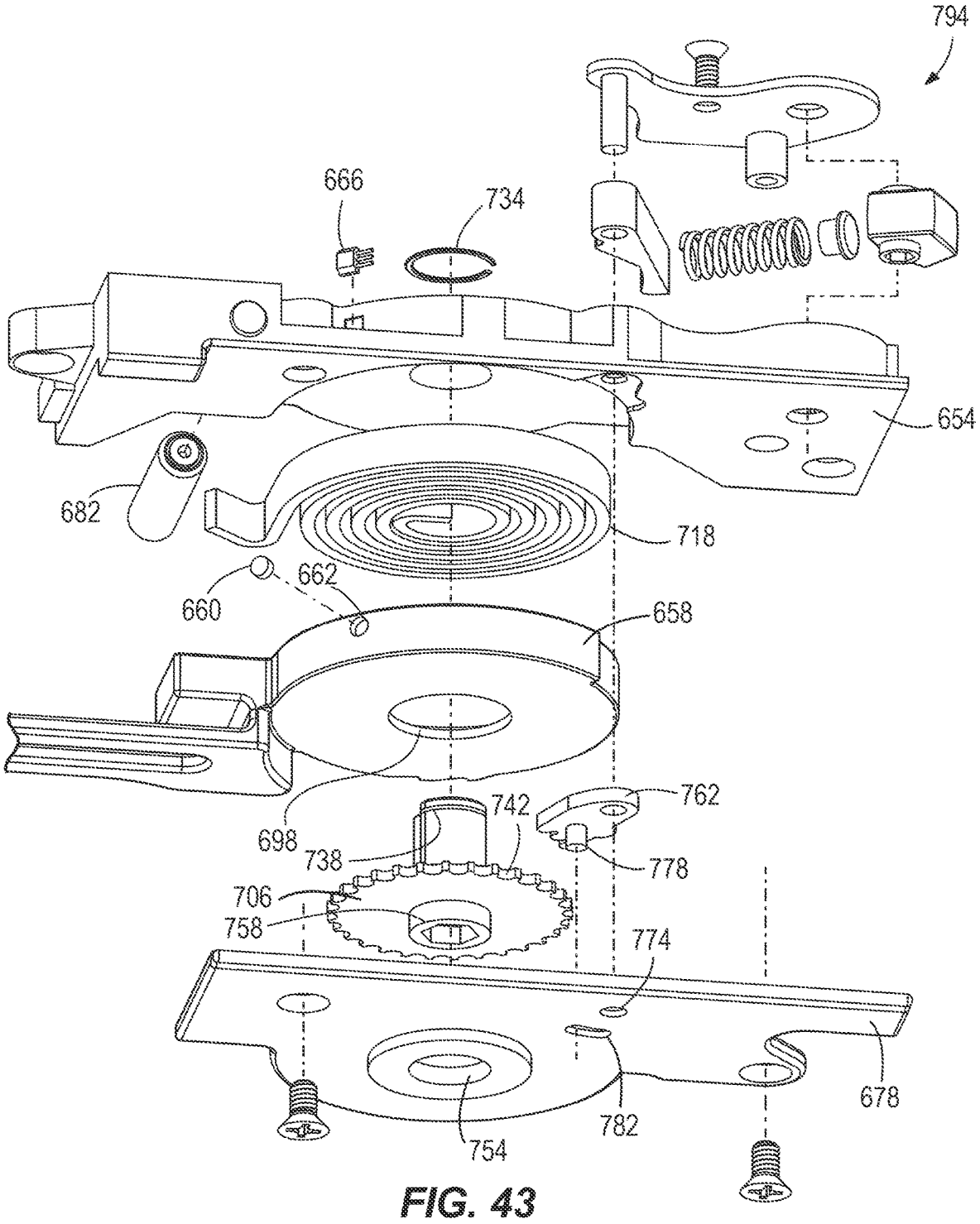
FIG. 43 is an exploded view of the door close assembly of FIG. 34, viewed from the bottom and illustrating the tension adjustment assembly of FIG. 40.

With reference to FIGS. 42 and 43, the housing 658 can include an aperture 662 that carries (or receives) a magnet 660. The aperture 662 is positioned in (or defined by) the housing 658. The magnet 660 is configured to rotate with the housing 658 about the base plate 654 as the door 50 opens and closes. A sensor 666 (e.g., a Halifax sensor, etc.) can be positioned in the case frame 46 and placed in communication with the magnet 660 to detect a position of the door 50 (e.g., open, closed, and/or position(s) between completely open and closed, etc.). The sensor 666 is shown disposed on the case frame 46, and more specifically the top frame member 90, but the sensor 666 can be located in (or on) a portion of the door close assembly 638. For example, as illustrated in FIGS. 42-43, the sensor 666 is disposed on a portion of the base plate 654. In other embodiments, the sensor 666 can be disposed or otherwise attached to any other portion of the merchandiser 10 that is suitable for determining a position or orientation of the door 50.

As shown in FIG. 32, the sensor 666 is in communication with a controller 670 to communicate the position or orientation of the door 50. While the operable communication is illustrated as a wireless connection, communication can be by any suitable connection (e.g., by a wired connection, etc.). The controller 670 can be positioned on (or in) the merchandiser 10, or remote from the merchandiser 10. Also, the controller 670 can be configured to control heat that may be applied to one or more of the glass panels 506, 510, 514 of the door 50 (shown in FIG. 27). For example, heat can be transmitted to a conductive coating on one or more of the glass panels 506, 510, 514 in response to the signal from the sensor 666 regarding the position of the door 50 (e.g., an open position, partially open position, closed position, etc.). The controller is configured to cycle the heat between on and off, and/or cycle heat between different glass panels 506, 510, 514, based on the position of the door 50 as detected by the sensor 666. The application of heat to one or more of the glass panels 506, 510, 514 is discussed in additional detail below.

Figure 33:
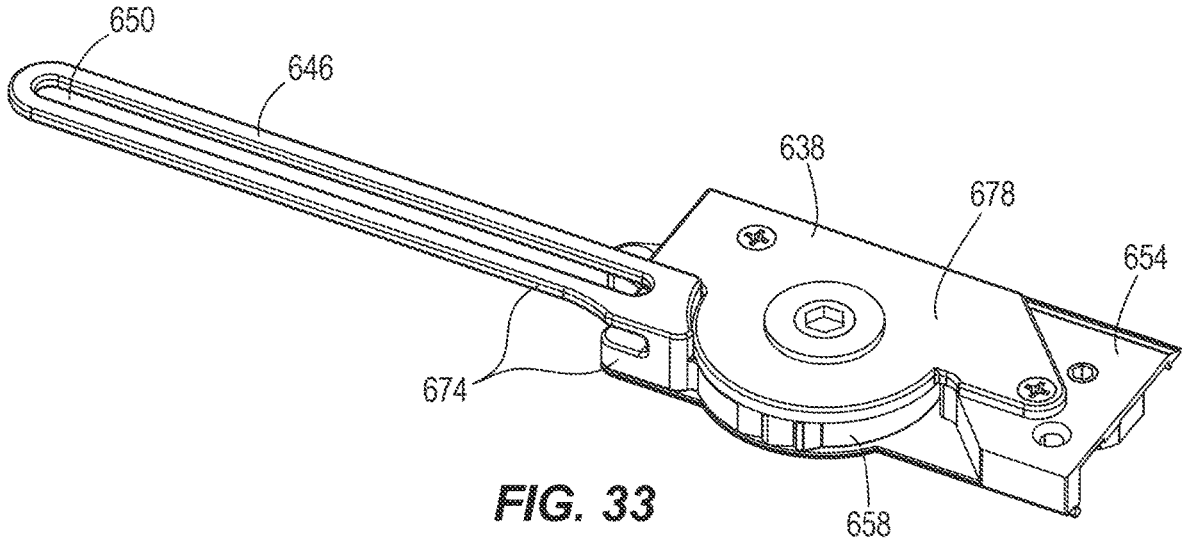
FIG. 33 is a perspective view of a first (lower) side of the door close assembly of FIG. 32.
Figure 34:
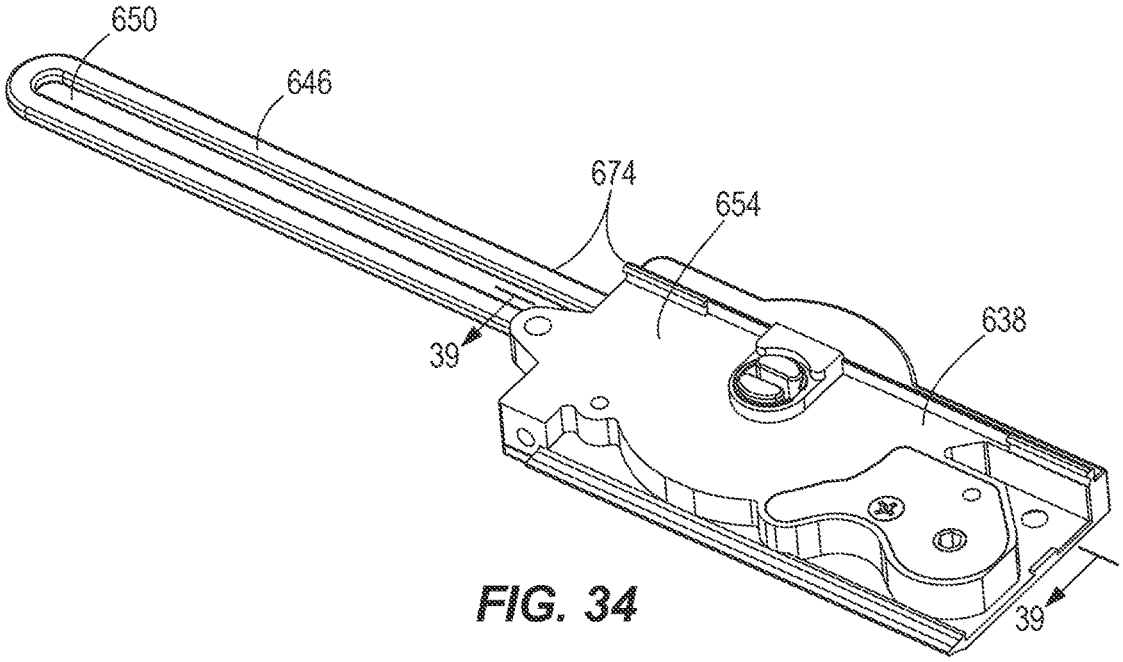
FIG. 34 is a perspective view of a second (upper) side of the door close assembly of FIG. 33.

FIGS. 33 and 34 illustrate the door close assembly 638 with the elongated arm 646, the base plate 654, and the housing 658 formed as a monolithic element 674. A cover plate 678 (shown in FIG. 33) is coupled to the base plate 654 to retain the housing 658 in engagement with the base plate 654 (e.g., sandwiched between the base plate 654 and the cover plate 678). As described in detail below, the housing 658 is configured to rotate independent of the base plate 654 and the cover plate 678 in response to movement of the elongated arm 646 caused by opening or closing of the door 50.

Figure 35:
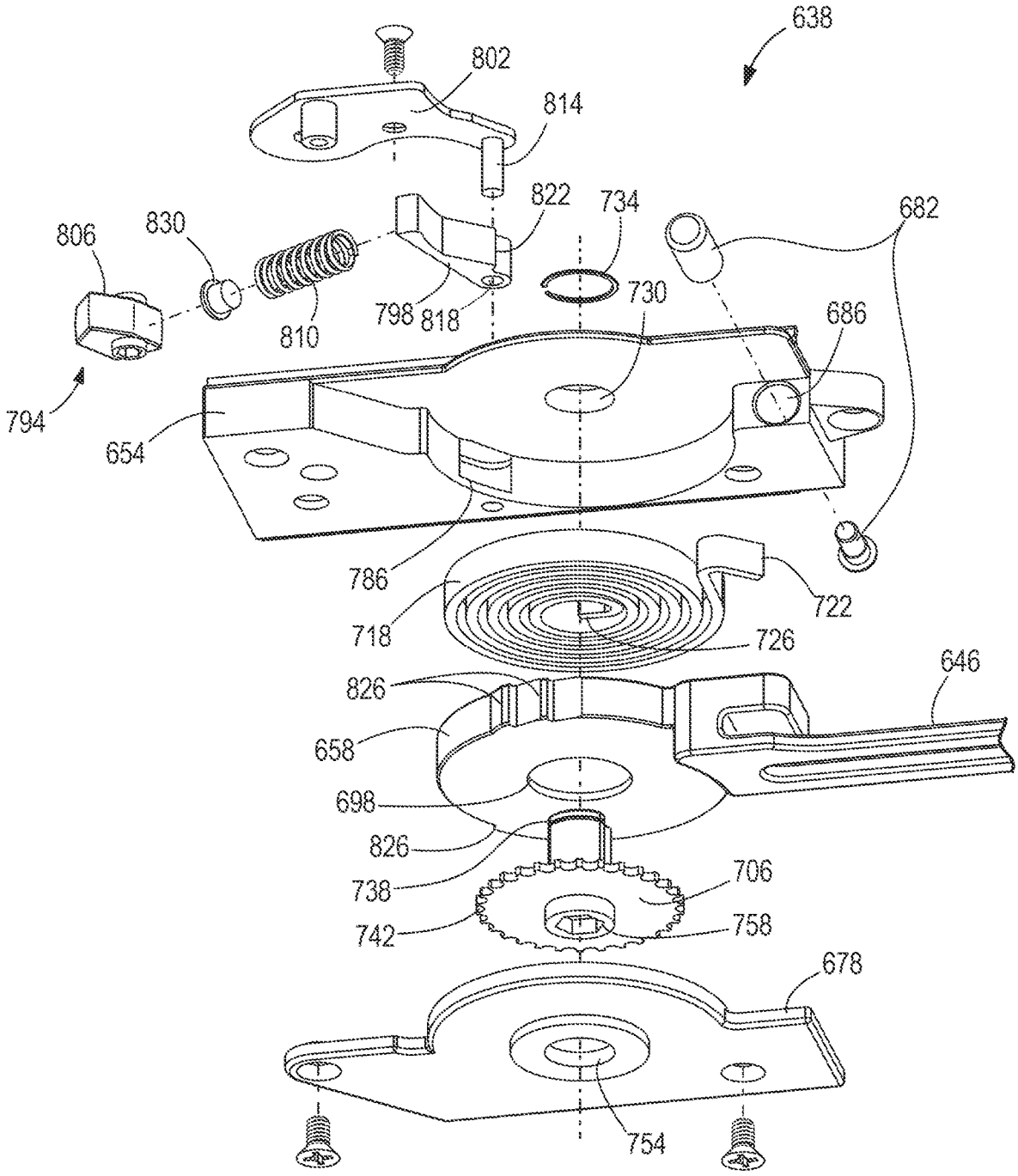
FIG. 35 is an exploded view of the door close assembly of FIG. 34, viewed from the bottom and illustrating an exemplary tension adjustment assembly.
Figure 36:
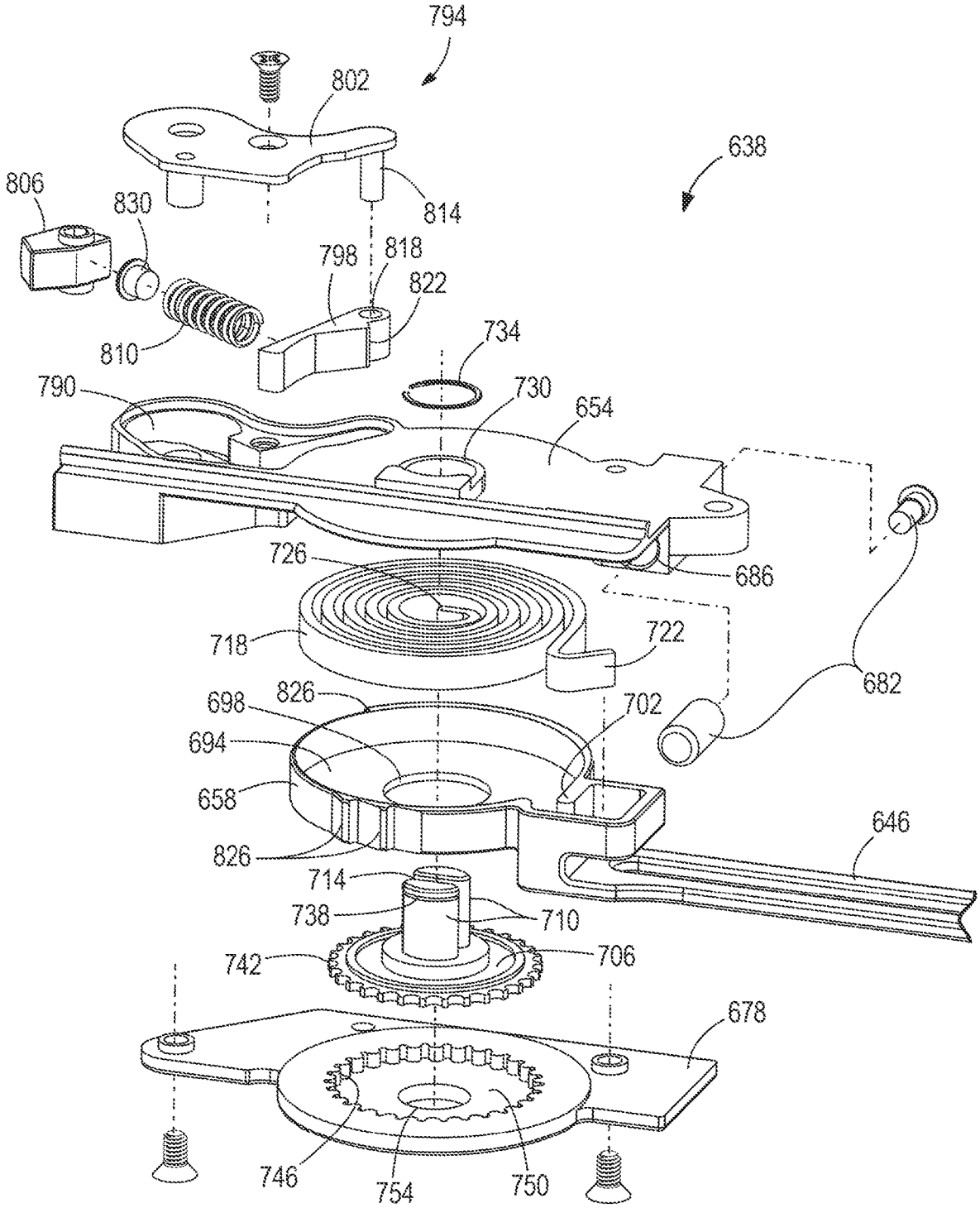
FIG. 36 is another exploded view of the door close mechanism of FIG. 34, viewed from the top and illustrating the tension adjustment assembly.
Figure 37:
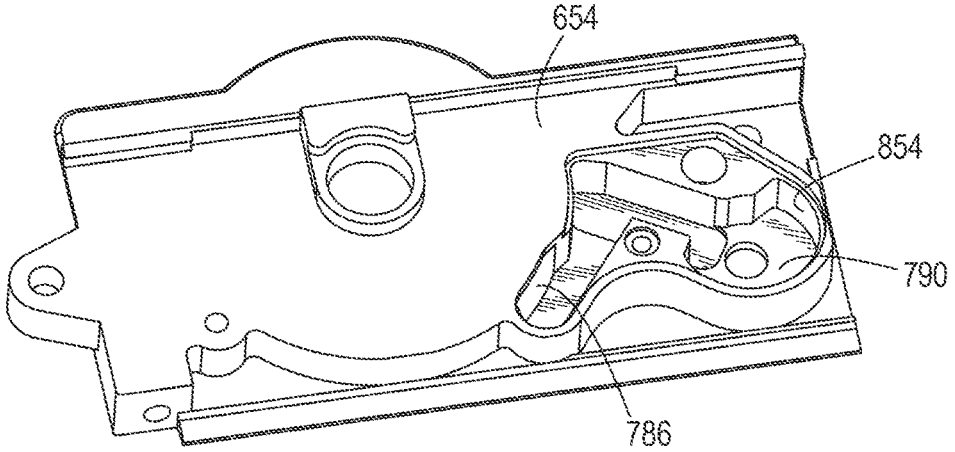
FIG. 37 is a perspective view of a first side of a base plate of the door close assembly of FIG. 34.
Figure 38:
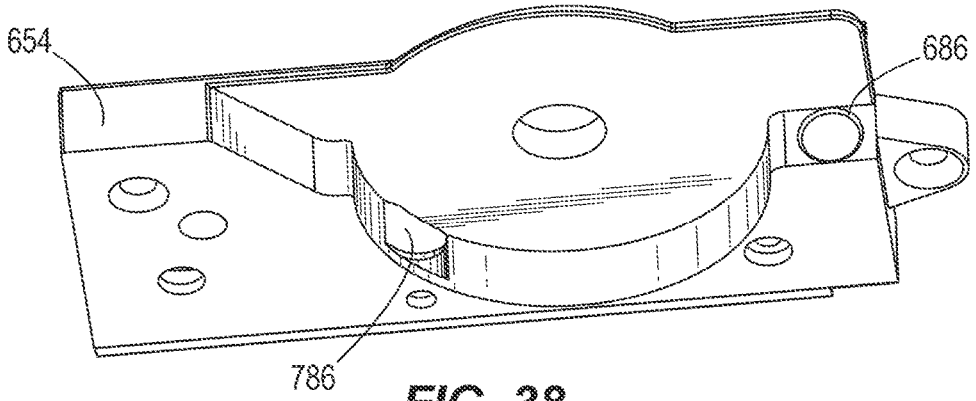
FIG. 38 is a perspective view of a second, opposite side of the base plate of FIG. 37.
Figure 44:
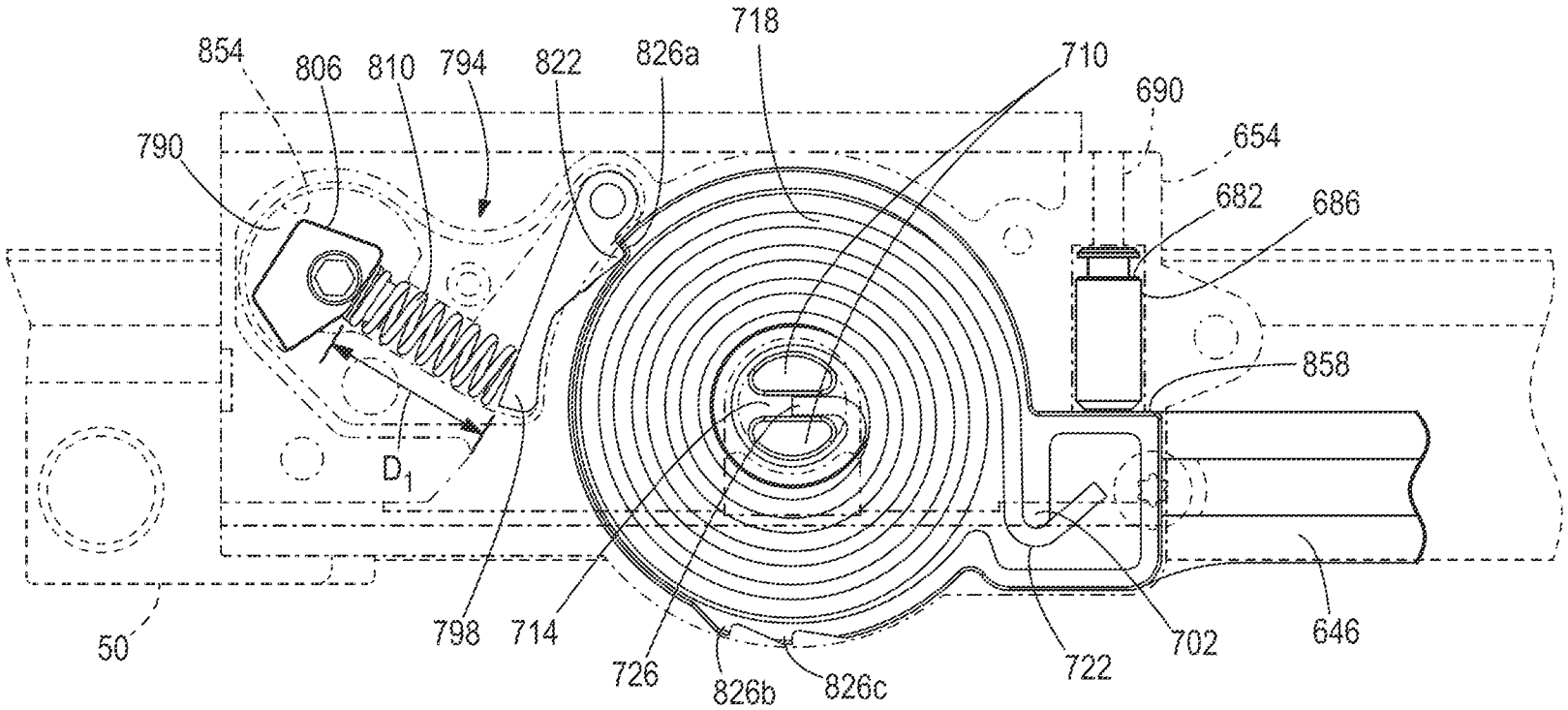
FIG. 44 is a top view of the door close assembly of FIG. 34 with the base plate and a portion of the door shown in broken lines, to illustrate a door hold-open mechanism and a soft door close. An adjustable cam of the door hold-open mechanism is shown in a first position and the door close assembly when the door is in a closed position.

FIGS. 35 and 36 show that the door close assembly 638 includes a biased plunger 682 that is disposed in (e.g., received by) a hole 686 that is defined in the base plate 654. As illustrated in FIG. 44, the hole 686 is a countersunk hole 686 that is connected or fluidly connected to a vent hole 690. The vent hole 690 extends through the base plate 654 and allows air pressure formed by actuation of the biased plunger 682 to escape from or through the vent hole 690.

Figure 39:
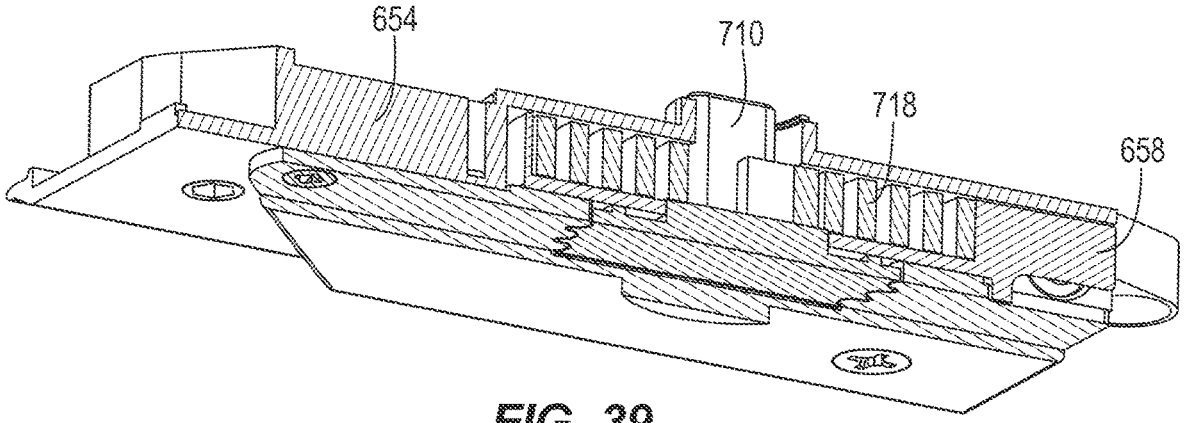
FIG. 39 is a cross-sectional view of the door close assembly of FIG. 34 taken along line 39-39 of FIG. 34.

With reference back to FIG. 36, the housing 658 defines a recessed area 694 and an aperture or hole 698 that extends through the recessed area 694. The housing 658 also defines a projection 702 that forms a portion of a sidewall of the recessed area 694. At least a portion of a tension adjustment mechanism 706 (or tension adjustment member 706) is received by the aperture 698. The portion includes opposite or symmetrical or mirrored members 710 that define a slot 714 between the opposite members 710. A spiral spring 718 (or biasing member 718) is supported by the base plate 654 and is carried in the recessed area 694. The spring 718 includes a first end 722 that is opposite a second end 726. The first end 722 is curved or bent to wrap around a portion of the projection 702 (caught or captured by the projection 702), while the second end 726 is coupled to the tension adjustment mechanism 706 within the slot 714 between the members 710. By engaging the ends 722, 726 of the spring 718, the projection 702 and the slot 714 provide adjustment of the tension applied by the spring 718 (increased tension by constricting the spring 718 or decreased tension by releasing the spring 718). After the tension adjustment mechanism 706 is received by the aperture 698 and is coupled to the spring 718, the opposite members 710 extend through (or are received by) a second aperture 730 in the base plate 654. As shown in FIG. 39, a retention member 734 engages an annular channel 738 positioned around the members 710 to assist with retaining the tension adjustment mechanism 706 in the baseplate 654.

With continued reference to FIGS. 35-36, the tension adjustment mechanism 706 includes a gear 742 that engages a corresponding second gear 746 (shown in FIG. 36) defined in a recess 750 of the cover plate 678. An aperture 754 in the cover plate 678 provides access to a head 758 (shown in FIG. 35) on the tension adjustment mechanism 706 that is keyed to receive a tool (e.g., an Allen wrench, a screwdriver, etc.). By inserting the tool into engagement with the head 758, and subsequently applying a force on the tension adjustment mechanism 706 toward the spring 718 (upward as viewed in the FIGURES), the gears 742, 746 disengage. Once disengaged, the tension adjustment mechanism 706 can be rotated with relative to the base plate 654, the housing 658, and the cover plate 678 to adjust a tension of the spring 718. After the desired tension is achieved, the force on the tension adjustment mechanism 706 is removed to re-engage the gears 742, 746 to maintain the selected tension.

Figure 40:
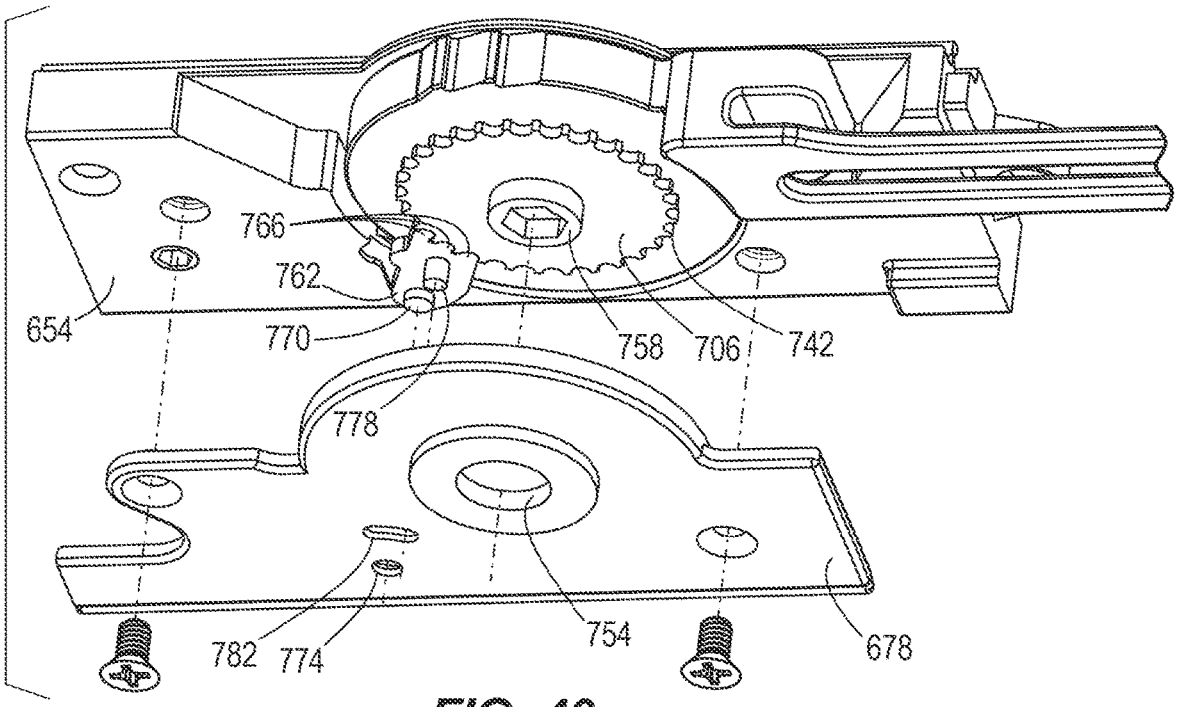
FIG. 40 is a partially exploded view of the door close assembly of FIG. 34, viewed from the bottom and illustrating another exemplary tension adjustment assembly.
Figure 41:
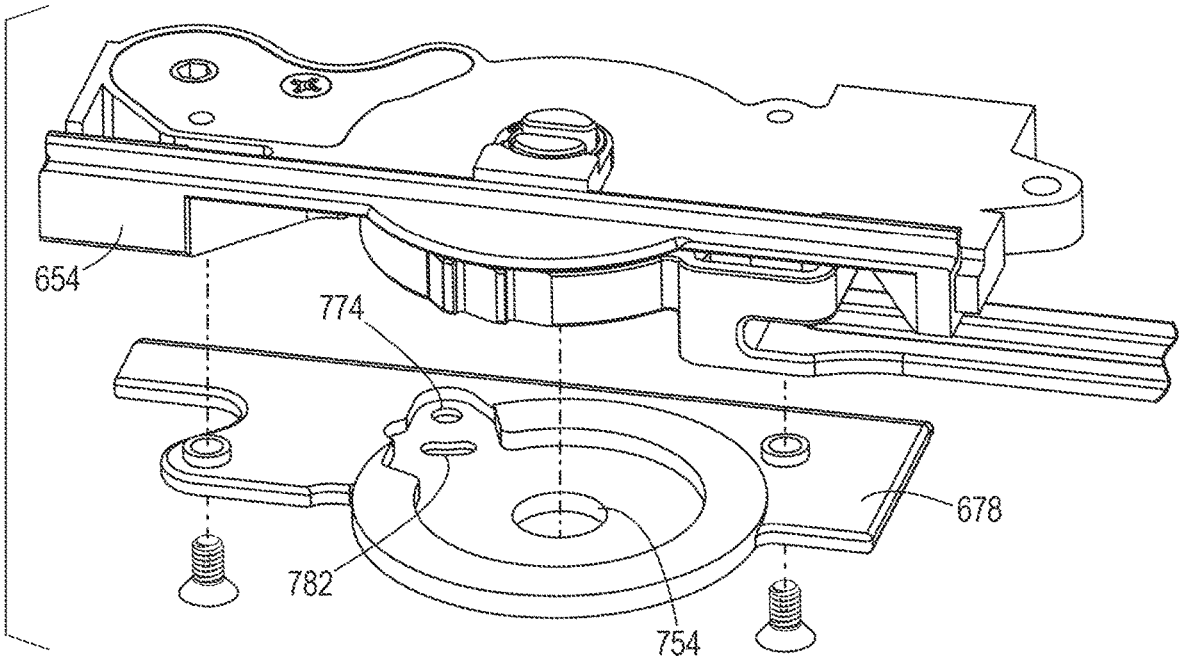
FIG. 41 is another partially exploded view of the door close assembly of FIG. 34, viewed from the top and illustrating the tension adjustment assembly of FIG. 40.

FIGS. 40-43 illustrate another exemplary tension adjustment mechanism 706 that adjusts the tension of the spring 718. For ease of understanding, like components will be identified with the same reference numerals. As shown in FIGS. 40-43, the cover plate 678 is provided without a gear or teeth, and the tension adjustment mechanism 706 can be adjusted via a lever 762. Referring to FIG. 40, the lever 762 is pivotably coupled to the base plate 654 and the cover plate 678. The lever 762 includes a plurality of fingers 766 that selectively mesh with a plurality of teeth of the gear 742 of the tension adjustment mechanism 706. The lever 762 is biased (or mechanically linked) into engagement with the tension adjustment mechanism 706. The fingers 766 are positioned to allow for rotation of the tension adjustment mechanism 706 in a first direction to increase the tension of the spring 718 (shown in FIGS. 42-43), and to restrict rotation of the tension adjustment mechanism 706 in an opposite, second direction to maintain tension applied by the spring 718. For example, the lever 762 can have teeth that are angled to engage the adjustment mechanism 706 so that rotation in one direction is permitted while rotation in the other direction is restricted. To release or reduce the tension applied by the spring 718, the lever 762 is pivoted out of engagement from the gear 742 to allow the tension adjustment mechanism 706 to rotate in the second direction. To facilitate the pivoting functionality of the lever 762, the lever 762 includes a pivot member 770 that defines a pivot axis.

The pivot member 770 is received by a pivot aperture 774 that is defined by the cover plate 678. The pivot aperture 774 is sized to facilitate rotation of the lever 762 about the axis defined by the pivot member 770. The lever 762 also includes an adjustment member 778 that extends from the lever 762. The adjustment member 778 is offset from and is positioned approximately parallel to the pivot member 770. The adjustment member 778 is received by a slot 782 that is defined by the cover plate 678. The slot 782 is generally curved or arcuate, to allow the adjustment member 778 to slide or move within the slot 782. The adjustment member 778 has a longer length than the pivot member 770, such that a portion of the adjustment member 778 extends through the slot 782. A biasing member (not shown) can be positioned in the base plate 654 to bias the lever 762 into engagement with the gear 742 of the tension adjustment mechanism 706.

Referring generally to FIGS. 40-43, to increase the tension of the spring 718 (shown in FIGS. 42 and 43), a tool (e.g., an Allen wrench, a screwdriver, etc.) is inserted into the aperture 754 in the cover plate 678, and is engaged with the head 758 (shown in FIGS. 40 and 43) of the tension adjustment mechanism 706. Upon engagement with the head 758, rotation of the tool in the first direction rotates the tension adjustment mechanism 706 in the first direction (e.g., counter-clockwise in the illustrated embodiment), which increases tension applied by the spring 718. Rotation of the adjustment mechanism 706 in the first direction overcomes the bias (or holding force) applied to the lever 762, allowing the gear 742 to rotate into and out of engagement with the fingers 766 (i.e. relative to the fingers 766). When the desired tension is achieved, the bias (or holding force) applied to the lever 762 maintains the position of the tension adjustment mechanism 706 (i.e. restricts the tension adjustment mechanism 706 from rotating in the second direction) to maintain the tension applied by the spring 718.

To decrease or release the tension applied by the spring 718, the lever 762 is pivoted out of engagement with the tension adjustment mechanism 706. A force sufficient to overcome the bias (or holding force) of the lever 762 is applied to the adjustment member 778, which slides the adjustment member 778 from a first end of the slot 782 to an opposite, second end of the slot 782. As the adjustment member 778 slides within the slot 782, the lever 762 pivots about the pivot axis defined by the pivot member 770 to disengage the fingers 766 from the gear 742. With the lever 762 positioned out of engagement with the gear 742, the tension adjustment mechanism 706 is free to rotate in the second direction (e.g., clockwise in the illustrated embodiment) to release the tension applied by the spring 718. When the desired tension is released, the force applied to the adjustment member 778 is released, and the bias (or holding force) on the lever 762 reengages the fingers 766 with the gear 742 to restrict rotation (or further rotation) of the tension adjustment mechanism 706 in the second direction.

Figure 46:
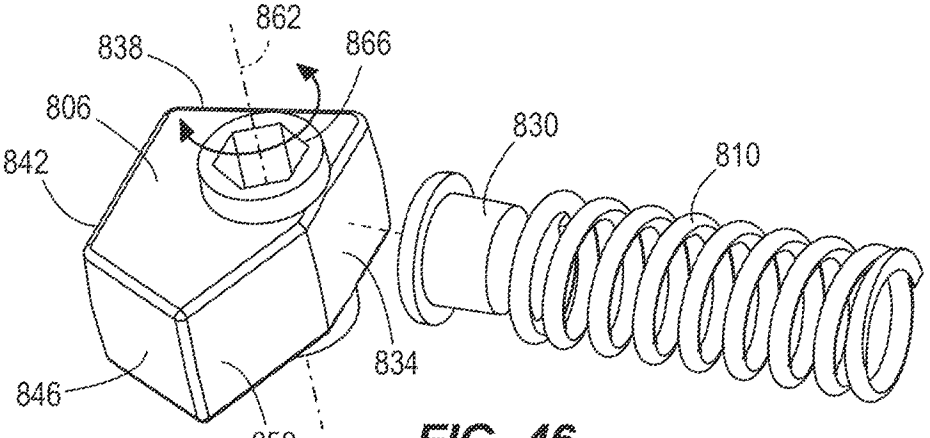
FIG. 46 is an exploded view of the door hold-open mechanism including the adjustable cam, a spring, and a member that interfaces between the cam and the spring.

Referring to FIGS. 35-38, the base plate 654 can define a window or opening 786 (shown in FIGS. 35, 37, and 38) that connects a pocket or recess 790 (shown in FIGS. 36-37) defined in the base plate 654 to the portion of the base plate 654 that engages the housing 658. With reference to FIGS. 35 and 36, the assembly includes a door hold-open mechanism 794 (or door hold-open assembly 794) that is disposed in the recess 790 (shown in FIG. 36). The door hold-open mechanism 794 includes a lever 798 that is pivotally connected to a housing or cover plate 802. A cam 806 is spaced from the lever 798, and is rotatably connected to the base plate 654 and the cover plate 802. A spring 810 (or biasing member 810) is disposed between and engaged with the lever 798 and the cam 806. The housing or cover plate 802 connects the door hold-open mechanism 794 to the base plate 654. For example, a member or leg 814 of the cover plate 802 can be received by an aperture 818 in the lever 798. The leg 814 can couple to (or otherwise engage) the base plate 654 to pivotally trap the lever 798. More specifically, the lever 798 is configured to pivot with respect to the leg 814 (and thus pivot with respect to the cover plate 802). The lever 798 carries a protrusion 822. The protrusion 822 is configured to extend through the window 786 (shown in FIG. 35) to engage one or more stops 826 (or projections 826) disposed on an outer surface of the housing 658 to hold the door 50 open in different open positions. The spring 810 is coupled to the lever 798 and the cam 806. The spring 810 can receives a member 830 that provides an interface between the spring 810 and the cam 806. The spring 810 induces a force on the lever 798 based on the position of the cam 806 such that the lever 798 can be biased into engagement with each stop 826. The cam 806 is defined by a polygonal-shaped body that has a plurality of cam surfaces. As illustrated in FIG. 46, the cam 806 includes a first cam surface 834, a second cam surface 838, a third cam surface 842, a fourth cam surface 846, and a fifth surface 850. Rotation of the cam 806 changes the cam surface that contacts a wall 854 (shown in FIGS. 37 and 44) of the recess 790 and the member 830 to adjust the tension of the spring 810, and in turn the hold-open force applied on the door 50.

FIGS. 44, 45, 47, and 48 illustrate the door hold-open mechanism 794 and the soft door close in operation. Referring to FIG. 44, the door 50 is in a closed position. The cam 806 is in a first position in which a first surface 834 (shown in FIG. 46) of the cam 806 engages the member 830, while a fifth surface 850 (shown in FIG. 46) engage a wall 854 of the recess 790. The cam 806 applies a biasing force to the lever 798 by the spring 810. The force biases the protrusion 822 through the window 786 (shown in FIGS. 37-38) and into engagement with a first stop **826*a*, which corresponds to the door closed position. In this position, the plunger 682 is also compressed and in engagement with a surface 858 of the arm 646**.

Figure 45:
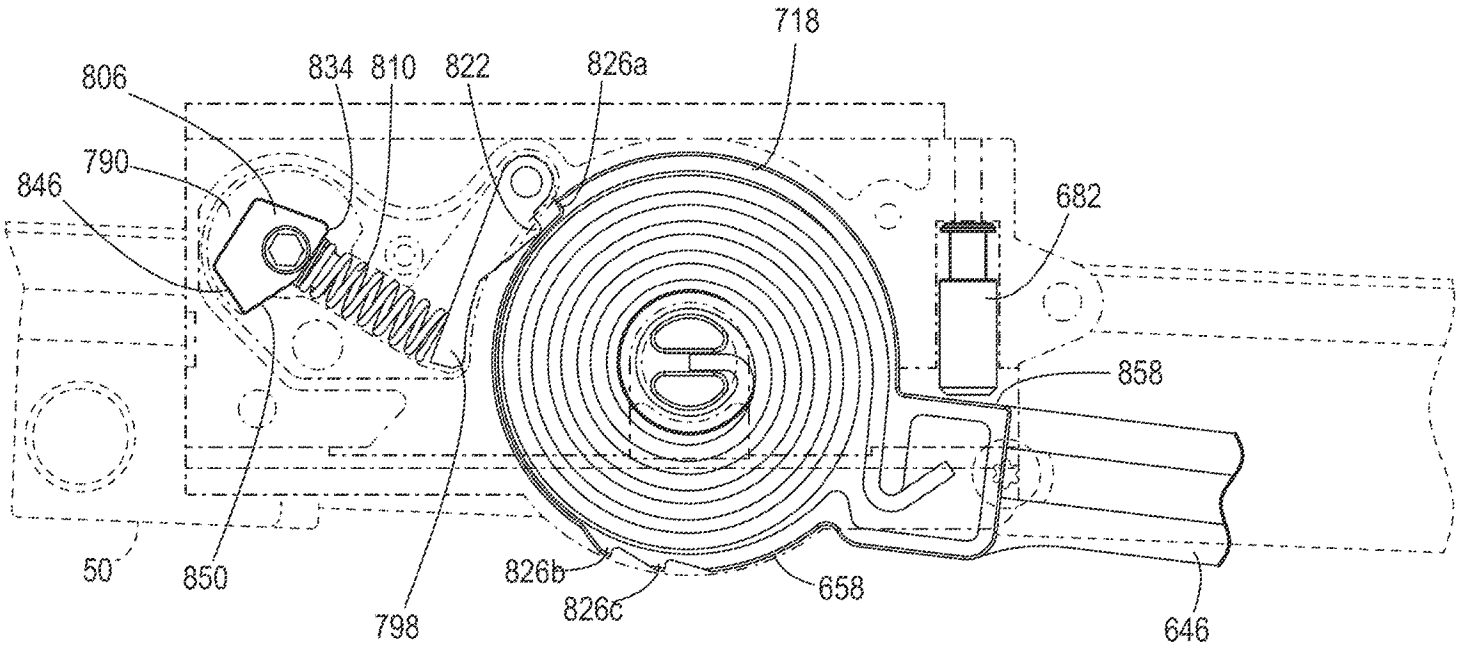
FIG. 45 is a top view of the door close mechanism of FIG. 44, illustrating the assembly when the door is rotated to a partially open position.

FIG. 45 illustrates the door 50 in a partially open position, and the cam 806 is in a first position such that the first surface 834 is engaged with the spring 810 to increase the force applied on the lever 798 by compressing the spring 810. The surface 858 is no longer in engagement with the plunger 682. As such, the plunger 682 is no longer compressed, and instead extends outward (e.g., is biased outward) toward the arm 646. The plunger 682 can be biased outward by a biasing member, hydraulics, air or any suitable bias assembly. As the door 50 rotates open, the first stop **826*a* rotates out of engagement with and separates from the protrusion 822. It should be appreciated that the partially open position illustrated in FIG. 45 can occur during the opening or closing of the door 50**.

To change the cam surface 834, 838, 842, 846, 850 that engages with the spring 810 and the wall 854 of the recess 790, the cam 806 can be rotated within the recess or pocket 790 about an axis 862 (shown in FIG. 46). To facilitate rotation, the cam 806 includes a head 866 (shown in FIG. 46) that is keyed to receive a tool (e.g., an Allen wrench, a screwdriver, etc.). By inserting the tool into engagement with the head 866, and subsequently rotating the tool clockwise or counter-clockwise, the cam 806 rotates within the recess 790 to engage a different cam surface 834, 838, 842, 846, 850 with the spring 810 and the wall 854 to adjust the force or tension applied on the lever 798 (shown in FIG. 44) by the spring 810. As a distance between the selected cam surface 834, 838, 842, 846, 850 and the lever 798 decreases, more force is applied on the lever 798 by the spring 810 due to compression of the spring 810. As the distance between the selected cam surface 834, 838, 842, 846, 850 and the lever 798 increases, less force is applied on the lever 798 by the spring 810. More specifically, a distance D between the lever 798 and the cam 806 changes depending on the cam surface 834, 838, 842, 846, 850 that engages with the spring 810. As illustrated in FIG. 44, the lever 798 is positioned a first distance $D_1$ away from the cam 806. The first distance $D_1$ is greater than a second distance $D_2$ (shown in FIG. 47), and the first and second distances $D_1$, $D_2$ are both greater than a third distance $D_3$ (shown in FIG. 48). As the distance D between the lever 798 and the cam 806 decreases (from $D_1$ to $D_3$), the tension applied on the lever 798 by the spring 810 increases. Increasing the tension applied to the lever 798 applies greater force to hold the door 50 open. Stated another way, the additional force applied to hold open the door 50 comes from more compression of the spring 810.

Figure 47:
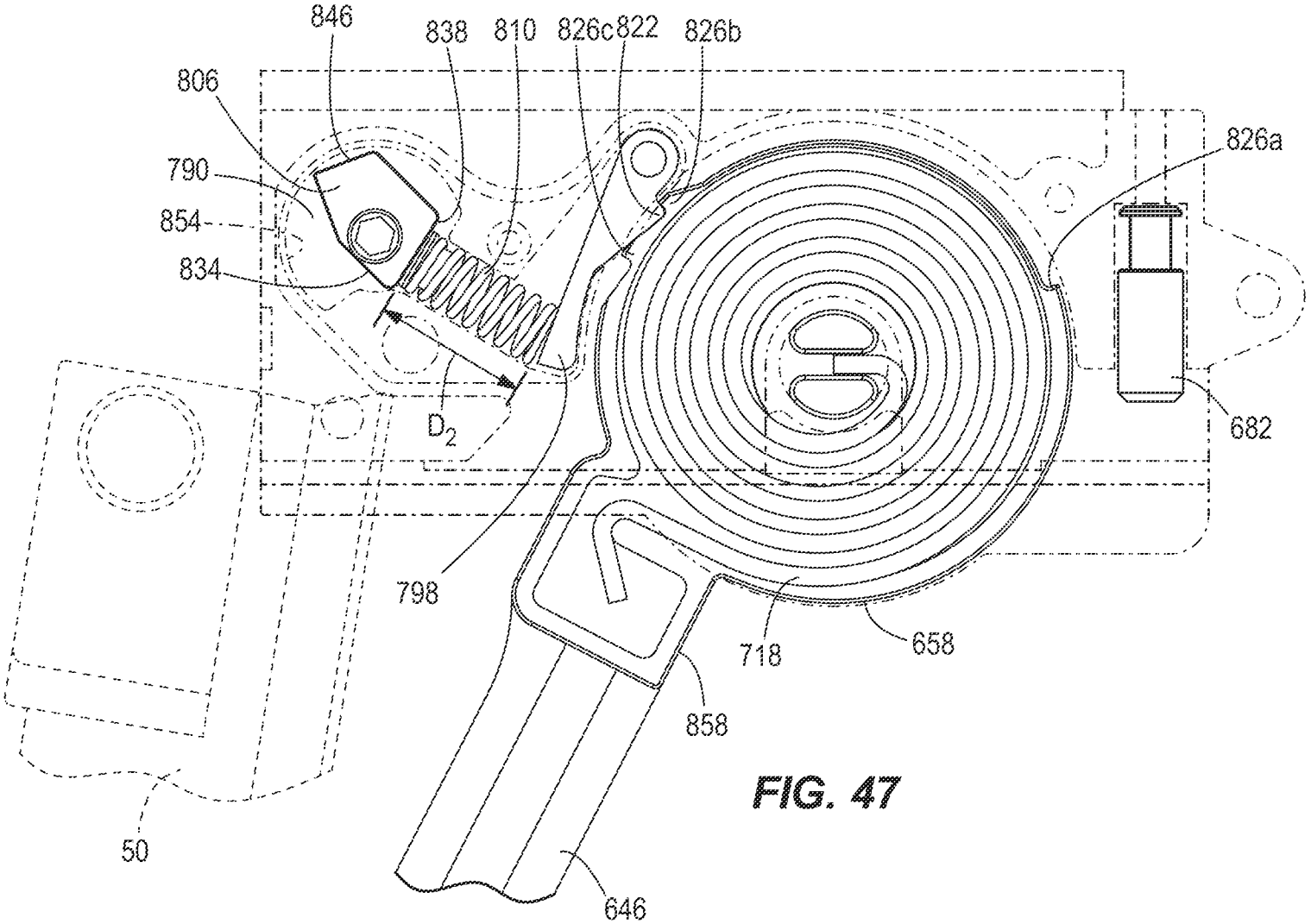
FIG. 47 is a top view of the door close mechanism of FIG. 44, illustrating the assembly when the door is rotated to a second, partially open position, and separately illustrating the cam adjusted to a second position to increase the force applied by the spring to hold the door in the open position.

FIG. 47 illustrates the door 50 in an open position. In addition, and unrelated to the opening or closing of the door 50, the cam 806 has been rotated to a second position such that the second surface 838 is engaged with the spring 810 to increase the force applied on the lever 798 by compressing the spring 810. More specifically, the cam 806 has been rotated such that the second surface 838 of the cam 806 is in engagement with the spring 810, and the fourth surface 846 of the cam 806 is in engagement with the wall 854 of the recess 790. This position shortens the distance D (to $D_2$) and increases the force applied by the spring 810 on the lever 798 relative to the force applied when the first surface 834 is engaged with the spring 810. The door 50 is in a first hold-open position in which the protrusion 822 is engaged with a second stop 826*b* to hold the door 50 open. To overcome the door hold-open force, a user applies a closing force to the door 50 that exceeds the hold-open force being applied by the spring 810. In doing so, the housing 658 rotates counter-clockwise as viewed in FIG. 47. As the housing 658 rotates, the second stop 826*b* applies a force to the protrusion 822 causing the lever 798 to pivot, compressing the spring 810. The lever 798 pivots until the protrusion 822 is withdrawn from the window 786 (see FIG. 35), or otherwise is received within the recess 790 such that the second stop 826*b* is no longer in engagement with the protrusion 822. The second stop 826*b* is no longer obstructed (by the protrusion 822 on the lever 798), and the housing 658 is free to rotate. Once the housing 658 is free to rotate, the spring 718 uncoils, further rotating the housing 658 toward the closed position. Once the door 50 reaches the position illustrated in FIG. 45, the spring 718 and the plunger 682 cooperate to maintain the substantially constant door close force (i.e., the soft door closure). As the door 50 closes, the soft door closure activates when the surface 858 of the arm 646 contacts the extended plunger 682. Once in contact, the plunger 682 slowly compresses (compare FIG. 45 to FIG. 44), slowing closure of the door 50. The plunger 682 and the spring 718 cooperatively maintain a substantially constant door close force.

Figure 48:
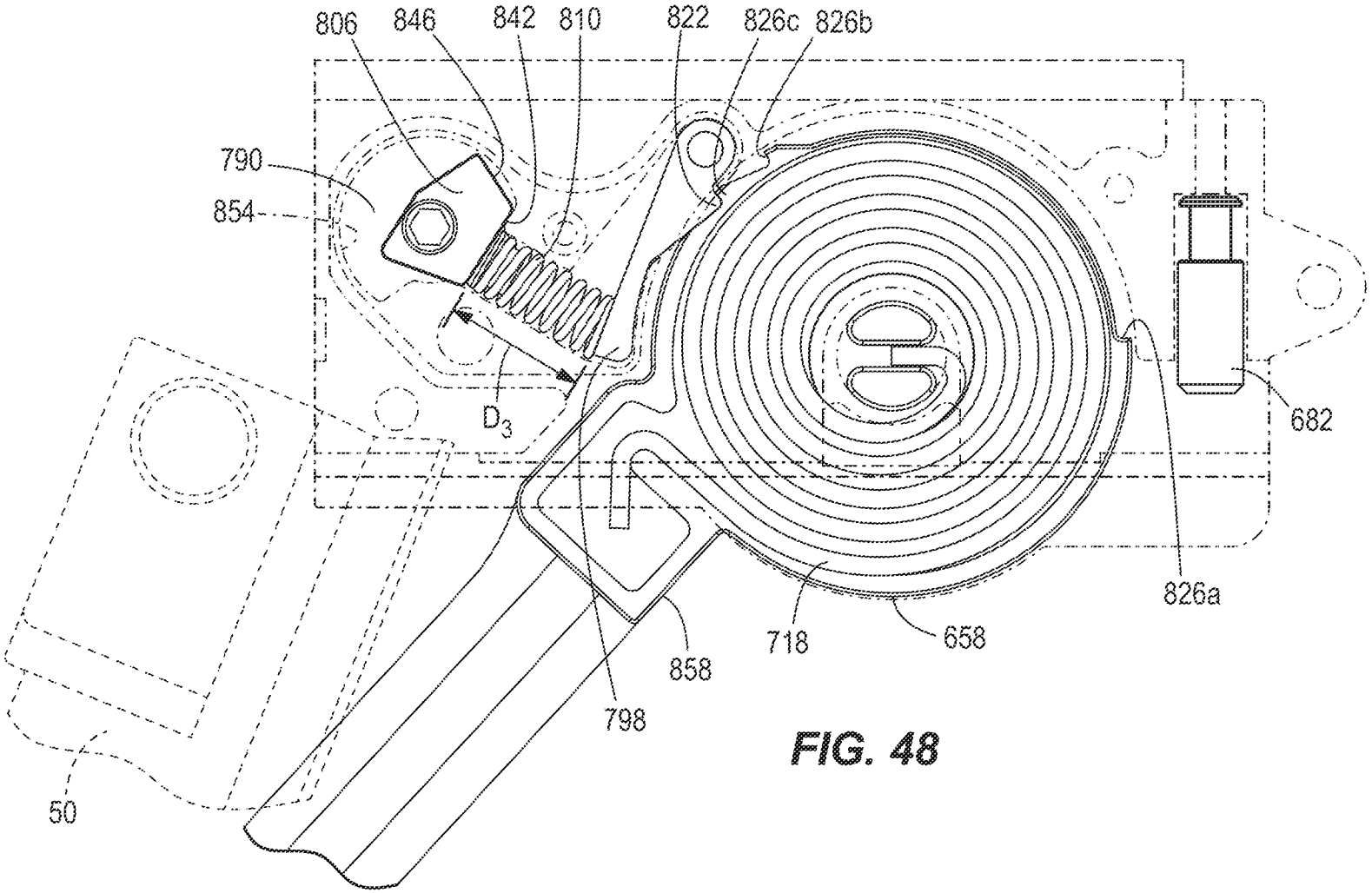
FIG. 48 is a top down view of the door close mechanism of FIG. 44 with the door illustrated in a third open position, and separately illustrating the cam adjusted to a third position to further increase the force applied by the spring to hold the door in the open position.

FIG. 48 illustrates the door 50 in a second open position that is more open (i.e., the housing 658 is rotated further open) than the open position of the door 50 shown in FIG. 47. In addition, and unrelated to the opening or closing of the door 50, the cam 806 has been rotated to a third position such that the third surface 842 is engaged with the spring 810 to further increase the force applied on the lever 798 by further compressing the spring 810. More specifically, the cam 806 has been rotated such that the third surface 842 of the cam 806 is in engagement with the spring 810, and the fourth surface 846 of the cam 806 is in engagement with another portion of the wall 854 of the recess 790. The cam 806 in this third position further shortens the distance D (to $D_3$) and further increases the force on the lever 798, relative to the force applied when the cam 806 is in the first position (FIG. 44) or second position (FIG. 47), by further compressing the spring 810 to increase the force applied on the lever 798 by the spring 810.

FIG. 48 also separately illustrates the door 50 in a second hold-open position in which the protrusion 822 is engaged with a third stop 826*c* to hold the door 50 open. To overcome the door hold-open force, a user applies a closing force to the door 50 that exceeds the hold-open force being applied by the spring 810. In doing so, the housing 658 rotates (counter-clockwise as viewed in FIG. 48). As the housing 658 rotates, the third stop 826*c* applies a force to the protrusion 822 causing the lever 798 to pivot, compressing the spring 810. The lever 798 pivots until the protrusion 822 is withdrawn from the window 786 (see FIG. 35), or otherwise is received within the recess 790, such that the third stop 826*c* is no longer in engagement with the protrusion 822. The third stop 826*c* is no longer obstructed (by the protrusion 822 on the lever 798), and the housing 658 is free to rotate. The spring 718 uncoils, further rotating the housing 658 toward the closed position. The user may have to continue to apply (or apply an additional) closing force to the door 50 to disengage the protrusion 822 from the second stop 826*b* (shown in FIG. 47). Once the door 50 reaches the position illustrated in FIG. 45, the spring 718 and the plunger 682 cooperate to maintain the substantially constant door close force (i.e., the soft door closure). As the door 50 closes, the soft door closure activates when the surface 85558 of the arm 798 contacts the extended plunger 682. Once in contact, the plunger 682 slowly compresses (compare FIG. 45 to FIG. 44), slowing closure of the door 50. The plunger 682 and the spring 718 together maintain a substantially constant door close force.

It should be appreciated that the door 50 can open farther (i.e. the housing 658 can rotate farther clockwise) than the positions illustrated in FIGS. 47 and 48. It should also be appreciated that the illustrated hold-open positions shown in FIGS. 47-48 operate independently of the position of the cam 806. The cam 806, and the associated adjustment of tension applied by the spring 810 on the lever 798, is independent of the door hold-open positions.

Figure 49:
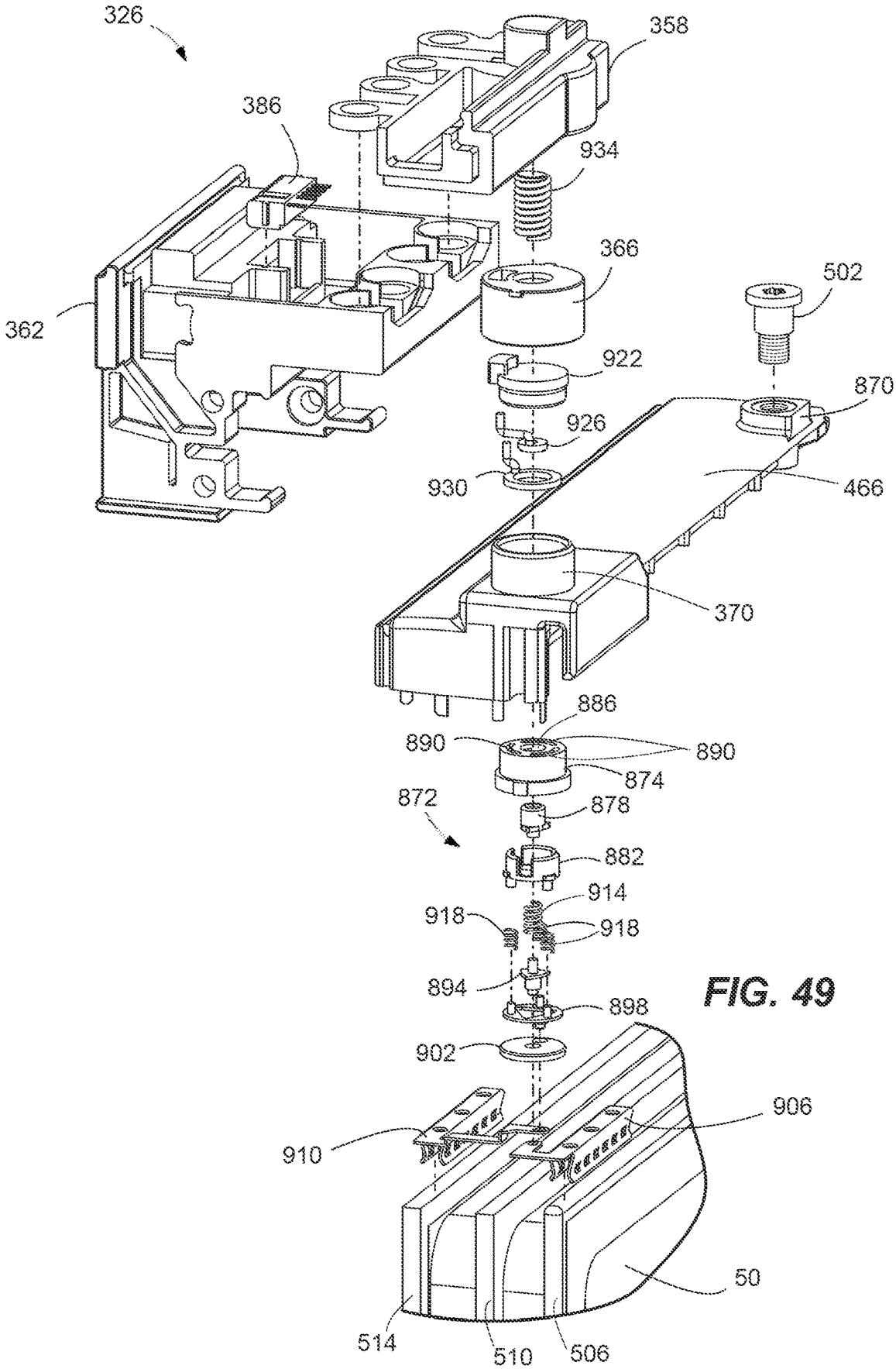
FIG. 49 is an exploded view of a portion of an electrically-powered door hinge assembly positioned on a top end of the door and configured to engage an upper center mullion mounting assembly of FIG. 7.
Figure 50:
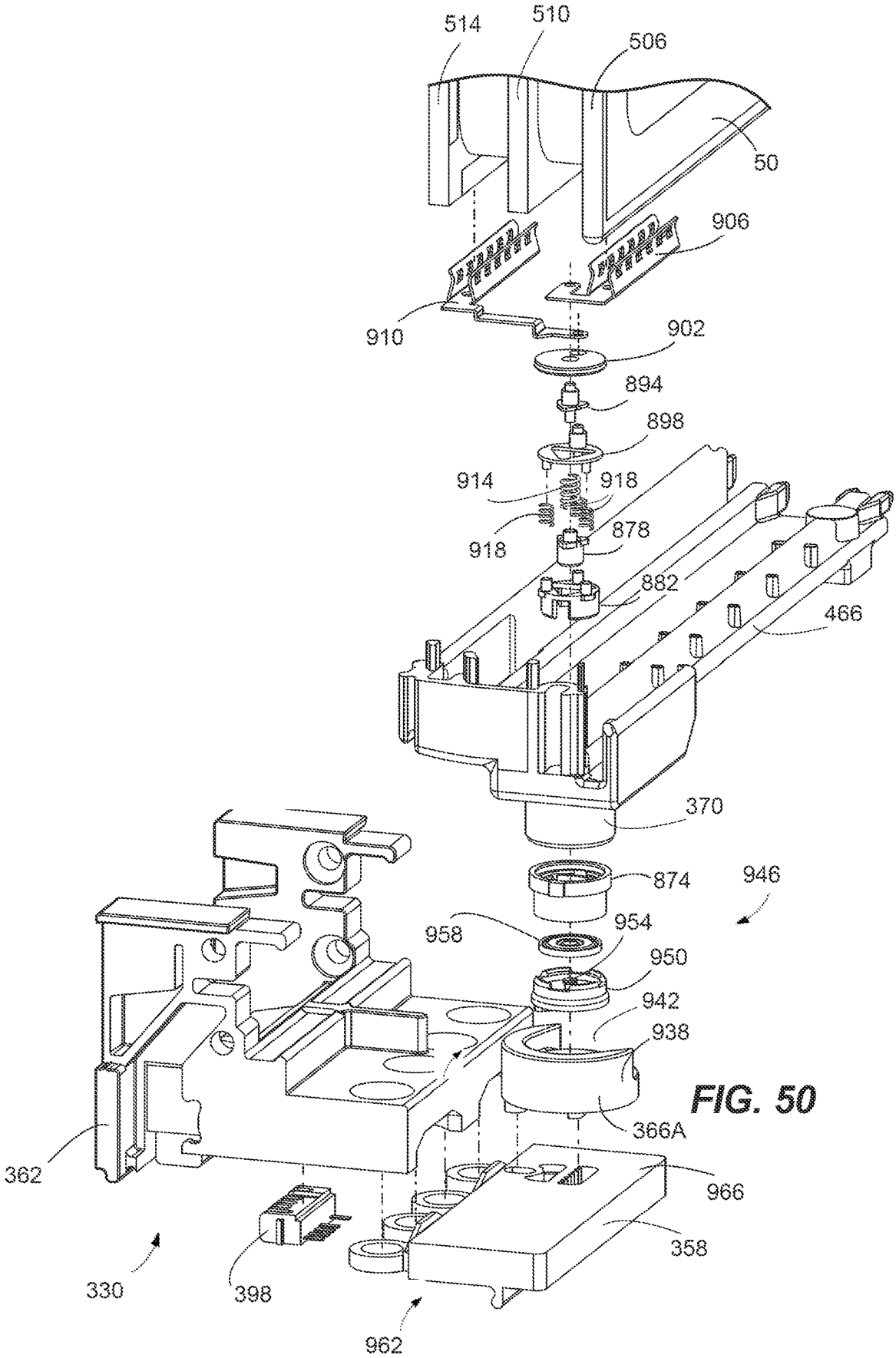
FIG. 50 is an exploded view of a portion of an electrically-powered door hinge assembly positioned on a bottom end of the door and configured to engage a lower center mullion mounting assembly of FIG. 7.
Figure 51:
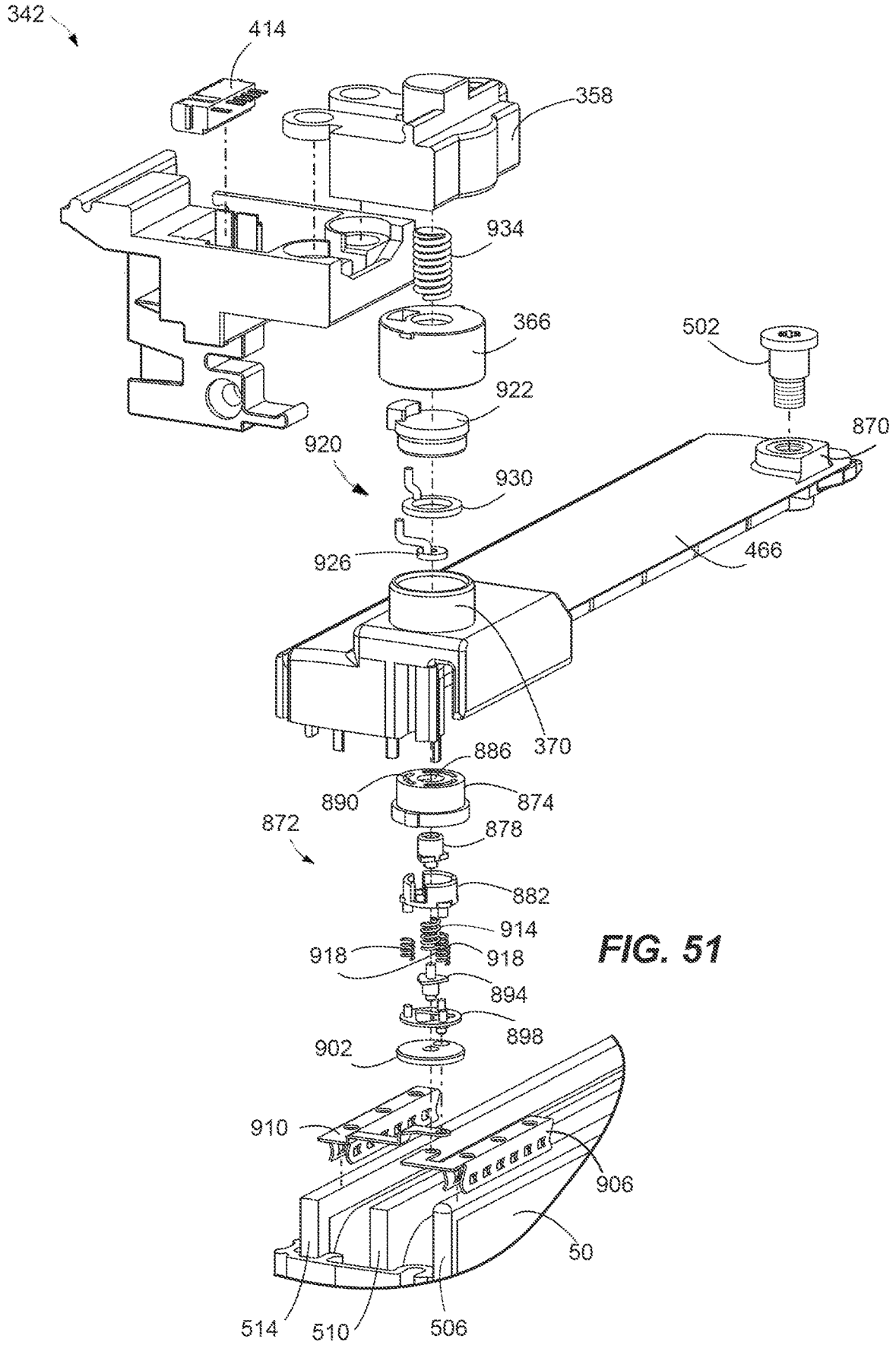
FIG. 51 is an exploded view of a portion of an electrically-powered door hinge assembly positioned on the top end of the door and configured to engage an end mullion mounting assembly of FIG. 7.
Figure 52:
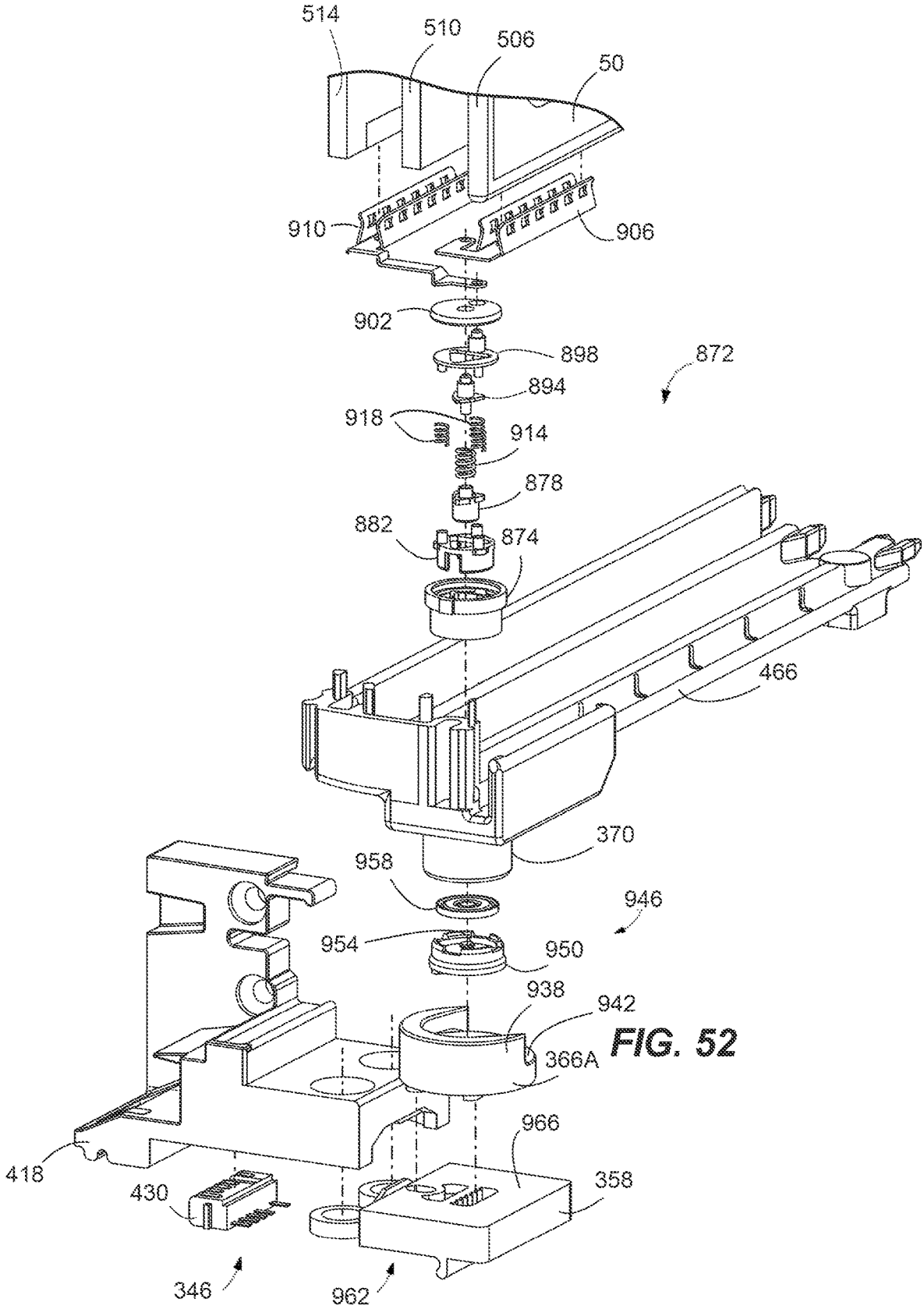
FIG. 52 is an exploded view of a portion of an electrically-powered door hinge assembly positioned on the bottom end of the door and configured to engage a lower end mullion mounting assembly of FIG. 7.

FIGS. 49 and 50 illustrate the electrical connection (or powered hinge) between the center mullion mounting assembly 326, 330 and the door 50, and FIGS. 51 and 52 illustrate the electrical connection (or powered hinge) between the end mullion mounting assemblies 342, 346 and the door 50. Since the electrical connections between the door 50 and the top mullion mounting assemblies 326, 342 are substantially the same, and the electrical connections between the door 50 and the bottom mullion mounting assemblies 330, 346 are substantially the same, they will be discussed together.

With reference to FIGS. 49 and 51, the corner member 466 of the door 50 includes a mounting aperture 870 that is configured to selectively receive the door closure guide mount 502. For example, in the illustrated embodiment, the door closure guide mount 502 is a threaded member and is threadably received by corresponding threads of the mounting aperture 870. Since the door closure guide mount 502 is generally positioned on one end of the door 50 (e.g., atop end, etc.), the door closure guide mount 502 can be selectively removed and repositioned when the door 50 is removed and rotated into another configuration (e.g., rotated from a left-hand open configuration to a right-hand open configuration, etc.).

The door pivot 370 on the corner member 466 carries a first electrical connector 872. The first electrical connector 872 includes a housing 874 that receives a first electrical element 878 and a second electrical element 882. The first and second electrical elements 878, 882 are arranged in a concentric relationship, and are received by respective slots 886, 890 in the housing 874. The first electrical element 878 is received by a first, central slot 886 in the housing 874. The second electrical element 882 is received by corresponding second slots 890. While the second electrical element 882 is illustrated as having a plurality of prongs or contacts, in other embodiments, the second electrical element 882 can be a continuous element that is circular or some other suitable polygonal shaped element.

Each of the first and second electrical elements 878, 882 are coupled to an associated electrical contact 894, 898. More specifically, a first electrical contact 894 is coupled to the first electrical element 878, while a second electrical contact 898 is coupled to the second electrical element 882. The electrical contacts 894, 898 are also arranged in a concentric relationship, with the first electrical contact 894 being surrounded by the second electrical contact 898. Stated another way, the first electrical contact 894 is nested in the second electrical contact 898. The first and second electrical contacts 894, 898 are coupled to a carrier 902 that electrically isolates the electrical contacts 894, 898. A portion of each contact 894, 898 extends through the carrier 902 to engage a respective electrical tab 906, 910. Each electrical tab 906, 910 is positioned in contact with a respective glass panel 506, 514 of the door 50. More specifically, the first contact 894 is connected to a first electrical tab 906, which engages the first panel 506 (or outermost panel 506) that is exposed to the ambient environment surrounding the merchandiser 10. The second contact 898 is connected to a second electrical tab 910, which engages the third panel 514 (or innermost panel) that is exposed to and faces the temperature controlled product display area 54. The first and second electrical tabs 906, 910 can be tabs, connectors, electrical conductors, or any other suitable conductive element (including combinations of tabs, conductors, etc.) that is configured to provide a powered connection to the door 50.

The electrical elements 878, 882 are each biased away from the door 50 to facilitate a connection with the associated hinge portion 358. A first biasing member 914 is positioned between the first electrical element 878 and the first contact 894, and applies a biasing force on the first electrical element 878 to bias the first electrical element 878 through the central slot 886. Similarly, a plurality of second biasing members 918 are positioned between the second electrical element 882 and the second contact 898. The second biasing members 918 apply a biasing force on the second electrical element 882 to bias the second electrical element 882 through the second slots 890. While the biasing members 914, 918 are illustrated as springs, any suitable spring like member can be used to bias the electrical elements 878, 882 away from the door 50. In addition, while the illustrated embodiment includes a plurality of second biasing members 918, in other embodiments a single biasing member 918 can be used to bias the electrical element 882.

The hinge portion 358 includes a second electrical connector 920 (or a top hinge electrical connector 920) that is received by the recess 366. The recess 366 includes an outer lip that is substantially the same height around the perimeter of the recess 366. The second electrical connector 920 includes a second housing 922 that receives a third electrical contact 926 and a fourth electrical contact 930. The electrical contacts 926, 930 are electrically isolated from each other by the housing 922. In addition, the electrical contacts 926, 930 are arranged in a concentric relationship, with the third electrical contact 926 being nested in the fourth electrical contact 930. A biasing member 934, illustrated as a spring, applies a bias force on the second housing 922 to bias the second housing 922 toward the door 50.

With reference to FIGS. 50 and 52, the corner member 466 of the door 50 that is positioned at the bottom of the door 50 includes the same first electrical connector 872 as at the top of the door 50 (illustrated in FIGS. 49 and 51). For ease of understanding like components are identified with the same reference numerals.

The hinge portion 358 on the mullion mounting assemblies 330, 346 includes the recess 366A that has an outer lip 938 and an opening 942 interrupting the outer lip 938. The recess 366A also includes a third electrical connector 946 (a bottom hinge electrical connector 946) that is received by the recess 366A and that has a third housing 950 that carries a fifth electrical contact 954 and that receives a sixth electrical contact 958. The electrical contacts 954, 958 are electrically isolated from each other by the housing 950. The electrical contacts 954, 958 are arranged in a concentric relationship, with the fifth electrical contact 954 nested in the sixth electrical contact 958.

To install the door 50 into the frame assembly 46, a user first positions the top end of the door pivot 370 (shown in FIGS. 49 and 51) into engagement with the recess 366 on the top mounting assembly 326, 342 so that the recess 366 receives the door pivot 370. A user can then apply an additional upward force on the door 50 toward the top mounting assembly 326, 342 to overcome the bias of the biasing member 934. This additional upward force provides sufficient clearance for the user to slide the bottom end of the door pivot 370 (shown in FIGS. 50 and 52) into engagement with the recess 366A on the bottom mounting assembly 330, 346. The user can slide the door pivot 370 into the recess 366A through the opening 942 in the outer lip 938. After both the top and bottom door pivots 370 are received by the respective recesses 366, 366A, the user can remove his or her force on the door 50. The biasing members 914, 918 in the first electrical connectors 872 bias the electrical elements 878, 882 into engagement with respective electrical contacts 926, 930 (in the top mounting assembly 326, 342) or electrical contacts 954, 958 (in the bottom mounting assembly 330, 346). Upon release of the external force, an automatic electrical connection is established between the door 50 and the merchandiser 10, which provides electricity from the respective mounting assemblies 326, 330 or 342, 346 to the door 50. In turn, the electricity can be used to selectively heat one or more of the glass panels 506, 510, 514.

For example, the controller 670 (shown in FIG. 32) can be in operable communication with the electrical connections formed between the first and second electrical connector 872, 920 or the first and third electrical connector 872, 946. Based on a door position detected from the sensor 666, the controller 670 activates (or powers on) the electrical connections formed by the electrical connectors. For example, in response to the controller 670 detecting that the door 50 is in a first door position that can cause condensation to build up on the first surface 518 of the first glass panel 506 (i.e. the surface of the glass panel 506 that is exposed to the ambient environment surrounding the merchandiser 10), the controller 670 is programmed to provide (or otherwise activate) the flow of electricity to the first electrical tabs 906. The electricity can increase the temperature of the glass panel 506 (e.g., through a conductive coating, etc.) to reduce or minimize condensation on the glass panel 506.

In another example, and in response to the controller 670 (shown in FIG. 32) detecting that the door 50 is in a door position (the same position as described above or a different position) that can cause condensation to build up on the sixth surface 538 (or second innermost surface 538) of the glass panel 514 (shown in FIG. 27), of the door 50 (i.e., the surface of the glass panel 514 that is exposed to or faces the temperature controlled product display area 54), the controller 670 is programmed to instruct (or otherwise activate) the flow of electricity to the second electrical tabs 910. The electricity can increase the temperature of the glass panel 514 (e.g., through a conductive coating, etc.) to reduce or minimize condensation on the glass panel 514.

The electricity increases the temperature of the associated glass panel 506, 510, 514 (shown in FIG. 27), which reduces or minimizes condensation. Preferably, the electricity is low voltage, which is less than or equal to 48 volts (e.g., less than or equal to 24 volts). The use of low voltage is intended to limit exposure or risk of electrical shock since multiple surfaces 518, 538 are accessible to a user. In addition, by selectively providing electricity to the door 50, total use of electricity decreases.

Figure 3:
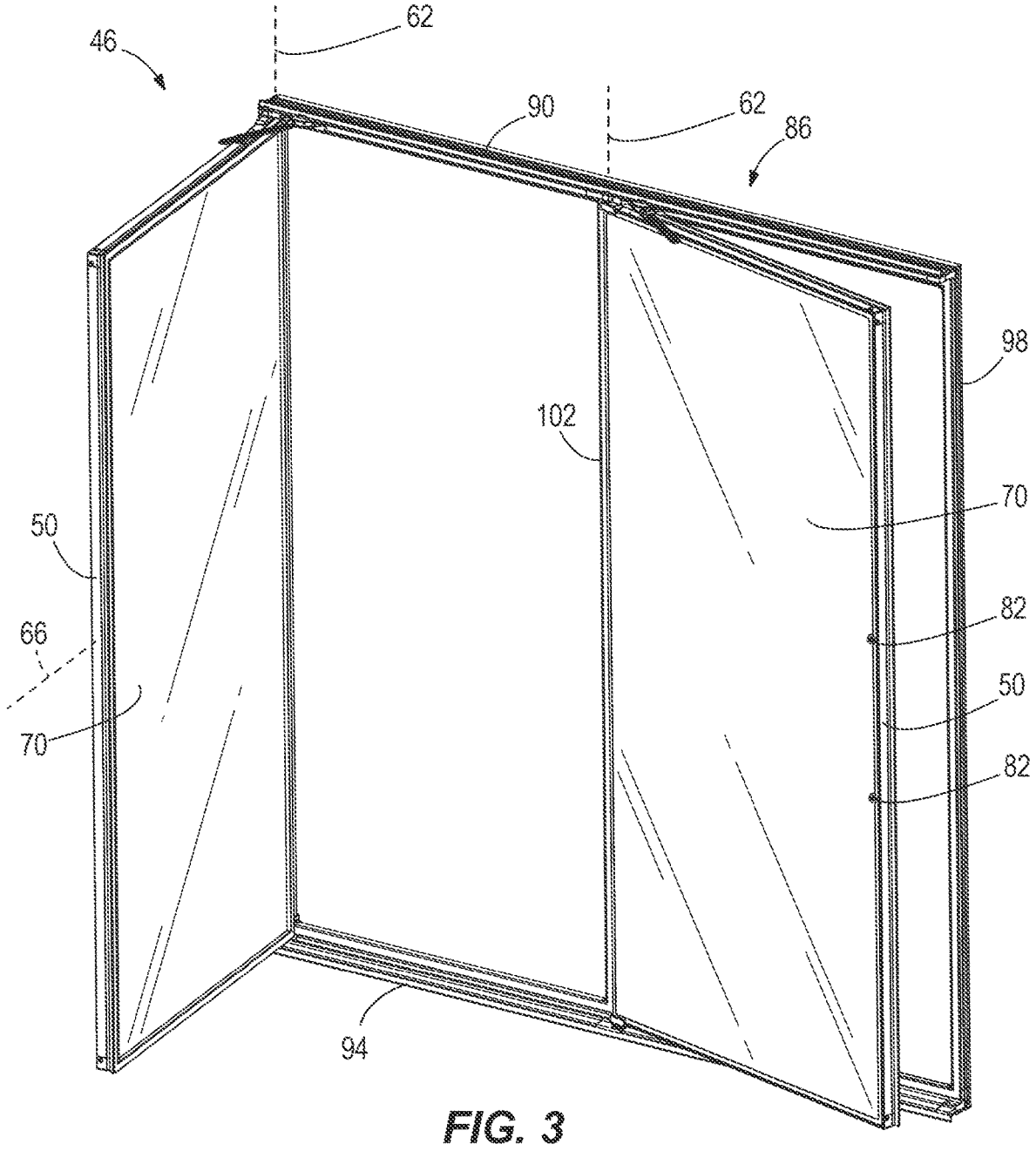
FIG. 3 is a perspective view of a portion of the case frame assembly including two doors attached to a section of the case frame for use with the refrigerated merchandiser of FIG. 1, with each door including a modular door frame assembly and oriented in a left-hand open configuration and at least partially open.
Figure 4:
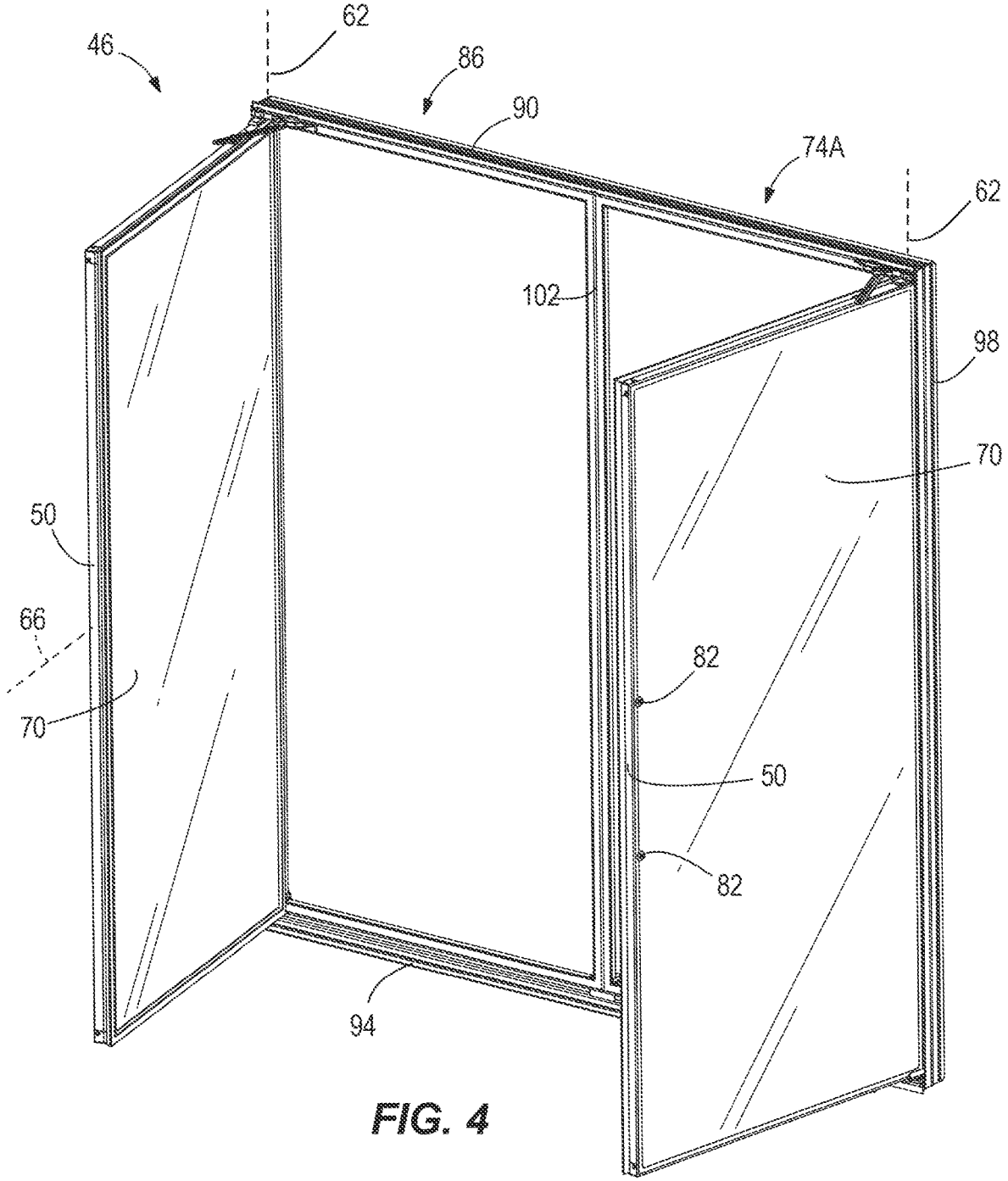
FIG. 4 is a perspective view of a portion of the case frame assembly including two doors attached to a section of the case frame for use with the refrigerated merchandiser of FIG. 1, with each door including the modular door frame assembly and oriented in a double door configuration and in at least a partially open position.
Figure 5:
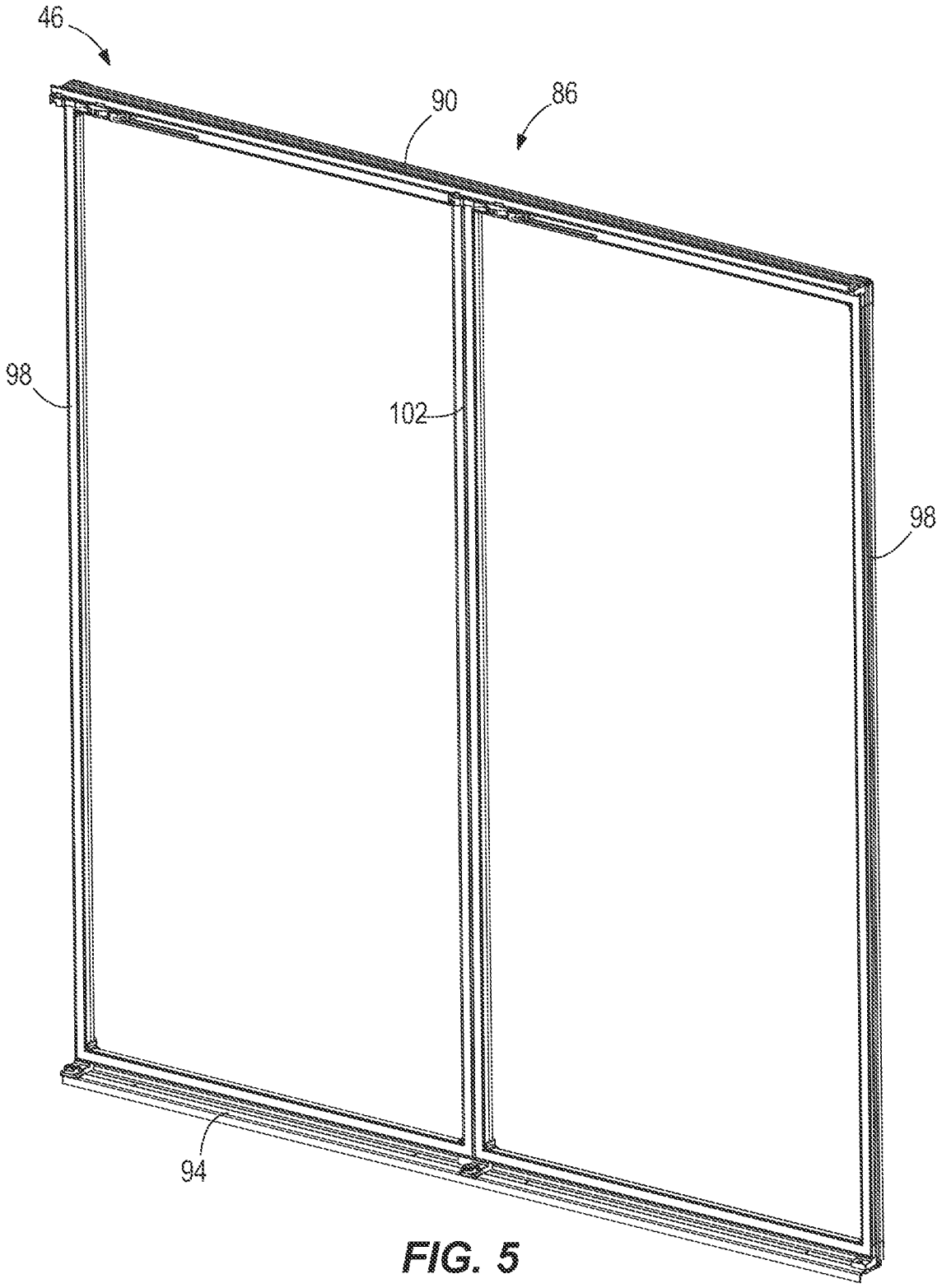
FIG. 5 is a perspective view of the portion of the case frame of FIG. 3 with the doors removed.
Figure 53:
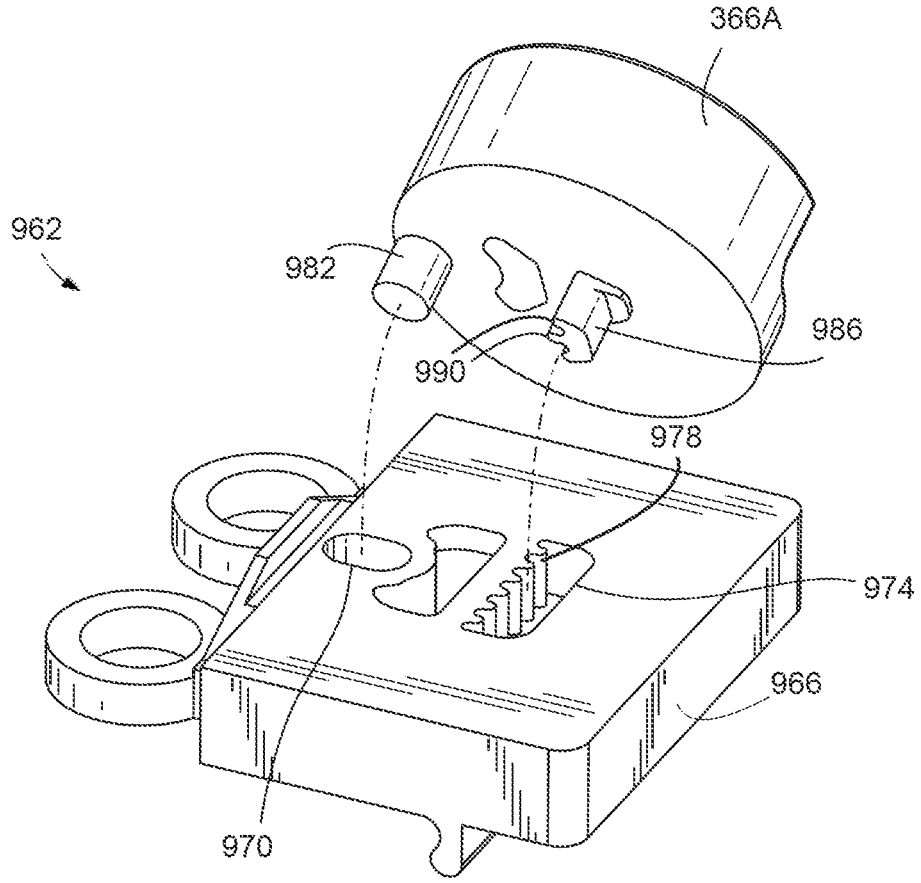
FIG. 53 is a perspective view of a door camber adjustment assembly disposed in the mullion mounting assembly of FIG. 7.

FIG. 53 illustrates a door camber adjustment assembly 962 that is positioned in the lower portion of the case frame and door assembly, and that is manipulatable to adjust the camber position of the door 50 (i.e. a position of the door about a plane that is parallel to the horizontal axis 66 shown in FIGS. 3-4). The door camber adjustment assembly 962 includes an adjustment member 966 that is coupled to or disposed in the lower frame member and that defines a first aperture 970 and a second aperture 974. The first aperture 970 is elongated (or oblong or oval), and extends in or is elongated in a direction toward the second aperture 974. The second aperture 974 extends approximately perpendicular to the elongated orientation of the first aperture 970 (in a direction parallel to the bottom frame member 450 of the door 50, shown in FIG. 25) and includes a plurality of teeth 978 to define a rack. The adjustment member 966 is configured to attach to or be incorporated in the hinge portion 358 (see FIG. 52). As shown in FIG. 53, the hinge portion 358 includes a first projection 982 and a second projection 986 on an underside of the portion 358. The first projection 982 is received by (or positioned in) the first aperture 970, and the second projection 986 includes a plurality of teeth 990 and is received by (or positioned in) the second aperture 986. It should be appreciated that the apertures and projections can be reversed, and separately that the assembly 962 can include the first and second projections 982, 986.

To adjust the camber of the door 50, and with the door 50 removed, the user can position the hinge portion 358 into selective engagement with the adjustment member 966. More specifically, the user can position the second projection 986 into the second aperture 974, engaging the teeth 990 with the teeth 978 at a position or in a specific relationship along the second projection 986. The user can then position the hinge portion 358 such that the first projection 982 is received by the first aperture 970. The door camber is based on the position of the second projection 986 along the second aperture 974. For example, when the second projection 986 is positioned in the second aperture 974 at an end closest to the door 50, the upright member 454, 458 of the door 50 (shown in FIG. 25) opposite (or farthest from) the door camber adjustment assembly 962 will move upward toward the top frame member 90 (shown in FIG. 3). In another example, when the second projection 986 is positioned in the second aperture 974 at an end farthest from the door 50, the upright member 454, 458 of the door 50 (shown in FIG. 25) opposite (or farthest from) the door camber adjustment assembly 962 will move downward toward the bottom frame member 94 (shown in FIG. 3). The camber of the door 50 can be fine-tuned by positioning the second projection 986 at a position between the ends of the second aperture 974. The elongated first aperture 970 permits positioning of the hinge portion 358 at different positions along the rack defined by the plurality of teeth 978.

Figure 54:
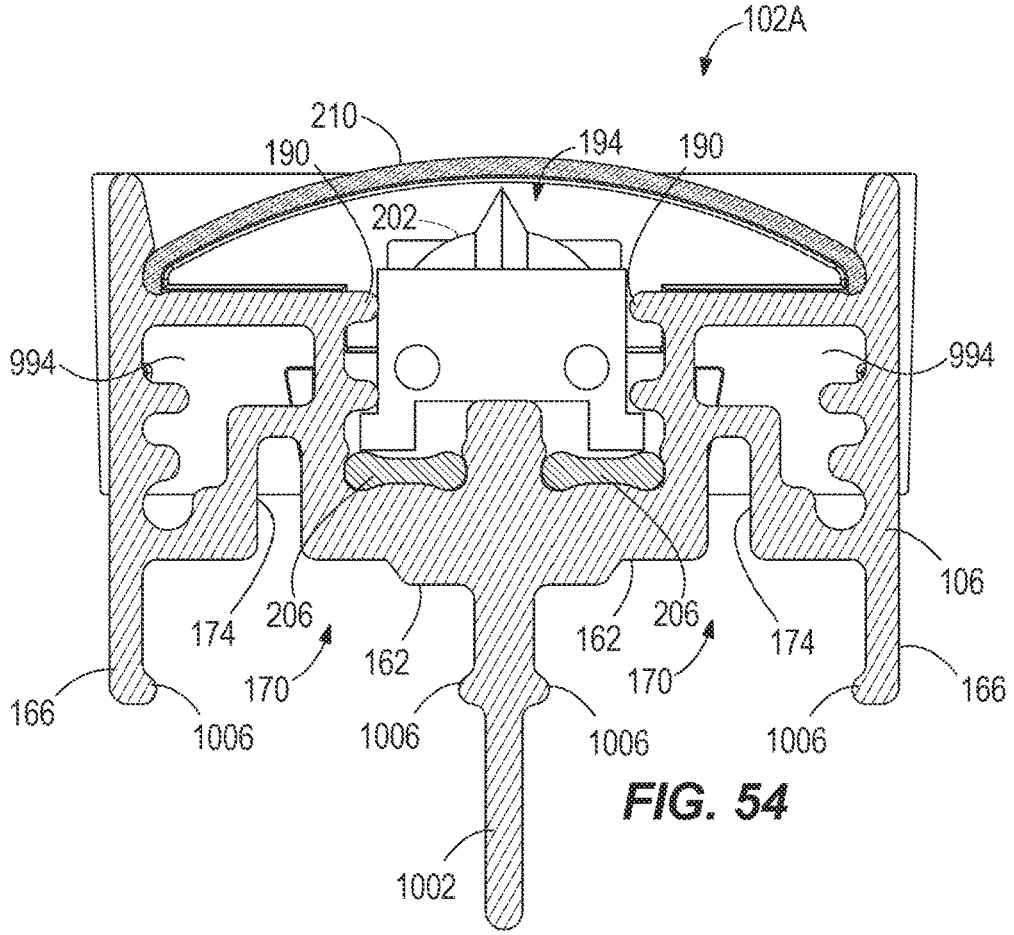
FIG. 54 is a cross-sectional view of another exemplary center mullion of the case frame and including a lens, a light assembly, and a heater.
Figure 55:
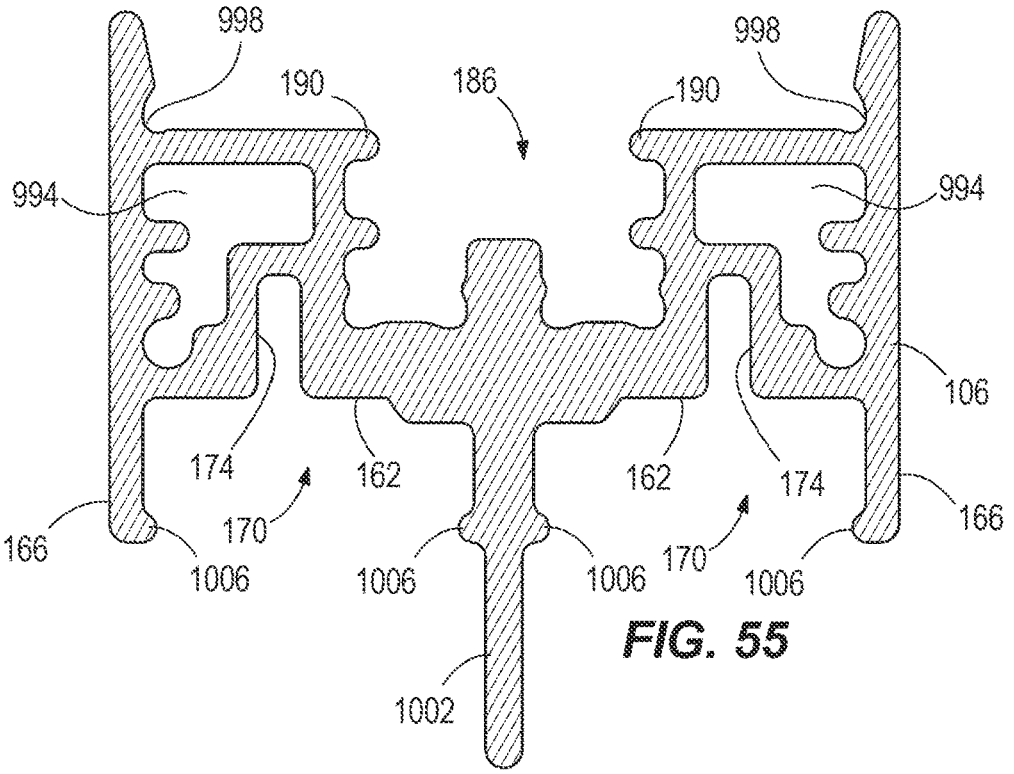
FIG. 55 is a cross-sectional view of the mullion body of the center mullion of FIG. 54, with the lens, light assembly, and heater removed.

FIGS. 54 and 55 illustrate another exemplary center mullion 102A that is similar to the center mullion 102. For ease of understanding like components are identified with the same reference numerals. In this embodiment, the mullion body 106 defines a plurality of elongated channels 994 that extend along a length of the center mullion 102A. The elongated channels 994 provide greater thermal insulation (when compared to existing mullion bodies) by carrying air flow, while also facilitating the removal of undesirable condensation by providing an exit path. The mullion body 106 also defines a notch 998 on each of the opposing sidewalls 166. The notches 998 are generally aligned and are positioned on an inside surface of each sidewall 166 to face one another. The notches 998 are configured to receive and retain an end of the mullion lens 210. In addition, the mullion body 106 defines a central wall 1002 that cooperates with each sidewall 166 to define the channels 170. The central wall 1002 extends a greater distance away from the support surface 162 than the sidewalls 166. The sidewalls 166 and the central wall 1002 also define a gasket retention hook 1006. The hooks 1006 extend from the sidewalls and central wall 1002 into each channel 170, and assist with retaining the associated gasket 550 (shown in FIG. 56). With reference to FIG. 54, the heater 206 is separated into a plurality of heaters 206 (e.g., two heaters).

Figure 56:
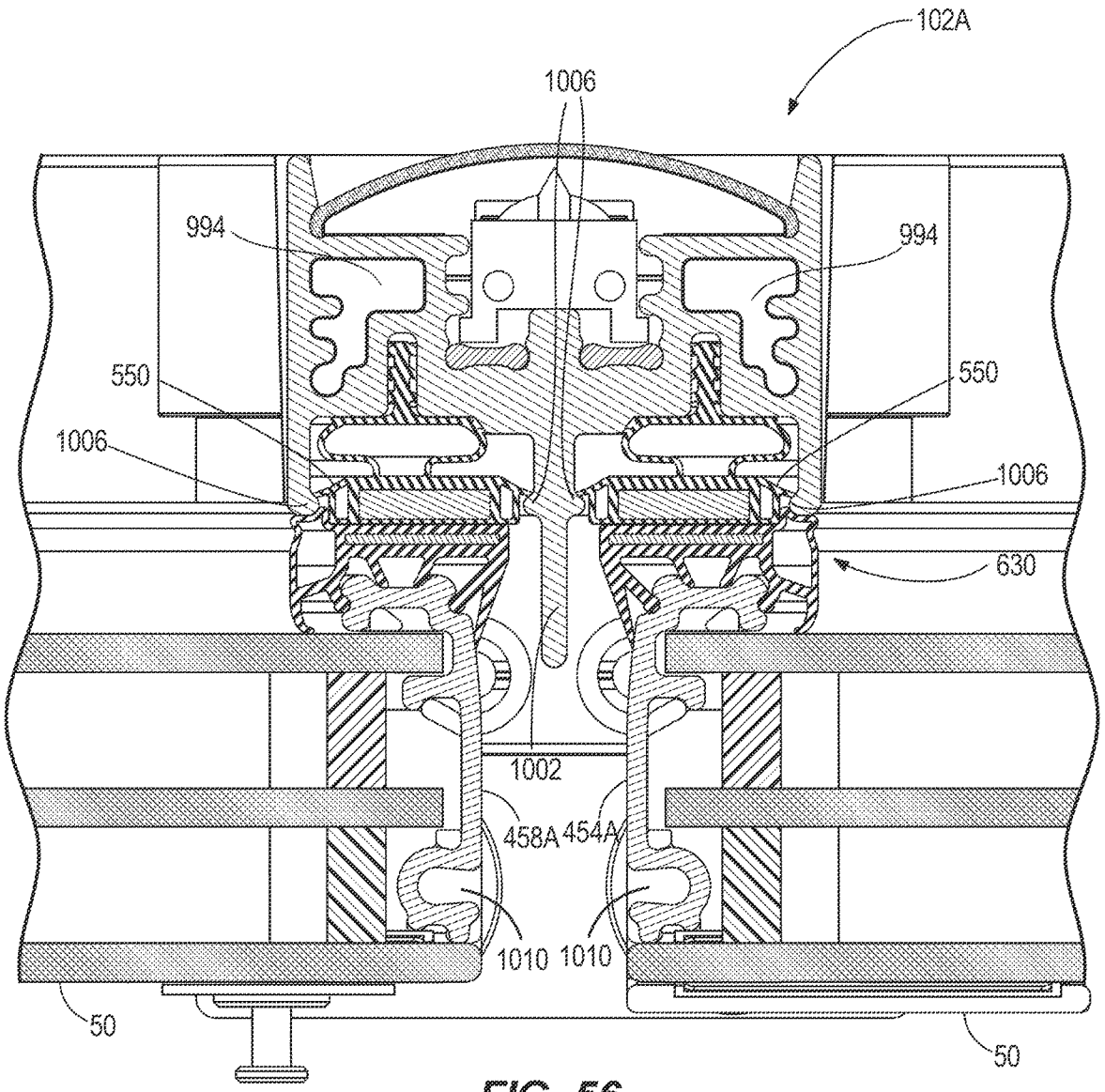
FIG. 56 is a cross-sectional view similar to FIG. 30 and illustrating the center mullion of FIG. 54.

FIG. 56 illustrates a cross-section of a portion of the door and case frame assembly that includes the doors 50, the center mullion 102A, and the seal assembly 630 that is positioned between each door 50 and the center mullion 102A. For ease of understanding like components are identified with the same reference numerals. The seal assembly 630 has the same components and operates in the same fashion as described with regard to the center mullion 102 (see FIG. 30). The gasket retention hooks 1006 engage with a portion of the gaskets 550 to assist with retaining the gaskets 550 in each channel 170 (shown in FIGS. 54-55). The doors 50 shown in FIG. 56 also include exemplary first and second upright members 454A, 458B that are similar to the members 454, 458. Each of the upright members 454A, 454B defines an elongated channel 1010 that has an open end facing outward away from the door 50. The channel 1010 is configured to receive one or more components (or add-on components) of the door 50. For example, additional lighting (e.g., a rope of LEDs, etc.) can be positioned in the channel 1010 to further illuminate the merchandiser 10.

Figure 57:
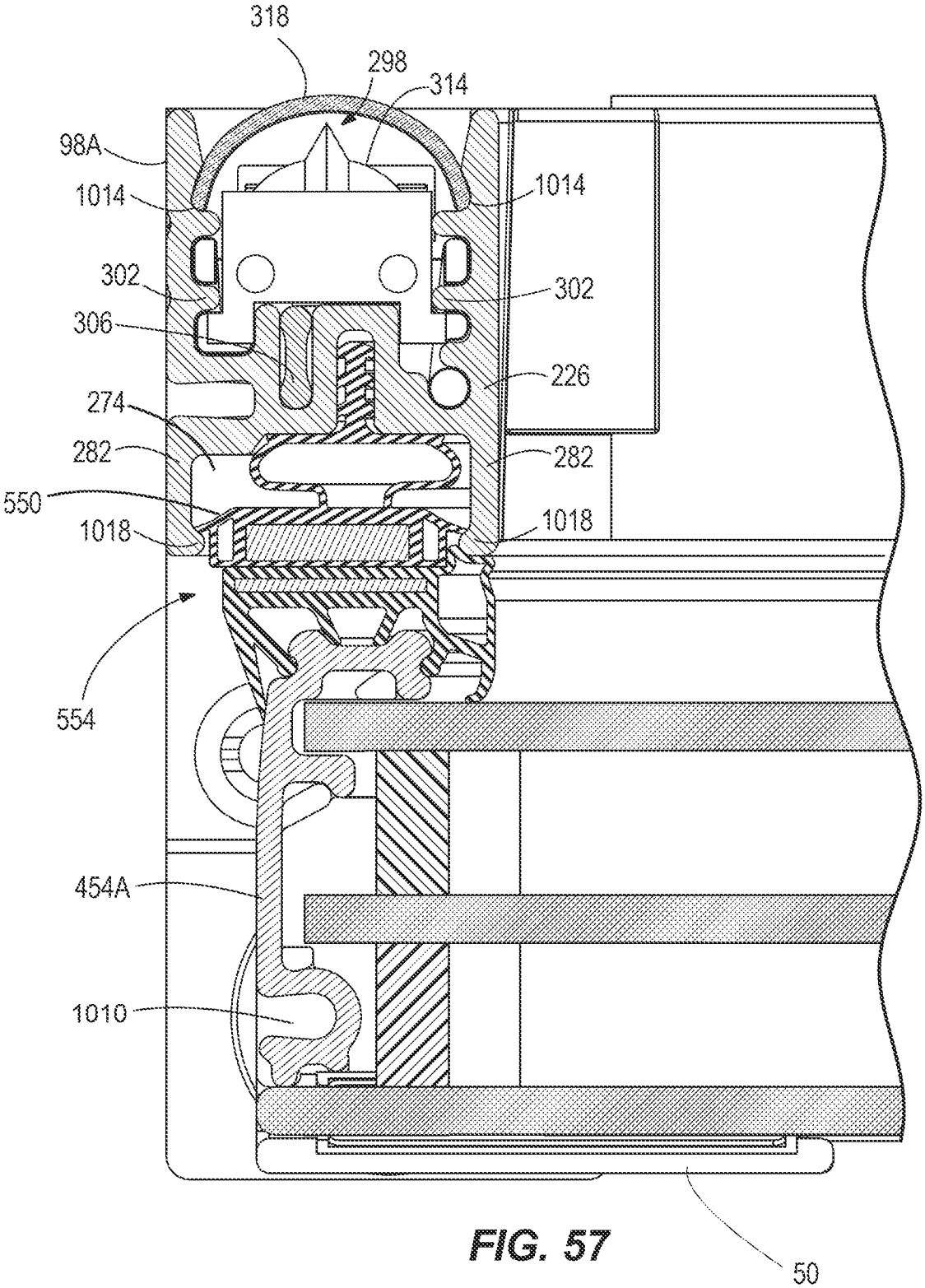
FIG. 57 is a cross-sectional view of a portion of a merchandiser similar to FIG. 27 and illustrating another exemplary end mullion and a portion of one door.

FIG. 57 illustrates another exemplary end mullion 98A that can be used in the merchandiser 10. For ease of understanding like components are identified with the same reference numerals. The seal assembly 554 has the same components as described with regard to the end mullion 98 (see FIG. 27). The mullion body 226 shown in FIG. 57 defines a notch 1014 on each of the opposite sidewalls 282. The notches 1014 are generally aligned and are positioned on an inside surface of each sidewall 282 to face one another.

The notches 1014 are configured to receive and retain an end of the mullion lens 318. The sidewalls 282 also define a gasket retention hook 1018 that extend from the sidewalls 282 into the channel 274. The hooks 1018 engage with a portion of the gasket 550 and assist with retaining the associated mullion gasket 550 (shown in FIG. 56). The door 50 also includes an upright member 454A that defines the elongated channel 1010.

Figure 58:
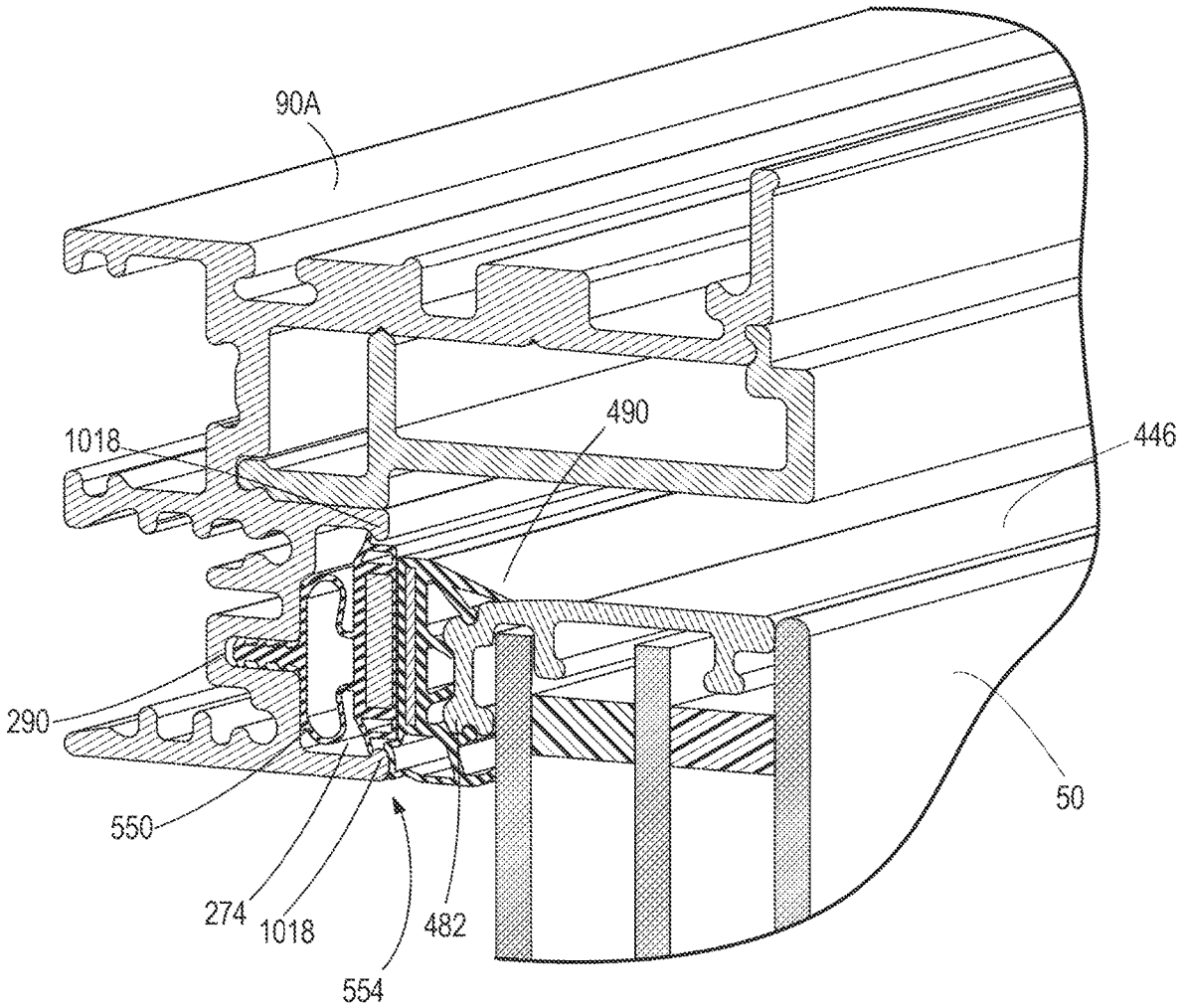
FIG. 58 is a cross-sectional view of a portion a merchandiser similar to the merchandiser of FIG. 1, illustrating another exemplary top frame member that forms a seal assembly.
Figure 59:
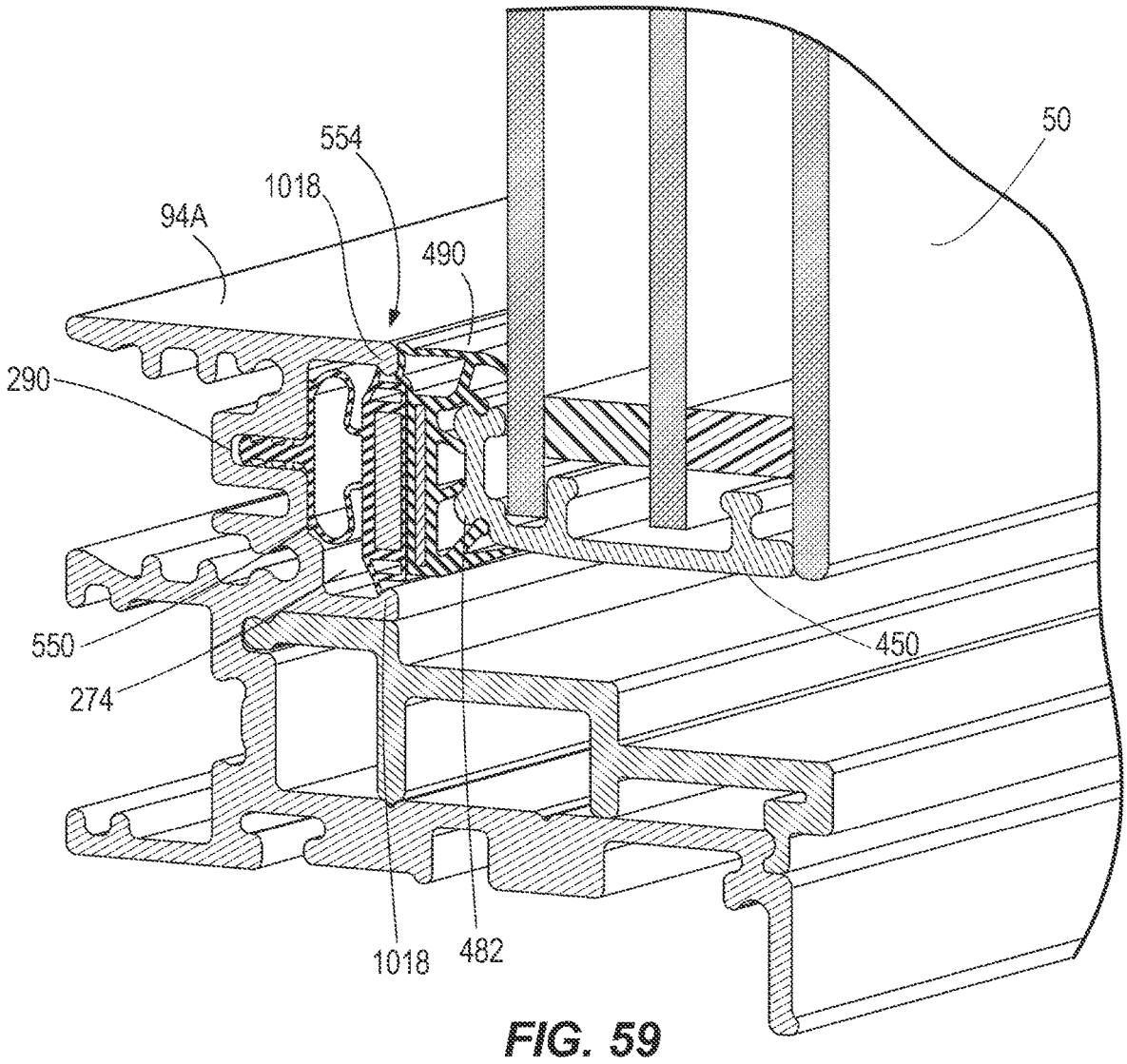
FIG. 59 is a cross-sectional view of a portion of a merchandiser similar to the merchandiser of FIG. 1, illustrating yet another exemplary top frame member that forms a seal assembly.

FIGS. 58 and 59 illustrate a cross-section of another embodiment of the top frame member 90A and the bottom frame member 94A, respectively, that, except as described below, are the same as the frame members 90, 94. For ease of understanding like components are identified with the same reference numerals. The top and bottom frame members 90A, 94A include the channel 274, the gasket securement cavity 290, and the hooks 1018 of the end mullion 98, 98A to receive the gasket 550. The top and bottom frame members 446, 450 of the door 50 also include the post 482 to engage the gasket 490. This allows the gaskets 490, 550 to form the seal assembly 554 along a width of the door 50 (i.e., along the top and bottom frame members 446, 450 of the door 50).

Figure 60:
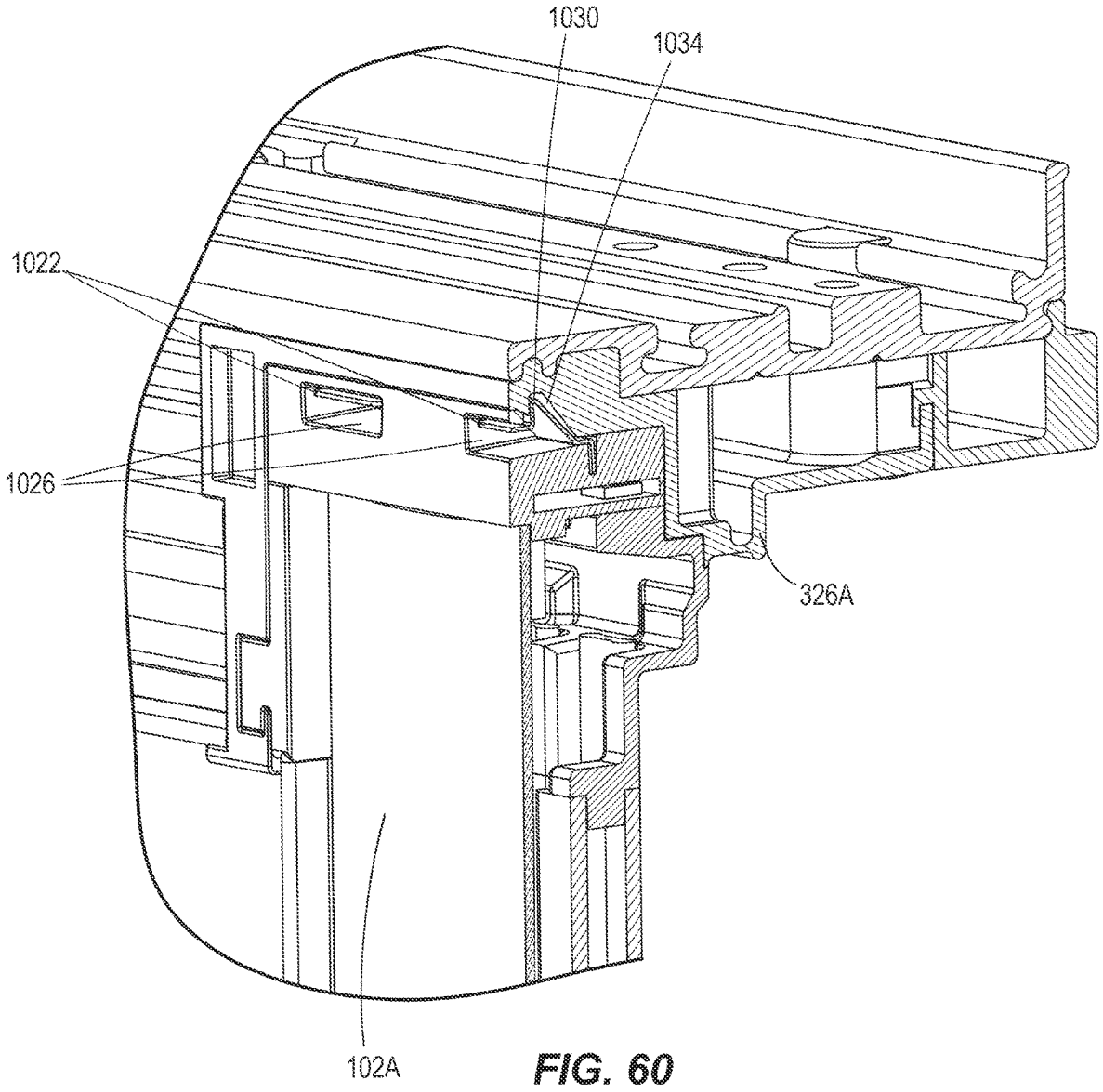
FIG. 60 is a cross-sectional view of the center mullion shown in FIG. 54 and other portions of the case frame assembly, illustrating another exemplary quick connect-disconnect assembly between the center mullion and the frame member with the center mullion attached to the frame member.
Figure 61:
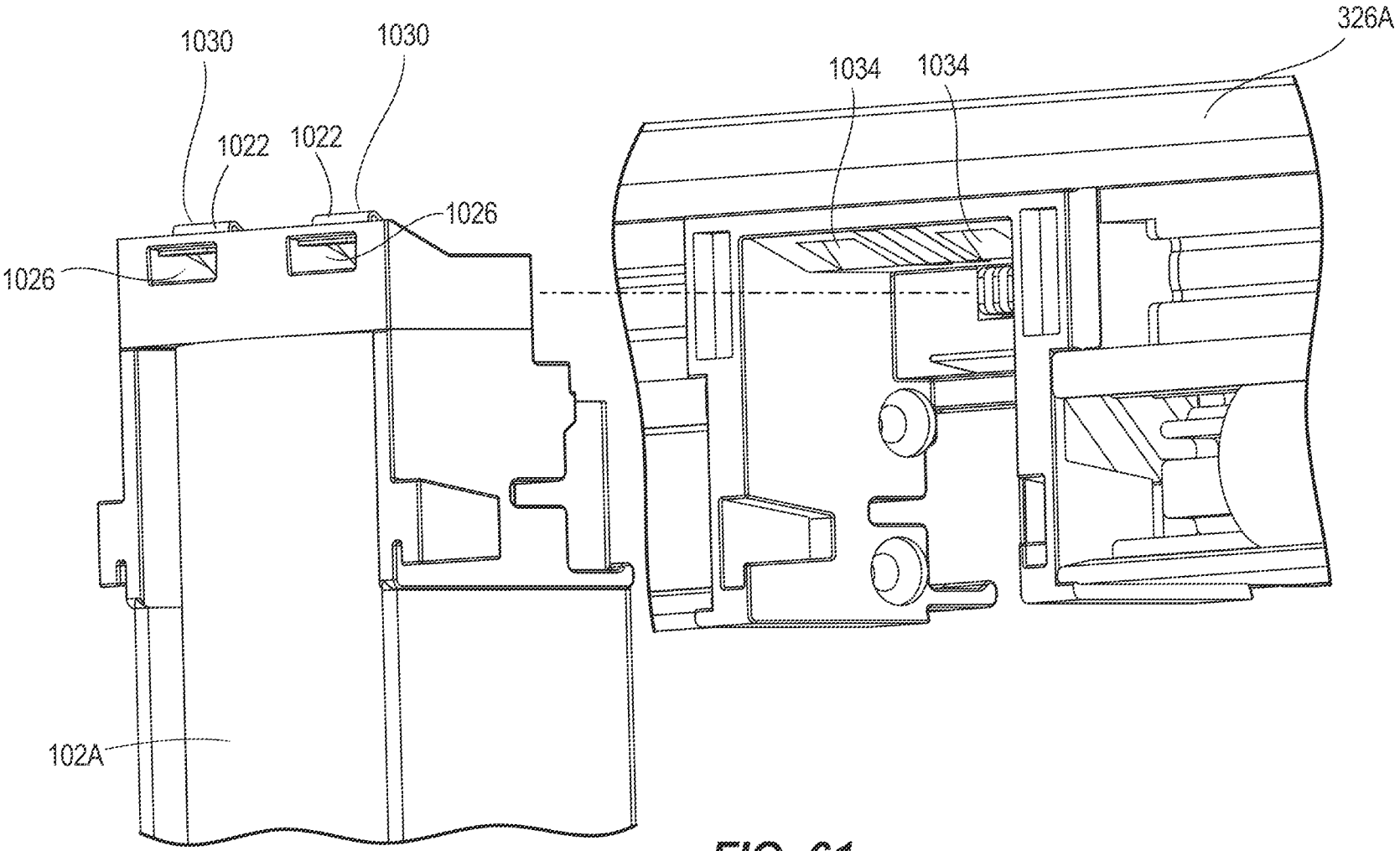
FIG. 61 is a cross-sectional view of the center mullion shown in FIG. 60, illustrating the center mullion detached from the frame member.

FIGS. 60 and 61 illustrate another exemplary quick connect-disconnect feature. For ease of understanding like components are identified with the same reference numerals. The center mullion 102A includes at least one biased clip 1022 (e.g., a spring clip) that is biased outward away from the mullion 102A. One end of each biased clip 1022 is configured to bend or pivot within a channel 1026 in the mullion 102A. Each clip 1022 also has a portion 1030 that extends or projects out of the mullion 102A, and is configured to be received by a corresponding recess 1034 in the mullion mounting assembly 326A. It should be appreciated that while the center mullion 102A is illustrated, one or more clips 1022 can be incorporated into the end mullion 98, 98A. In addition, in other embodiments, one biased clip 1022 or a plurality of biased clips 1022 can be used to attach each end of the mullion 98, 102. It should also be appreciated that one or more recesses 1034 can be incorporated into each associated mullion mounting assembly 326, 330, 342, 346.

To engage the mullion 102A with the mullion mounting assembly 326A, the mullion 102A is aligned such that each biased clip 1022 is positioned into proximity with an associated recess 1034. Each biased clip 1022 is then inserted into the associated recess 1034. The biasing force on each clip 1022 allows the portion 1030 to engage a complementary geometry of the recess 1034, securing the mullion 102A to the mullion mounting assembly 326A (shown in FIG. 60). To disengage the mullion 102A from the mullion mounting assembly 326A, a user applies sufficient force to the end of each biased clip 1022 (e.g., using a finger, screwdriver, etc.) to overcome the bias. The clip 1022 pivots in the channel 1026. The portion 1030 in turn pivots out of engagement with the recess 1034, freeing the mullion 102A to be disengaged and subsequently removed from mullion mounting assembly 326A and, optionally, repaired or replaced.

Various features and advantages of the invention are set forth in the following claims.

The invention claimed is:

1. A mullion assembly for a merchandiser, the mullion assembly comprising:

an elongated mullion body including a first end and a second end, the mullion body defining an elongated channel extending from the first end toward the second end along a longitudinal axis oriented along a length of the mullion body, the channel located adjacent a center of the mullion body and defined by a support surface of the mullion body;

a light assembly coupled to the mullion body within the channel, the light assembly including a circuit board and light emitting diodes coupled to the circuit board; and a heater coupled to the mullion body and positioned between the mullion body and the light assembly in direct contact with the light assembly, the light assembly and the heater positioned and configured to cooperatively heat the mullion body, wherein the circuit board is coupled to a surface of the heater.

2. The mullion assembly of claim 1, wherein the heater is coupled to the support surface and disposed in the channel.

3. The mullion assembly of claim 1, wherein the channel is a first channel on a first side of the mullion body and the mullion body defines a second channel on an opposite side of the mullion body, wherein the light assembly and the heater are positioned to heat air space adjacent the mullion body including the second channel.

4. The mullion assembly of claim 3, further comprising a gasket coupled to the mullion body within the second channel.

5. The mullion assembly of claim 1, wherein the mullion body further includes opposite outer walls and the mullion assembly further includes a lens coupled to the outer walls to enclose the light assembly.

6. The mullion assembly of claim 1, wherein the light assembly is only insertable into and removable from the channel from the first end or the second end.

7. The mullion assembly of claim 1, wherein the heater is defined by a resistance wire, and wherein the light assembly is electrically coupled to the resistance wire such that the resistance wire is configured to at least partially power the heater and the light assembly.

8. The mullion assembly of claim 1, further comprising an electrical connector coupled to the mullion body adjacent the first end, wherein the electrical connector is electrically coupled to the light assembly to provide power to the light assembly.

9. The mullion assembly of claim 1, wherein the heater is positioned to heat the mullion body when the light assembly is off.

10. The mullion assembly of claim 9, wherein the heater is configured to intermittently heat the mullion body.

11. The mullion assembly of claim 1, wherein the heater is configured to supplement heat generated by the light assembly.

12. The mullion assembly of claim 1, wherein the heater is positioned in contact with the mullion body to intermittently heat the mullion body.

13. The mullion assembly of claim 12, wherein the heater is configured to supplement heat generated by the light assembly.

14. A mullion assembly for a merchandiser, the mullion assembly comprising:

an elongated mullion body including a first end and a second end, the mullion body defining an elongated channel extending from the first end toward the second end along a longitudinal axis oriented along a length of the mullion body, the channel located adjacent a center of the mullion body and defined by a support surface of the mullion body;

a light assembly coupled to the mullion body within the channel; and a heater defined by a resistance wire and coupled to the mullion body, the heater positioned between the mullion body and the light assembly in direct contact with the light assembly, wherein the light assembly and the heater are positioned and configured to cooperatively heat the mullion body, and wherein the light assembly is electrically coupled to the resistance wire such that the resistance wire is configured to at least partially power the heater and the light assembly.

* * * * *